US007901285B2

(12) United States Patent
Tran et al.

(10) Patent No.: US 7,901,285 B2
(45) Date of Patent: Mar. 8, 2011

(54) AUTOMATED GAME MONITORING

(75) Inventors: Louis Tran, San Francisco, CA (US); Nam Banh, Aliso Viejo, CA (US)

(73) Assignee: Image Fidelity, LLC, San Francisco, CA (US)

( * ) Notice: Subject to any disclaimer, the term of this patent is extended or adjusted under 35 U.S.C. 154(b) by 362 days.

(21) Appl. No.: 11/052,941

(22) Filed: Feb. 8, 2005

(65) Prior Publication Data

US 2005/0272501 A1 Dec. 8, 2005

Related U.S. Application Data

(60) Provisional application No. 60/568,977, filed on May 7, 2004.

(51) Int. Cl.
*A63F 9/24* (2006.01)

(52) U.S. Cl. ..... 463/25

(58) Field of Classification Search ..... 463/29, 463/25, 30, 12; 273/148 R, 309; 348/143, 348/159, 207.1, 207.11
See application file for complete search history.

(56) References Cited

U.S. PATENT DOCUMENTS 4,357,015 A * 11/1982 Santora et al. ..... 463/22
4,531,187 A 7/1985 Uhland
4,928,175 A * 5/1990 Haggren ..... 348/159
5,258,837 A * 11/1993 Gormley ..... 348/441
5,605,334 A * 2/1997 McCrea, Jr. ..... 273/309
5,726,706 A * 3/1998 Walsh ..... 348/151
5,781,647 A * 7/1998 Fishbine et al. ..... 382/100
5,801,766 A 9/1998 Alden
5,831,527 A * 11/1998 Jones et al. ..... 340/540
5,831,669 A * 11/1998 Adrain ..... 348/143
6,126,166 A * 10/2000 Lorson et al. ..... 273/148 R
6,313,871 B1 * 11/2001 Schubert ..... 348/143
6,389,182 B1 5/2002 Ihara et al.
6,460,848 B1 10/2002 Soltys et al.
6,508,709 B1 * 1/2003 Karmarkar ..... 463/42
6,517,435 B2 * 2/2003 Soltys et al. ..... 463/25
6,517,436 B2 2/2003 Soltys et al.
6,520,857 B2 2/2003 Soltys et al.

(Continued)

OTHER PUBLICATIONS

Notification of Transmittal of the International Search Report and the Written Opinion of the International Searching Authority, or the Declaration, dated Sep. 25, 2007, for International Appln. No. PCT/US06/18939, filed May 17, 2006.

*Primary Examiner* — David L Lewis
*Assistant Examiner* — Omkar Deodhar
(74) *Attorney, Agent, or Firm* — Carr & Ferrell LLP

(57) ABSTRACT

The present invention provides a system and method for monitoring players in a game, extracting player and game operator data, and processing the data. In one embodiment, the present invention captures the relevant actions and/or the results of relevant actions of one or more players and one or more game operators in a game, such as a casino game. The system and methods are flexible in that they do not require special gaming pieces to collect data. Rather, the present invention is calibrated to the particular gaming pieces and environment already in use in the game. The data extracted can be processed and presented to aid in game security, player and game operator progress and history, determining trends, maximizing the integrity and draw of casino games, and a wide variety of other areas. The data is generally retrieved through a series of cameras that capture images of game play from different angles.

7 Claims, 44 Drawing Sheets

U.S. PATENT DOCUMENTS

| | | | | |
|---|---|---|---|---|
| 6,527,271 | B2 | 3/2003 | Soltys et al. | |
| 6,530,836 | B2 | 3/2003 | Soltys et al. | |
| 6,530,837 | B2 | 3/2003 | Soltys et al. | |
| 6,533,276 | B2 | 3/2003 | Soltys et al. | |
| 6,533,662 | B2 | 3/2003 | Soltys et al. | |
| 6,575,834 | B1 * | 6/2003 | Lindo | 463/40 |
| 6,579,180 | B2 | 6/2003 | Soltys et al. | |
| 6,579,181 | B2 | 6/2003 | Soltys et al. | |
| 6,582,301 | B2 | 6/2003 | Hill | |
| 6,595,857 | B2 | 7/2003 | Soltys et al. | |
| 6,612,930 | B2 | 9/2003 | Kawagoe et al. | |
| 6,663,490 | B2 | 12/2003 | Soltys et al. | |
| 6,688,979 | B2 | 2/2004 | Soltys et al. | |
| 6,712,696 | B2 | 3/2004 | Soltys et al. | |
| 6,848,994 | B1 * | 2/2005 | Knust et al. | 463/25 |
| 6,908,385 | B2 * | 6/2005 | Green | 463/29 |
| 6,938,900 | B2 * | 9/2005 | Snow | 273/292 |
| 2001/0029200 | A1 * | 10/2001 | Romero | 463/12 |
| 2002/0045478 | A1 | 4/2002 | Soltys et al. | |
| 2002/0094869 | A1 * | 7/2002 | Harkham | 463/42 |
| 2002/0118958 | A1 * | 8/2002 | Ishikawa et al. | 386/117 |
| 2002/0147042 | A1 * | 10/2002 | Vuong et al. | 463/40 |
| 2003/0060286 | A1 | 3/2003 | Walker et al. | |
| 2003/0064798 | A1 | 4/2003 | Grauzer et al. | |
| 2003/0069071 | A1 * | 4/2003 | Britt et al. | 463/42 |
| 2003/0096643 | A1 * | 5/2003 | Montgomery | 463/11 |
| 2003/0125109 | A1 * | 7/2003 | Green | 463/29 |
| 2003/0161539 | A1 | 8/2003 | Montgomery | |
| 2003/0195037 | A1 | 10/2003 | Vuong et al. | |
| 2003/0220136 | A1 | 11/2003 | Soltys et al. | |
| 2004/0023722 | A1 * | 2/2004 | Vuong et al. | 463/40 |
| 2005/0026680 | A1 * | 2/2005 | Gururajan | 463/25 |
| 2005/0137005 | A1 * | 6/2005 | Soltys et al. | 463/13 |
| 2005/0288086 | A1 * | 12/2005 | Schubert et al. | 463/11 |
| 2006/0177109 | A1 * | 8/2006 | Storch | 382/118 |
| 2006/0252554 | A1 | 11/2006 | Gururajan et al. | |
| 2007/0077987 | A1 | 4/2007 | Gururajan et al. | |

* cited by examiner

730

850

860

900

2440

AUTOMATED GAME MONITORING

CLAIM OF PRIORITY

This application claims priority to U.S. Provisional Application No. 60/568,977, entitled "AUTOMATED PLAYER TRACKING AND ANALYSIS SYSTEM AND METHOD", filed on May 7, 2004, having inventors Louis Tran, Nam Banh, Gaurav Dudhoria and Charles Dang; which is incorporated herein by reference.

BACKGROUND OF THE INVENTION

1. Field of the Invention

The present invention is directed to signal processing systems,

2. Description of the Related Art

Gambling activities and gaming relate back to the beginning of recorded history. Casino gambling has since developed into a multi-billion dollar worldwide industry. Typically, casino gambling consists of a casino accepting a wager from a player based on the outcome of a future event or the play of an organized game of skill or chance. Based on the result of the event or game play, the casino either keeps the wager or makes some type of payout to the player. The events include sporting events while the casino games include blackjack, poker, baccarat, craps, and roulette. The casino games are typically run by casino operators which monitor and track the progress of the game and the players involved in the game.

Blackjack is a casino game played with cards on a blackjack table. Players try to achieve a score derived from cards dealt to them that is greater than the dealer's card score. The maximum score that can be achieved is twenty-one. The rules of blackjack are known in the art.

Casino operators typically track players at table games manually with paper and pencil. Usually, a pit manager records a "buy-in", average bet, and the playing time for each rated player on paper. A separate data entry personnel then enters this data into a computer. The marketing and operations department can decide whether to "comp" a player with a free lodging, or otherwise provide some type of benefit to a player to entice the player to gamble at the particular casino, based on the player's data. The current "comp" process is labor intensive, and it is prone to mistakes.

Protection of game integrity is also an important concern of gaming casinos. Determining whether a player or group of players are implementing orchestrated methods that decrease casino winnings is very important. For example, in "Bringing Down the House", by Ben Mezrich, a team of MIT students beat casinos by using "team play" over a period of time. Other methods of cheating casinos and other gaming entities include dealer-player collusion, hole card play, shuffle tracking, and dealer dumping.

Automatic casino gaming monitoring systems should also be flexible. For example, a gaming monitoring system should be flexible so that it can work with different types of games, different types of gaming pieces (such as cards and chips), and in different conditions (such as different lighting environments). A gaming monitoring system that must be used with specifically designed gaming pieces or ideal lighting conditions is undesirable as it is not flexible to different types of casinos, or even different games and locations within a single casino.

What is needed is a system to manage casino gaming in terms of game tracking and game protection. For purposes of integrity, accuracy, and efficiency, it would be desirable to fulfill this need with an automatic system that requires minimal human interaction. The system should be accurate in extracting data from a game in progress, expandable to meet the needs of games having different numbers of players, and flexible in the manner the extracted data can be analyzed to provide value to casinos and other gaming entities.

SUMMARY OF THE INVENTION

The technology herein, roughly described, pertains to automatically monitoring a game. A determination is made that an event has occurred by capturing the relevant actions and/or results of relevant actions of one or more participants (i.e., one or more players and one or more game operators) in a game. Actions and/or processes are then performed based on the occurrence of the event.

A game monitoring system for monitoring a game may include a first camera, one or more supplemental cameras and an image processing engine. The first camera may be directed towards a game surface at a first angle from the game surface and configured to capture images of the game surface. The one or more supplemental cameras are directed towards the game surface at a second angle from the game surface and configured to capture images of the game surface. The first angle and the second angle may have a difference of at least forty-five degrees in a vertical plane with respect to the game surface. The image processing engine may process the images captured of the game surface by the first camera and the one or more supplemental cameras.

A method for monitoring a game begins with receiving image information associated with a game environment. Next, image information is processed to derive game information. The occurrence of an event is then determined from the game information. Finally, an action is initiated responsive to the event.

DETAILED DESCRIPTION

The present invention provides a system and method for monitoring a game, extracting player related and game operator related data, and processing the data. In one embodiment, the present invention determines an event has occurred by capturing the relevant actions and/or the results of relevant actions of one or more participants (i.e., one or more players and one or more game operators) in a game. Actions and/or processes are then performed based on the occurrence of the event. The system and methods are flexible in that they do not require special gaming pieces to collect data. Rather, the present invention is calibrated to the particular gaming pieces and environment already used in the game. The data extracted can be processed and presented to aid in game security, player and game operator progress and history, determine trends, maximize the integrity and draw of casino games, and a wide variety of other purposes. The data is generally retrieved through a series of images captured before and during game play.

Examples of casino games that can be monitored include blackjack, poker, baccarat, roulette, and other games. For purposes of discussion, the present invention will be described with reference to a blackjack game. Thus, some relevant player actions include wagering, splitting cards, doubling down, insurance, surrendering and other actions. Relevant operator actions in blackjack may include dealing cards, dispersing winnings, and other actions. Participant actions, determined events, and resulting actions performed are discussed in more detail below.

Figure 1:
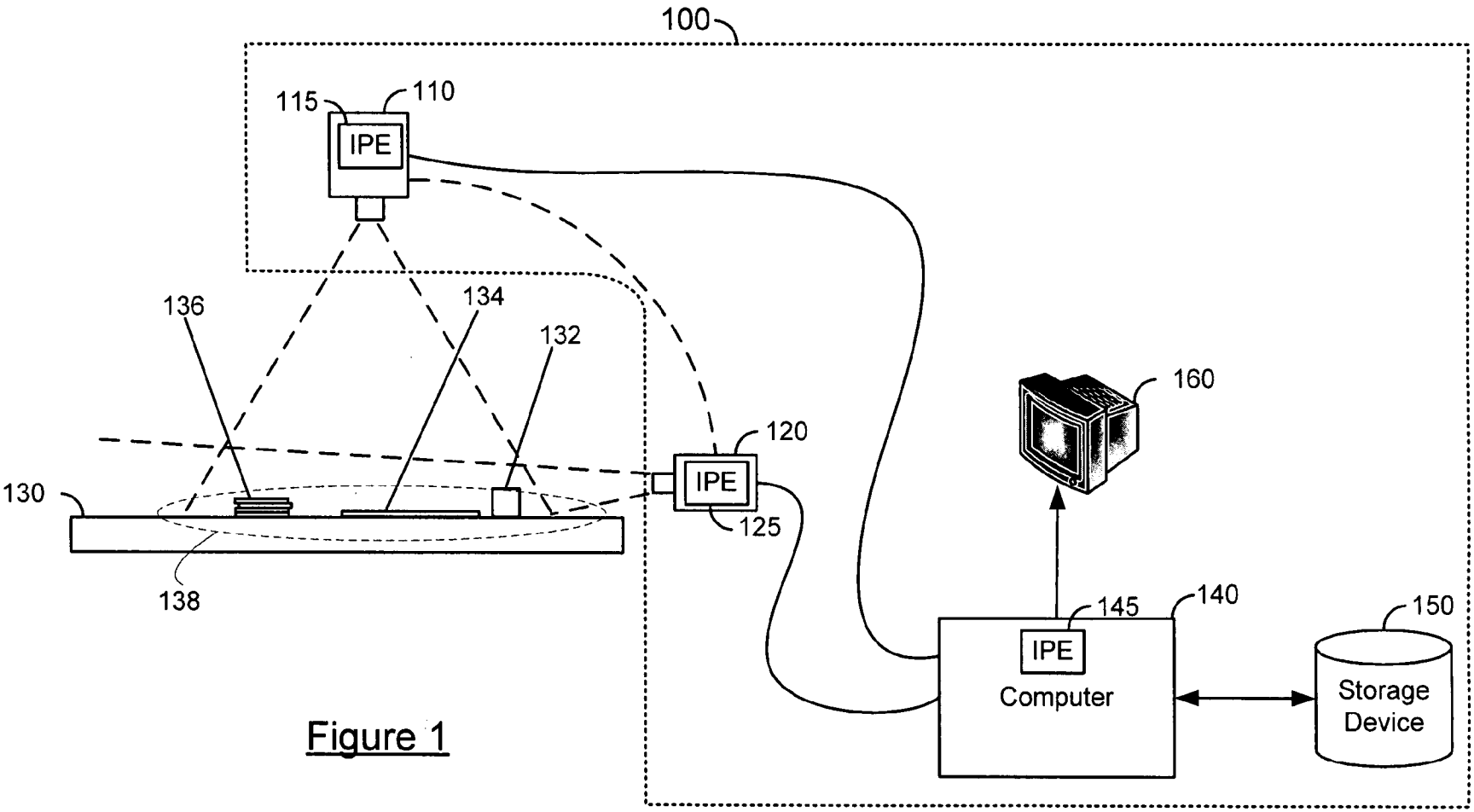
FIG. 1 illustrates one embodiment of a game monitoring environment.

An embodiment of a game monitoring environment is illustrated in FIG. 1. Game monitoring environment includes game monitoring system 100 and game surface 130. System 100 is used to monitor a game that is played on game surface 130. Game monitoring system 100 includes first camera 110, supplemental camera 120, computer 140, display device 160 and storage device 150. Computer 140 is connectively coupled to first camera 110, supplemental camera 120, display device 160 and storage device 150. First camera 110 and supplemental camera 120 capture images of gaming surface 130. Gaming surface 130 may include gaming pieces, such as dice 132, cards 134, chips 136 and other gaming pieces. Images captured by first camera 110 and supplemental camera 120 are provided to computer 140. Computer 140 processes the images and provides information derived from the images to be displayed on display device 160. Images and other information can be stored on storage device 150. In one embodiment, computer 140 includes an image processor engine (IPE) for processing images captured by cameras 110 and 120 to derive game data. In another embodiment, one or both of cameras 110 and 120 include an IPE for processing images captured by the cameras and for deriving game data. In this case, the cameras are interconnected via a wired or wireless transmission medium. This communication link allows one camera to process images captured from both cameras, or one camera to synchronize to the other camera, or one camera to act as a master and the other acts as a slave to derive game data.

In one embodiment, first camera 110 and supplemental camera 120 of system 100 are positioned to allow an IPE to triangulate the position as well as determine the identity and quantity of cards, chips, dice and other game pieces. In one embodiment, triangulation is performed by capturing an image of game surface 130 from different positions. In the embodiment shown, first camera 110 captures an image of a top view playing surface 130 spanning an angle $\theta$. Angle $\theta$ may be any angle as needed by the particular design of the system. Supplemental camera 120 captures an image of a side view of playing surface 130 spanning an angle $\phi$. The images overlap for surface portion 138. An IPE within system 100 can then match pixels from images captured by first camera 110 to pixels from images captured by supplemental camera 120 to ascertain game pieces 132, 134 and 136. In one embodiment, other camera positions can be used as well as more cameras. For example, a supplemental camera can be used to capture a portion of the game play surface associated with each player. This is discussed in more detail below.

Figure 2:
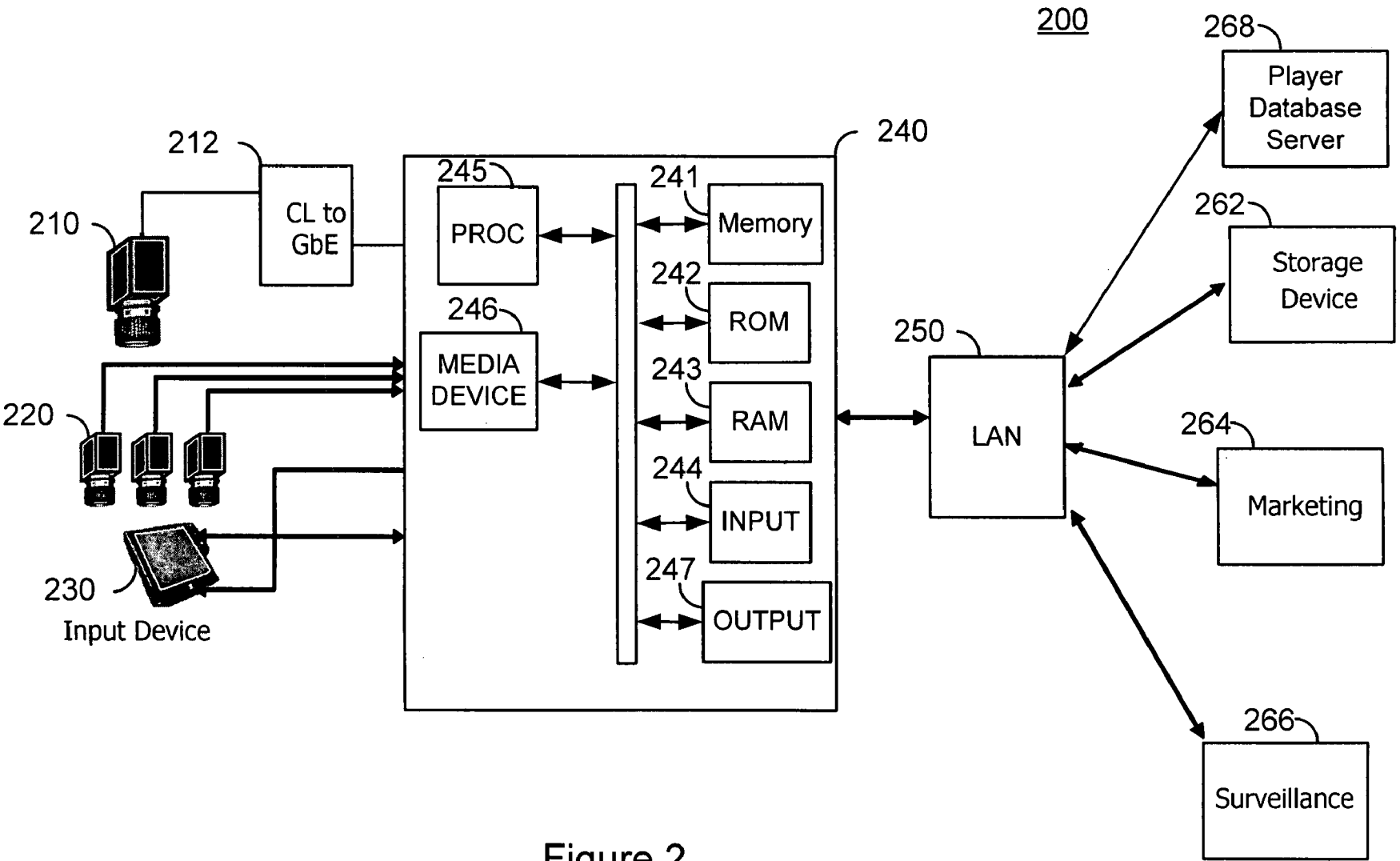
FIG. 2 illustrates an embodiment of a game monitoring system.

An embodiment of a game monitoring system 200 is illustrated in FIG. 2. Game monitoring system 200 may be used to implement system 100 of FIG. 1. System 200 includes a first camera 210, a plurality of supplemental view cameras 220, an input device 230, computer 240, Local Area Network (LAN) 250, storage device 262, marketing/operation station 264, surveillance station 266, and player database server 268.

In one embodiment, first camera 210 provides data through a CameraLink interface. A CameraLink to gigabit Ethernet (GbE) converter 212 may be used to deliver a video signal over larger distances to computer 240. The transmission medium (type of transmission line) to transmit the video signal from the first camera 210 to computer 240 may depend on the particular system, conditions and design, and may include analog lines, 10/100/1000/10G Ethernet, Firewire over fiber, or other implementations. In another embodiment the transmission medium may be wireless.

Bit resolution of the first camera may be selected based on the implementation of the system. For example, the bit resolution may be about 8 bits/pixel. In some embodiments, the spatial resolution of the camera is selected such that it is slightly larger than the area to be monitored. In one embodiment, one spatial resolution is sixteen (16) pixels per inch, though other spatial resolutions may reasonably be used as well. In this case, for a native camera spatial resolution of 1280×1024 pixels, an area of approximately eighty inches by sixty-four inches (80"×64") will be covered and recorded and area of approximately seventy inches by forty inches (70"×40") will be processed.

The sampling or frame rate of the first camera can be selected based on the design of the system. In one embodiment, a frame rate of five or more frames per second of raw video can reliably detect events and objects on a typical casino game such as blackjack, though other frame rate may reasonably be used as well. The minimum bandwidth requirement, BW, for the communication link from first camera 210 to computer 240 can be determined by figuring the spatial resolution, $R_S$, multiplied by the pixel resolution, $R_P$, multiplied by the frames per second, $f_{frames}$, such that $BW=R_S \times R_P \times f_{frames}$. Thus, for a camera operating at eight pits per pixel and five frames per second with 1280×800 pixel resolution, the minimum bandwidth requirement for the communication link is (8 bits/pixel)(1200×800 pixels/frame)(5 f/s)=40 Mbs. Camera controls may be adjusted to optimize image quality and sampling. Camera controls as camera shutter speed, gain, dc offset can be adjusted by writing to the appropriate registers. The iris of the lens can be adjusted manually to modulate the amount of light that hit the sensor elements (CCD or CMOS) of the camera.

In one embodiment, the supplemental cameras implement an IEEE 1394 protocol in isochronous mode. In this case, the supplemental camera(s) can have a pixel resolution of 24-bit in RGB format, a spatial resolution of 640×480, and capture images at a rate of five frames per second. In one embodiment, supplemental camera controls can be adjusted include shutter speed, gain, and white balance to maximize the distance between chip denominations.

Input device 230 allows a game administrator, such as a pit manager or dealer, to control the game monitoring process. In one embodiment, the game administrator may enter new player information, manage game calibration, initiate and maintain game monitoring and process current game states. This is discussed in more detail below. Input device 230 may include user interface (UI), touch screen, magnetic card reader, or some other input device.

Computer 240 receives, processes, and provides data to other components of the system. The server may include a memory 241, including ROM 242 and RAM 243, input 244, output 247, PCI slots, processor 245, and media device 246 (such as a disk drive or CD drive). The computer may run an operating system implemented with commercially available or custom-built operating system software. RAM may store software that implements the present invention and the Operation System. Media device 246 may store software that implements the present invention and the operating system. The input may include ports for receiving video and images from the first camera and receiving video from a storage device 262. The input may include Ethernet ports for receiving updated software or other information from a remote terminal via the Local Area Network (LAN) 250. The output may transfer data to storage device 262, marketing terminal 264, surveillance terminal 266, and player database server 268.

Figure 3:
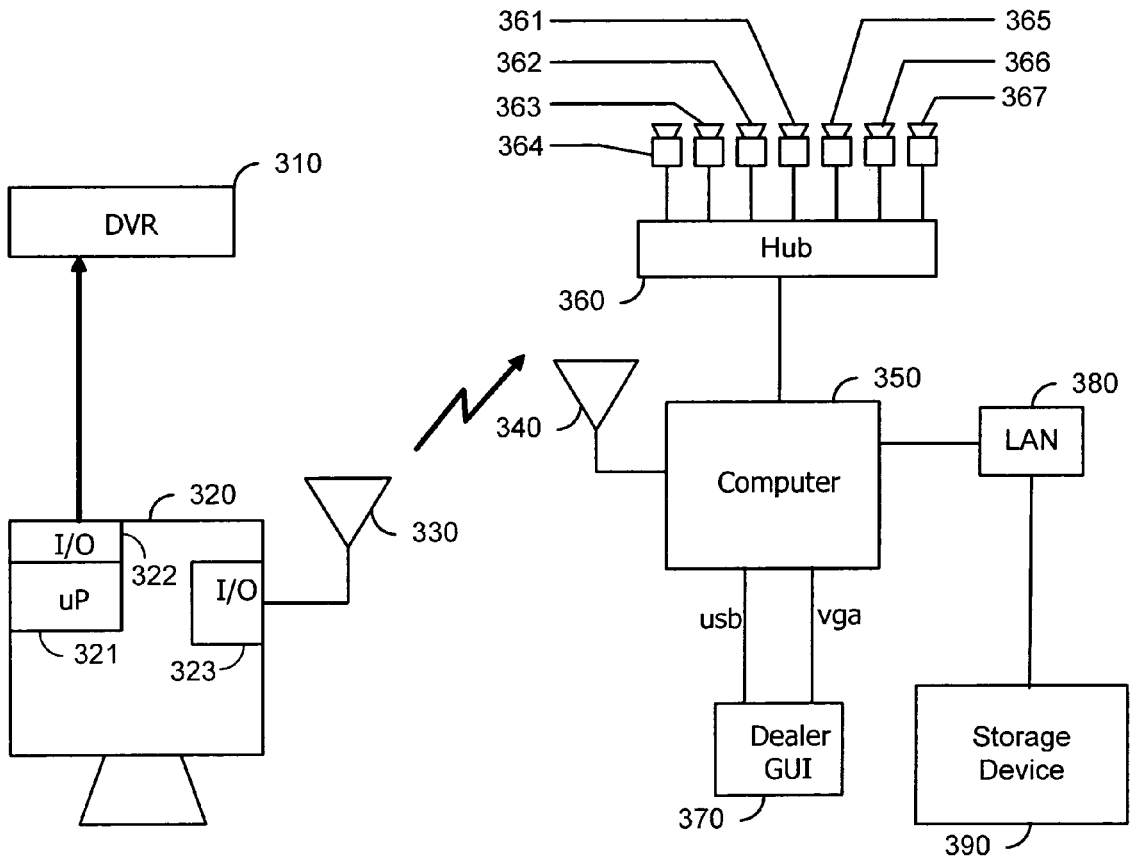
FIG. 3 illustrates another embodiment of a game monitoring system.

Another embodiment of a gaming monitoring system 300 is illustrated in FIG. 3. In one embodiment, gaming monitoring system 300 may be used to implement system 100 of FIG. 1. System 300 includes a first camera 320, wireless transmitter 330, a Digital Video Recorder (DVR) device 310, wireless receiver 340, computer 350, dealer Graphical User Interface (GUI) 370, LAN 380, storage device 390, supplemental cameras 361, 362, 363, 364, 365, 366, and 367, and hub 360. First camera 320 captures images from above a playing surface in a game environment to capture images of actions such as player bet, payout, cards and other actions. Supplemental cameras 361, 362, 363, 364, 365, 366, and 376 are used to capture images of chips at the individual betting circle. In one embodiment, the supplemental cameras can be placed at or near the game playing surface. Computer 350 may include a processor, media device, memory including RAM and ROM, an input and an output. A video stream is captured by camera 320 and provided to DVR 310. In one embodiment, the video stream can also be transmitted from wireless transmitter 330 to wireless receiver 340. The captured video stream can also be sent to a DVR channel 310 for recording. Data received by wireless receiver 340 is transmitted to computer 350. Computer 350 also receives a video stream from supplementary cameras 361-367. In the embodiment illustrated, the cameras are connected to hub 360 which feeds a signal to computer 350. In one embodiment, hub 360 can be used to extend the distance from the supplemental cameras to the server.

In one embodiment the overhead camera 320 can process a captured video stream with embedded processor 321. To reduce the required storing capacity of the DVR 310, the embedded processor 321 compresses the captured video into MPEG format or other compression formats well known in the art. The embedded processor 321 watermarks to ensure authenticity of the video images. The processed video can be sent to the DVR 310 from the camera 320 for recording. The embedded processor 321 may also include an IPE for processing raw video to derive game data. The gaming data and gaming events can be transmitted through wireless transmitter 330 (such as IEEE 802.11a/big or other protocols) to computer 350 through wireless receiver 340. Computer 350 triggers cameras 361-367 to capture images of the game surface based on received game data. The gaming events may also be time-stamped and embedded into the processed video stream and sent to DVR 310 for recording. The time-stamped events can be filtered out at the DVR 310 to identify the time window in which these events occur. A surveillance person can then review the time windows of interest only instead of the entire length of the recorded video. These events are discussed in more detail below.

In one embodiment, raw video stream data sent to computer 350 from camera 320 triggers computer 350 to capture images using cameras 361-367. In this embodiment, the images captured by first camera 320 and supplemental cameras 361-367 can be synchronized in time. In one embodiment, first camera 320 sends a synchronization signal to computer 350 before capturing data. In this case, all cameras of FIG. 3 capture images or a video stream at the same time. The synchronized images can be used to determine game play states as discussed in more detail below. In one embodiment, raw video stream received by computer 350 is processed by an IPE to derive game data. The game data trigger the cameras 361-367 to capture unobstructed images of player betting circles.

In one embodiment, image processing and data processing is performed by processors within the system of FIGS. 1-3. The image processing derives information from captured images. The data processing processes the data derived from the information.

In an embodiment wherein a blackjack game is monitored, the first and supplemental cameras of systems 100, 200 or 300 may capture images and/or a video stream of a blackjack table. The images are processed to determine the different states in the blackjack game, the location, identification and quantity of chips and cards, and actions of the players and the dealer.

Figure 4:
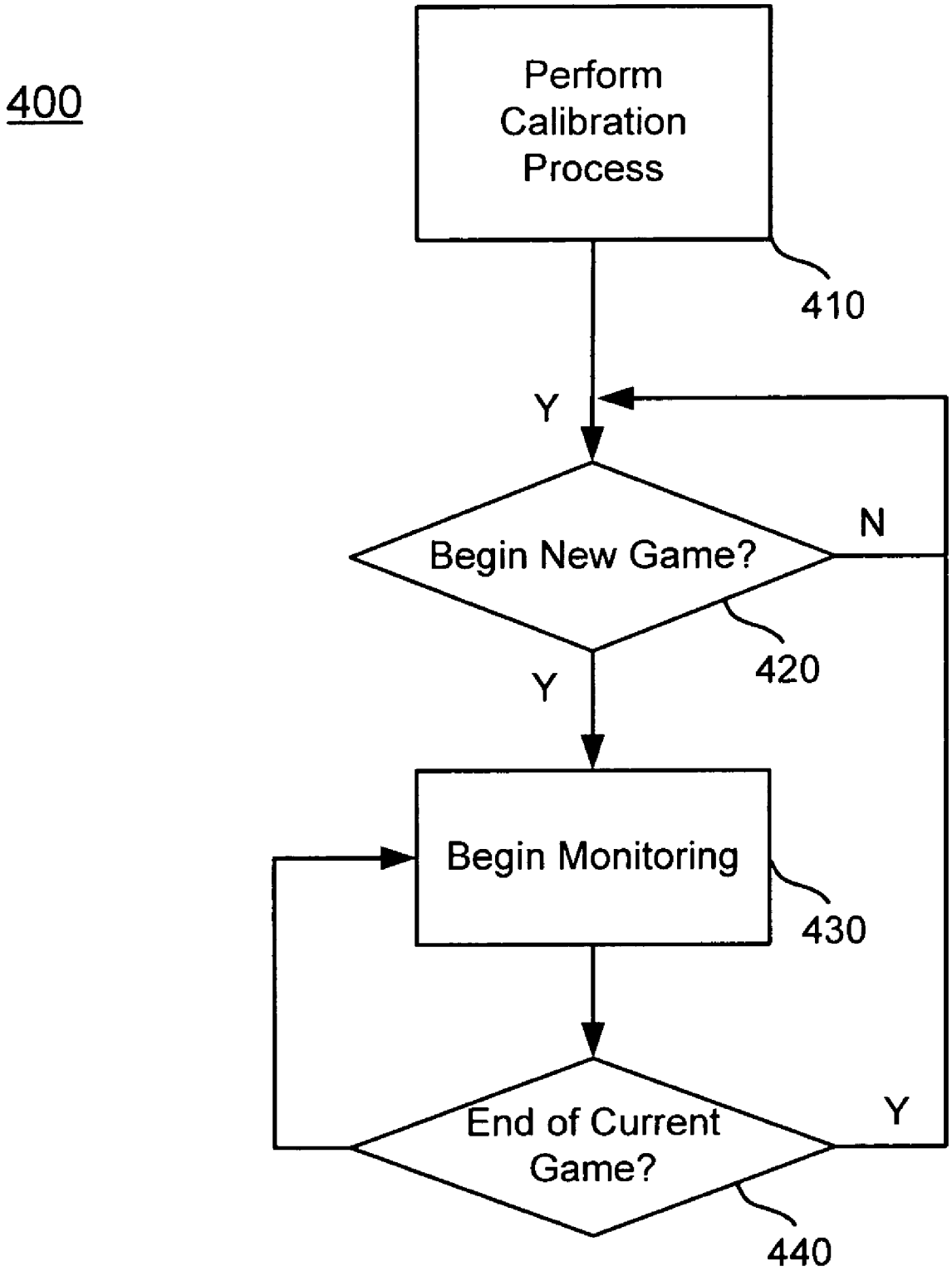
FIG. 4 illustrates an embodiment of a method for monitoring a game.

FIG. 4 illustrates a method 400 for monitoring a game. A calibration process is performed at step 410. The calibration process can include system equipment as well as game parameters. System equipment may include cameras, software and hardware associated with a game monitor system. In one embodiment, elements and parameters associated with the game environment, such as reference images, and information regarding cards, chips, Region of Interest (ROIs) and other elements, are captured during calibration. An embodiment of a method for performing calibration is discussed in more detail below with respect to FIG. 4

In one embodiment, a determination that a new game is to begin is made by detecting input from a game administrator, the occurrence of an event in the game environment, or some other event. Game administrator input may include a game begin or game reset input at input device 230 of FIG. 2.

Next, the game monitoring system determines whether a new game has begun. In one embodiment, a state machine is maintained by the game monitoring system. This is discussed in more detail below with respect to FIG. 27. In this case, the state machine determines at step 420 whether the game state should transition to a new game at step 420. The game state machine and detecting the beginning of a new game is discussed in more detail below. If a new game is to begin, operation continues to step 430. Otherwise, operation remains at step 420.

Game monitoring begins at step 430. In one embodiment, game monitoring includes capturing images of the game environment, processing the images, and triggering an event in response to capturing the images. In an embodiment wherein a game of blackjack is monitored, the event may be initiating card recognition, chip recognition, detecting the actions of a player or dealer, or some other event. Game monitoring is discussed in more detail below. The current game is detected to be over at step 440. In a blackjack game, the game is detected to be over once the dealer has reconciled the player's wager and removed the cards from the gaming surface. Operation then continues to step 410 wherein the game system awaits the beginning of the next game.

Figure 5A:
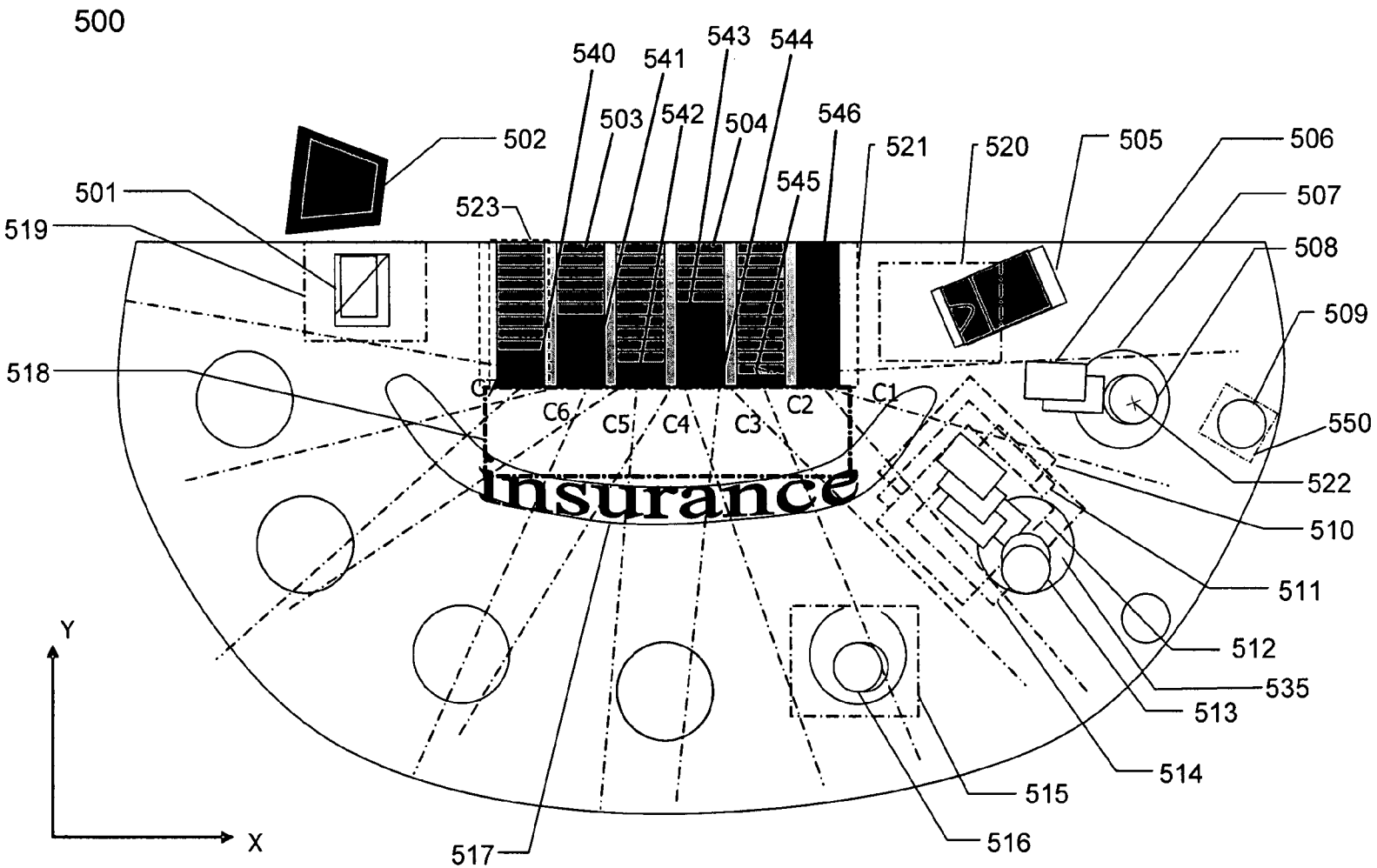
FIG. 5A illustrates an example of an image of a blackjack game environment.

In one embodiment, the calibration and game monitoring process both occur within the same game environment. FIG. 5A illustrates an embodiment of a top view of a blackjack game environment 500. In one embodiment, blackjack environment 500 is an example of an image captured by first camera 110 of FIG. 1. The images are then processed by a system of the present invention. Blackjack environment 500 includes several ROIs. An ROI, Region of Interest, is an area in a game environment that can be captured within an image or video stream by one or more cameras. The ROI can be processed to provide information regarding an element, parameter or event within the game environment. Blackjack environment 500 includes card dispensed holder 501, input device 502, dealer maintained chips 503, chip tray 504, card shoe 505, dealt card 506, player betting area 507, player wagered chips 508, 513, and 516, player maintained chips 509, chip stack center of mass 522, adapted card ROI 510, 511, 512, initial card ROI 514, wagered chip ROI 515, insurance bet region 517, dealer card ROI 518, dispensed card holder ROI 519, card shoe ROI 520, chip tray ROI 521, chip well ROI 523, representative player regions 535, cameras 540, 541, 542, 543, 544, 545 and 546 and player maintained chip ROI 550. Input device 502 may be implemented as a touch screen graphical user interface, magnetic card reader, some other input device, and/or combination thereof. Player card and chip ROIs are illustrated in more detail in FIG. 5B.

Blackjack environment 500 includes a dealer region and seven player regions (other numbers of player regions can be used). The dealer region is associated with a dealer of the blackjack game. The dealer region includes chip tray 504, dealer maintained chips 503, chip tray ROI 521, chip well ROI 523, card dispensed holder 501, dealer card ROI 518, card shoe 505 and card shoe ROI 520. A player region is associated with each player position. Each player region (such as representative player region 535) includes a player betting area, wagered chip ROI, a player initial card ROI, and adapted card ROIs and chip ROIs associated with the particular player, and player managed chip ROI. Blackjack environment 500 does not illustrate the details of each player region of system 500 for purposes of simplification. In one embodiment, the player region elements are included for each player.

In one embodiment, cameras 540-546 can be implemented as supplemental cameras of systems 100, 200 or 300 discussed above. Cameras 540-546 are positioned to capture a portion of the blackjack environment and capture images in a direction from the dealer towards the player regions. In one embodiment, cameras 540-546 can be positioned on the blackjack table, above the blackjack table but below a first camera of system 100, 200 or 300, or in some other position that captures an image in the direction of the player regions. Each of cameras 540-546 captures a portion of the blackjack environment as indicated in FIG. 5A and discussed below in FIG. 5B.

Figure 5B:
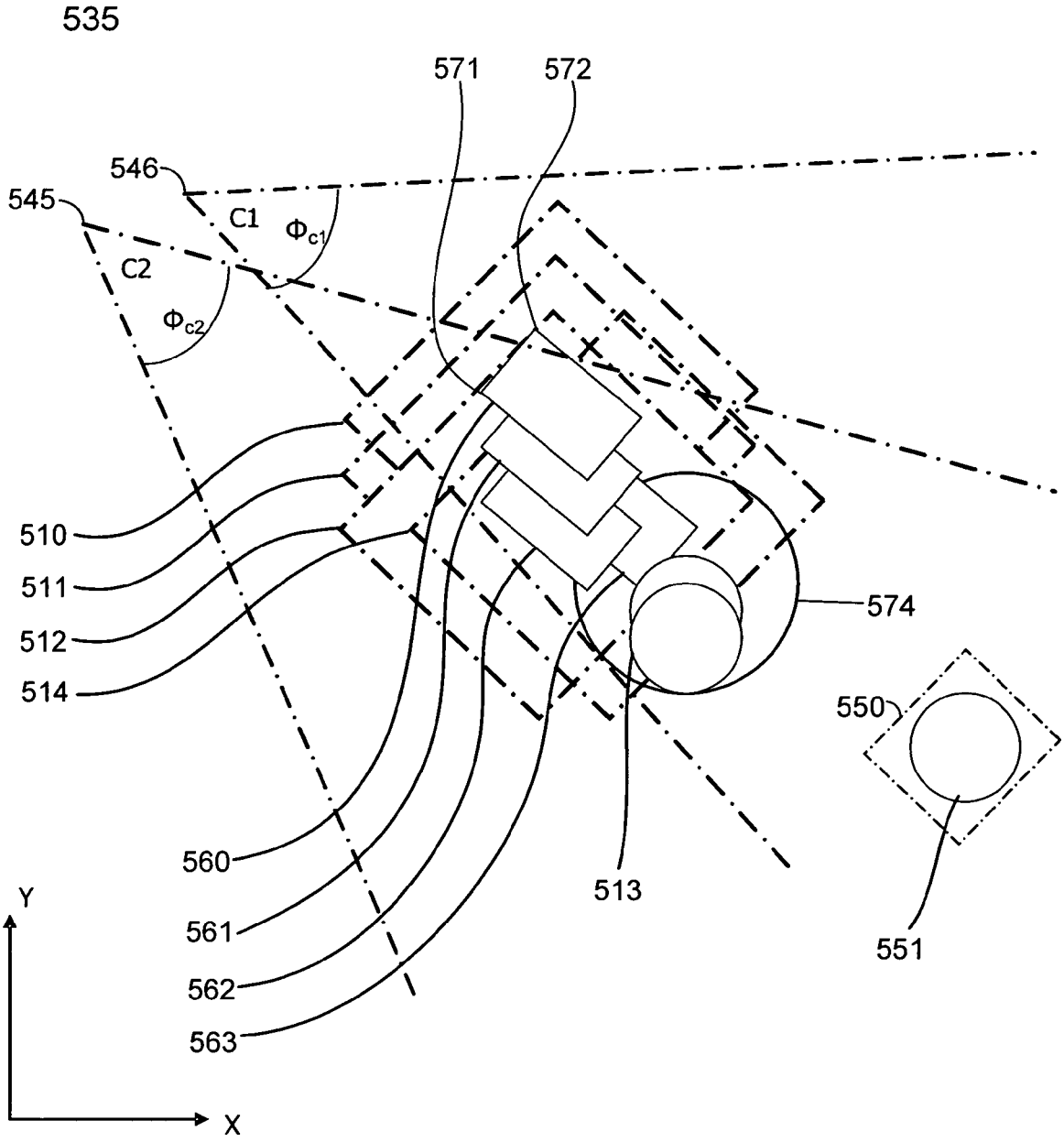
FIG. 5B illustrates an embodiment of a player region.

Player region 535 of FIG. 5A is illustrated in more detail in FIG. 5B. Player region 535 includes most recent card 560, second most recent card 561, third most recent card 562, fourth most recent card (or first dealt card) 563, adapted card ROIs 510, 511, and 512, initial card ROI 514, chip stack 513, cameras 545 and 546, player maintained chips 551, player maintained chips ROI 550, and player betting area 574. Cameras 545 and 546 capture a field of view of player region 535. Though not illustrated, a wagered chip ROI exists around player betting area 574. The horizontal field of view for cameras 545 and 546 has an angle $\phi_{c2}$ and $\phi_{c1}$, respectively. These FOVs may or may not overlap. Although the vertical FOV is not shown, it is proportional to the horizontal FOV by the aspect ration of the sensor element of the camera.

Cards 560-563 are placed on top of each other in the order they were dealt to the corresponding player. Each card is associated with a card ROI. In the embodiment illustrated, the ROI has a shape of a rectangle and is centered at or about the centroid of the associated card. Not every edge of each card ROI is illustrated in player region 535 in order to clarify the region. In player region 535, most recent card 560 is associated with ROI 510, second most recent card 561 is associated with ROI 511, third most recent card 562 is associated with ROI 512, and fourth most recent card 563 is associated with ROI 514. In one embodiment, as each card is dealt to a player, an ROI is determined for the particular card. Determination of card ROIs are discussed in more detail below.

Figure 5C:
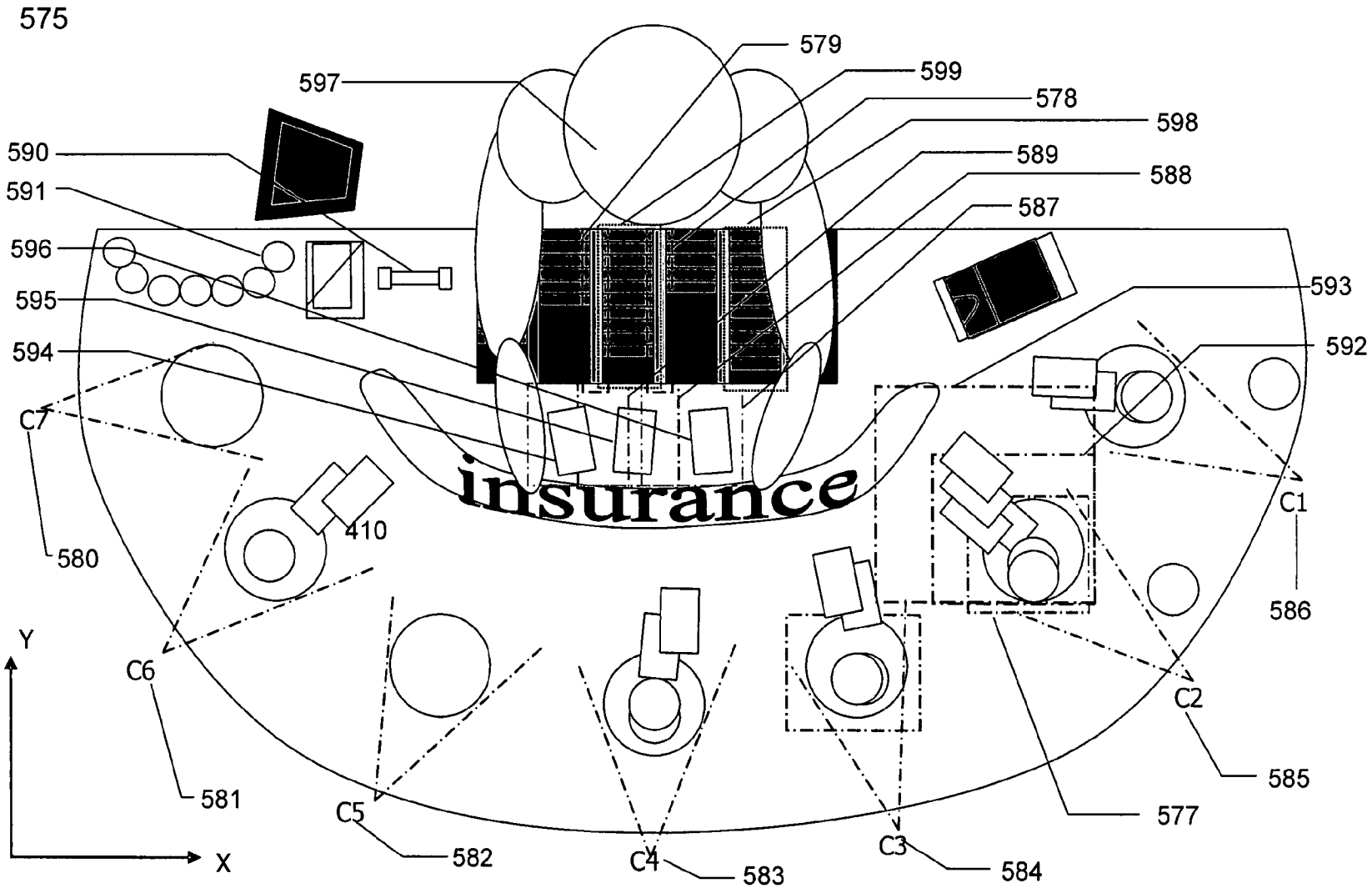
FIG. 5C illustrates another example of an image of a blackjack game environment

FIG. 5C illustrates another embodiment of a blackjack game environment 575. Blackjack environment 500 includes supplemental cameras 580, 581, 582, 583, 584, 585 and 586, marker positions 591, drop box 590, dealer up card ROI 588, dealer hole card ROI 587, dealer hit card ROI 589, initial player card ROI 592, subsequent player card ROI 593, dealer up card 595, dealer hole card 596, dealer hit card 594, chip well separation regions 578 and 579, and chip well ROI 598 and 599. Although dealer hit cards ROIs can be segmented, monitored, and processed, for simplicity they are not shown here.

As in blackjack environment 500, blackjack environment 575 includes seven player regions and a dealer region. The dealer region is comprised of the dealer card ROIs, dealer cards, chip tray, chips, marker positions, and drop box. Each player region is associated with one player and includes a player betting area, wagered chip ROI, a player card ROI, and player managed chip ROI. Although one player can be associated with more than one player region. As in blackjack environment 500, not every element of each player region is illustrated in FIG. 5C in order to simplify the illustration of the system.

In one embodiment, supplemental cameras 580-586 of blackjack environment 575 can be used to implement the supplemental cameras of systems 100, 200 or 300 discussed above. Cameras 580-586 are positioned to capture a portion of the blackjack environment and capture images in the direction from the player regions towards the dealer. In one embodiment, cameras 580-586 can be positioned on the blackjack table, above the blackjack table but below a first camera of system 100, 200 or 300, or in some other direction towards the dealer from the player regions. In another embodiment, the cameras 580-586 can be positioned next to a dealer and directed to capture images in the direction of the players.

Figure 6:
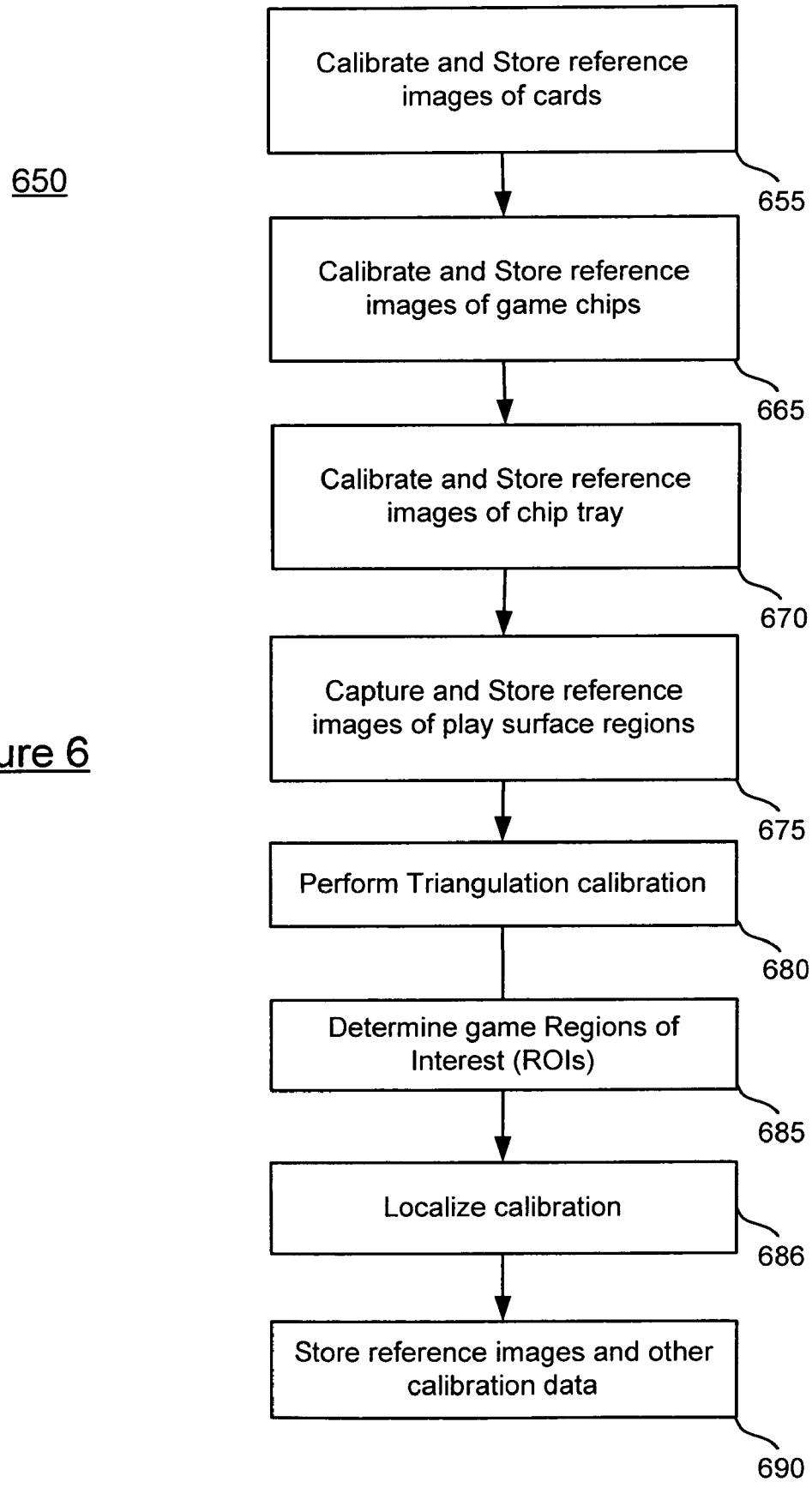
FIG. 6 illustrates one embodiment of a method for performing a calibration process.

FIG. 6 illustrates an embodiment of a method for performing a calibration process 650 as discussed above in step 410 of FIG. 4. Calibration process 650 can be used with a game that utilizes playing pieces such as cards and chips, such as blackjack, or other games with other playing pieces as well.

In one embodiment, the calibration phase is a learning process where the system determines the features and size of the cards and chips as well as the lighting environment and ROIs. Thus, in this manner, the system of the present invention is flexible and can be used for different gaming systems because it "learns" the parameters of a game before monitoring and capturing game play data. In one embodiment, as a result of the calibration process in a blackjack game, the parameters that are generated and stored include ROI dimensions and locations, chip templates, features and sizes, an image of an empty chip tray, an image of the gaming surface with no cards or chips, and card features and sizes. The calibration phase includes setting first camera and supplemental camera parameters to best utilize the system in the current environment. These parameters are gain, white balancing, and shutter speed among others. Furthermore, the calibration phase also maps the space of the first camera to the space of the supplemental cameras. This space triangulation identifies the general regions of the chips or other gaming pieces, thus, minimizes the search area during the recognition process. The space triangulation is described in more detail below.

Method 650 begins with capturing and storing reference images of cards at step 655. In one embodiment, this includes capturing images of ROIs with and without cards. In the reference images having cards, the identity of the cards is determined and stored for use in comparison of other cards during game monitoring. Step 655 is discussed in more detail below with respect to FIG. 7A. Next, reference images of wagering chips are captured and stored at step 665. Capturing and storing a reference image of wagering chips is similar to that of a card and discussed in more detail below with respect to FIG. 8A. Reference images of a chip tray are then captured and stored at step 670.

Figure 10:
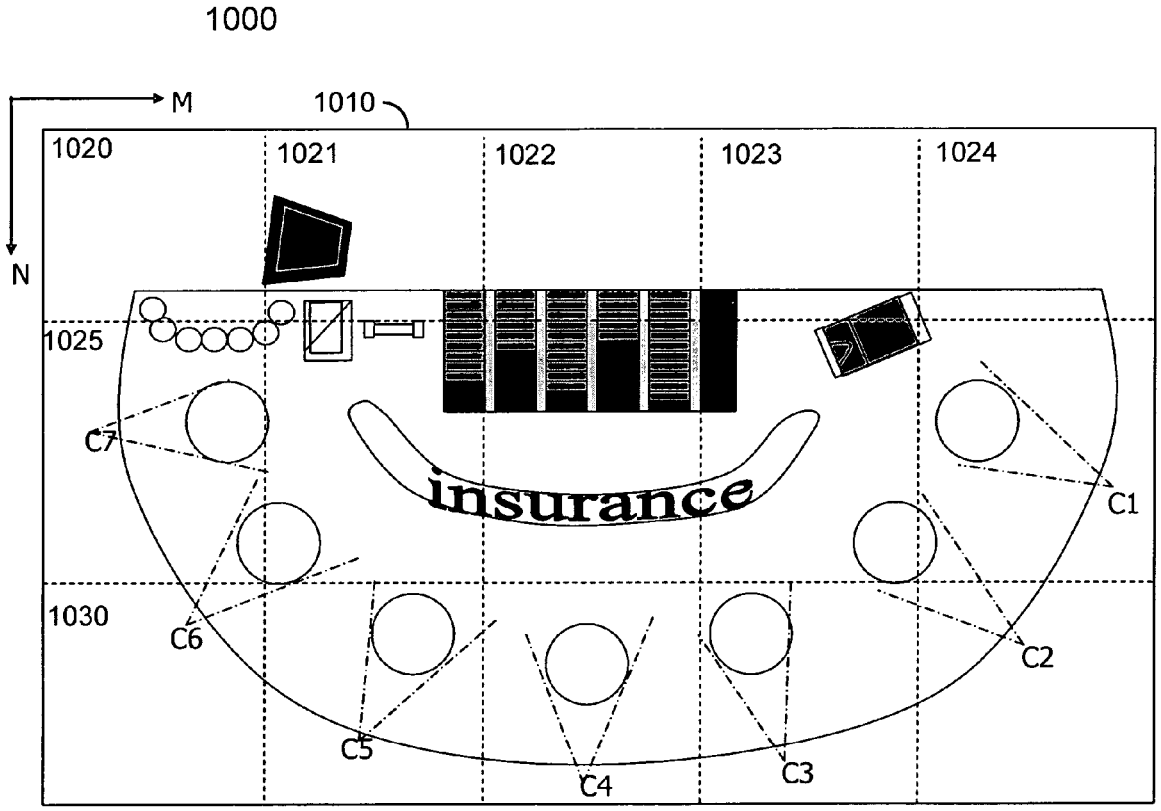
FIG. 10 illustrates one embodiment of a game environment divided into a matrix of regions.

Next, in one embodiment, reference images of play surface regions are captured at step 675. In this embodiment, the playing surface of the gaming environment is divided into play surface regions. A reference image is captured for each region. The reference image of the region can then be compared to an image of the region captured during game monitoring. When a difference is detected between the reference image and the image captured during game monitoring, the system can determine an element and/or action causing the difference. An example of game surface 900 divided into play surface regions is illustrated in FIG. 10. Game surface 1000 includes a series of game surface regions 1010 includes three rows and four columns of regions. Other numbers of rows and columns, or shapes of regions in addition to rectangles, such as squares, circles and other shapes, can be used to capture regions of a game surface. FIG. 10 is discussed in more detail below.

Triangulation calibration is then performed at step 680. In one embodiment, multiple cameras are used to triangulate the position of player card ROIs, player betting circle ROIs, and other ROIs. The ROIs may be located by recognition of markings on the game environment, detection of chips, cards or other playing pieces, or by some other means. Triangulation calibration is discussed in more detail below with respect to FIGS. 9A and 9B. Game ROIs are then determined and stored at step 685. The game ROIs may be derived from reference images of cards, chips, game environment markings, calibrated settings in the gaming system software or hardware, operator input, or from other information. Reference images and other calibration data are then stored at step 690. Stored data may include reference images of one or more cards, chips, chip trays, game surface regions, calibrated triangulation data, other calibrated ROI information, and other data.

Figure 7A:
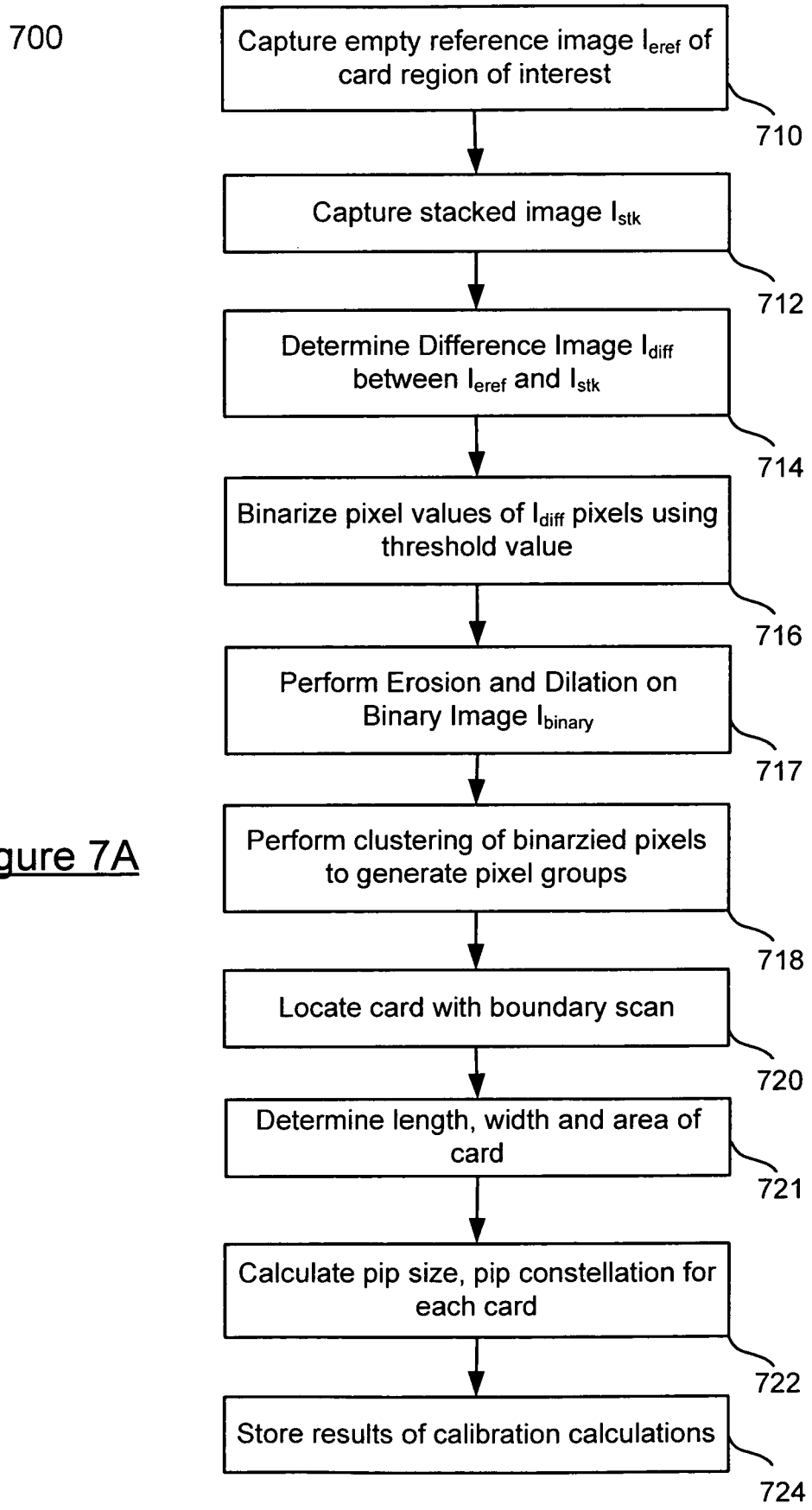
FIG. 7A illustrates one embodiment of a method for performing card calibration.
Figure 7B:
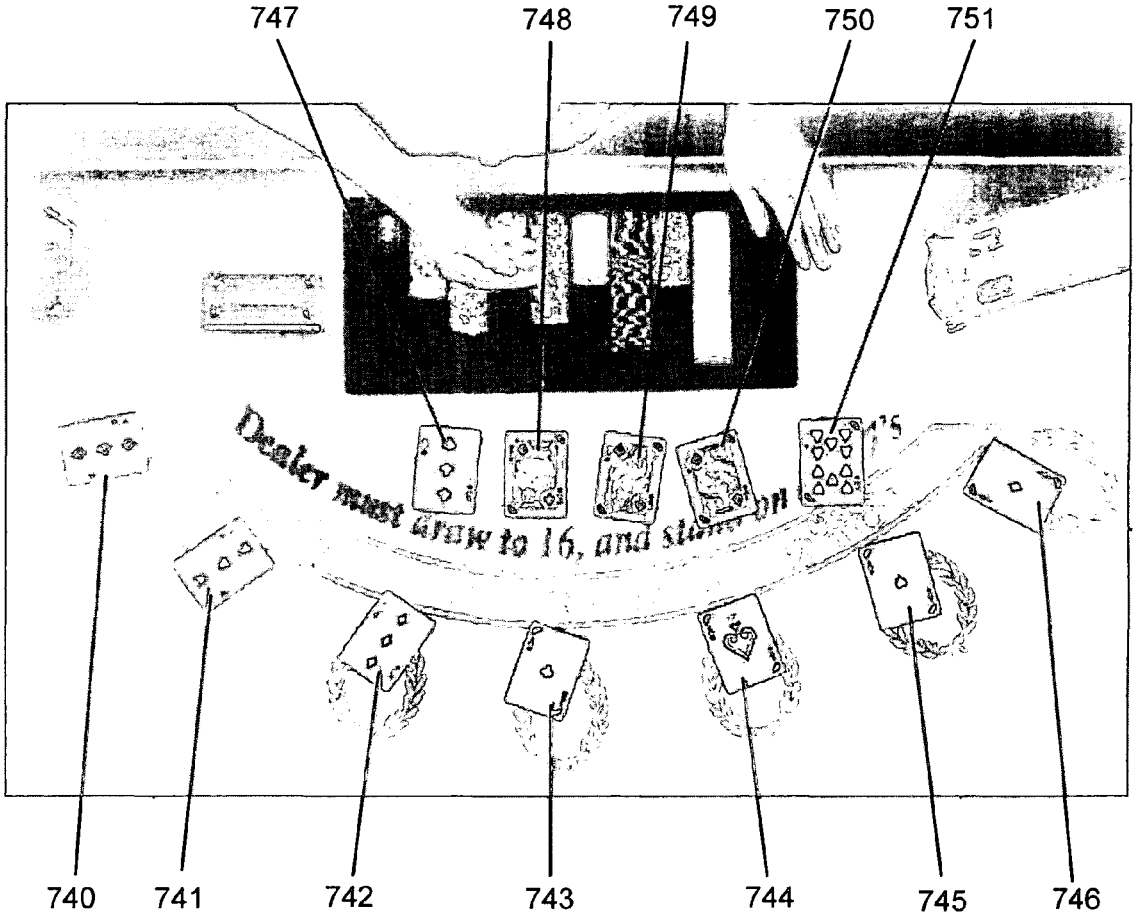
FIG. 7B illustrates one embodiment of a stacked image.

FIG. 7A illustrates an embodiment of a method 700 for performing card calibration as discussed above at step 655 of method 650. Method 700 begins with capturing an empty reference image $I_{eref}$ of a card ROI at step 710. In one embodiment, the empty reference image is captured using an first camera of systems 100, 200, or 300. In one embodiment, the empty reference image $I_{eref}$ consists of an image of a play environment or ROI where one or more cards can be positioned for a player during a game, but wherein none are currently positioned. Thus, in the case of a blackjack environment, the empty reference image is of the player card ROI and consists of an entire or portion of a blackjack table without any cards placed at the particular portion captured. Next, a stacked image $I_{stk}$ is captured at step 712. In one embodiment, the stacked image is an image of the same ROI or environment that is "stacked" in that it includes cards placed within one or more card ROIs. In one embodiment, the cards may be predetermined ranks and suits at predetermined places. This enables images corresponding to the known card rank and suit to be stored. An example of a stacked image $I_{stk}$ 730 is illustrated in FIG. 7B. Image 730 includes cards 740, 741, 742, 743, 744, 745, and 746 located at player ROIs. Cards 747, 748, 749, 750 and 751 are located at the dealer card ROI. Cards 740, 741, 742, 743, and 747 are all a rank of three, while cards 744, 745, and 746 are all a rank of ace. Cards 748, 749, 750 and 751 are all ten value cards. In one embodiment, cards 740-751 are selected such that the captured image(s) can be used to determine rank calibration information. This is discussed in more detail below.

After the stacked image is captured, a difference image $I_{diff}$ comprised of the absolute difference between the empty reference image $I_{eref}$ and the stacked image $I_{stk}$ is calculated at step 714. In one embodiment, the difference between the two images will be the absolute difference in intensity between the pixels comprising the cards in the stacked image and those same pixels in the empty reference image.

Pixel values of $I_{diff}$ are binarized using a threshold value at step 716. In one embodiment, a threshold value is determined such that a pixel having a change in intensity greater than the threshold value will be assigned a particular value or state. Noise can be calculated and removed from the difference calculations before the threshold value is determined. In one embodiment, the threshold value is derived from the histogram of the difference image. In another embodiment, the threshold value is typically determined to be some percentage of the average change in intensity for the pixels comprising the cards in the stacked image. In this case, the percentage is used to allow for a tolerance in the threshold calculation. In yet another embodiment, the threshold is determined from the means and the standard deviations of a region of $I_{eref}$ or $I_{stk}$ with constant background Once the threshold calculation is determined, all pixels for which the change of intensity exceeded the threshold will be assigned a value. In one embodiment, a pixel having a change in intensity greater than the threshold is assigned a value of one. In this case, the collection of pixels in $I_{diff}$ with a value of one is considered the threshold image or the binary image $I_{binary}$.

After the binarization is performed at step 716, erosion and dilation filters are performed at step 717 on the binary image, $I_{binary}$, to remove "salt-n-pepper noise". The clustering is performed on the binarized pixels (or threshold image) at step 718. Clustering involves grouping adjacent one value pixels into groups. Once groups are formed, the groups may be clustered together according to algorithms known in the art. Similar to the clustering of pixels, groups can be clustered or "grouped" together if they share a pixel or are within a certain range of pixels from each other (for example, within three pixels from each other). Groups may then be filtered by size such that groups smaller then a certain area are eliminated (such as seventy five percent of the area of a known card area). This allows groups that may be a card to remain.

Once the binarized pixels have been clustered into groups, the boundary of the card is scanned at step 720. The boundary of the card is generated using the scanning method described in method 1400. Once the boundary of the card is scanned, the length, width, and area of the card can be determined at step 721. In one embodiment where known card rank and suit is placed in the gaming environment during calibration, within the card's boundary, the mean and standard deviation of color component (red, green, blue, if color camera is used) or intensity (if monochrome camera is used) of the pips of a typical card is estimated along with the white background in step 722. The mean value of the color components and/or intensity of the pip are used to generate thresholds to binarize the interior features of the card. Step 724 stores the calibrated results for use in future card detection and recognition. In one embodiment, the length, width and area are determined in units of pixels. Table 1a and 1b below shows a sample of calibrated data for detected cards using a monochrome camera with 8 bits/pixel.

TABLE 1

| Card Calibration Data, Size and pip area | | | | | |
|---|---|---|---|---|---|
| Length, pix | Width, Pix | Area(Diamond) Pixel sq. | Area(Heart) Pixel sq. | Area(Spade) Pixel sq. | Area(Club) Pixel sq. |
| 89 | 71 | 235 | 245 | 238 | 242 |
| 90 | 70 | 240 | 240 | 240 | 240 |

TABLE 1b

| Card Calibration Data, mean intensity | | | | |
|---|---|---|---|---|
| White background | Diamond | Heart | Spade | Club |
| 245 | 170 | 170 | 80 | 80 |

Figure 8A:
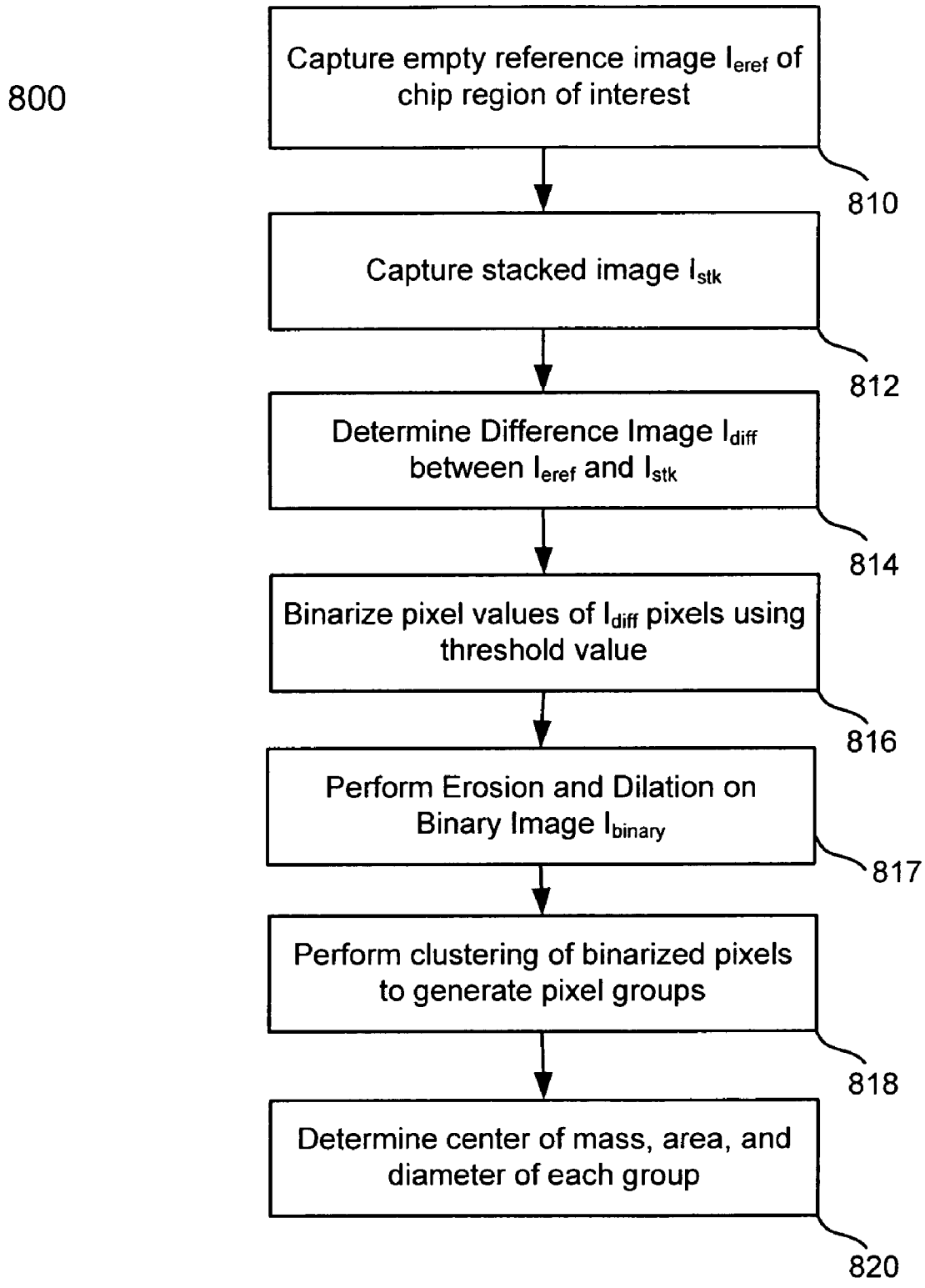
FIG. 8A illustrates one embodiment of a method for performing chip calibration.

FIG. 8A illustrates a method for performing chip calibration as discussed above at step 665 of method 650. Method 800 begins with capturing an empty reference image $I_{eref}$ of a chip ROI at step 810 using a first camera. In one embodiment, the empty reference image $I_{eref}$ consists of an image of a play environment or chip ROI where one or more chips can be positioned for a player during a game, but wherein none are currently positioned. Next, a stacked image $I_{stk}$ for the chip ROI is captured at step 812. In one embodiment, the stacked image is an image of the same chip ROI except it is "stacked" in that it includes wagering chips. In one embodiment, the wagering chips may be a known quantity and denomination in order to store images corresponding to specific quantities and denomination. After the stacked image is captured, the difference image $I_{diff}$ comprised of the difference between the empty reference image $I_{eref}$ and the stacked image $I_{stk}$ is calculated at step 814. Step 814 is performed similarly to step 714 of method 700. Binarization is then performed on difference image $I_{diff}$ at step 816. Erosion and dilation operations at step 817 are perform next to remove "salt-n-pepper" noise. Next, clustering is performed on the binarized image, $I_{binary}$ at step 818 to generate pixel groups. Once the binarized pixels have been grouped together, the center of mass for each group, area, and diameter are calculated and stored at step 820. Steps 816-818 are similar to steps 716-718 of method 700.

Figure 8B:
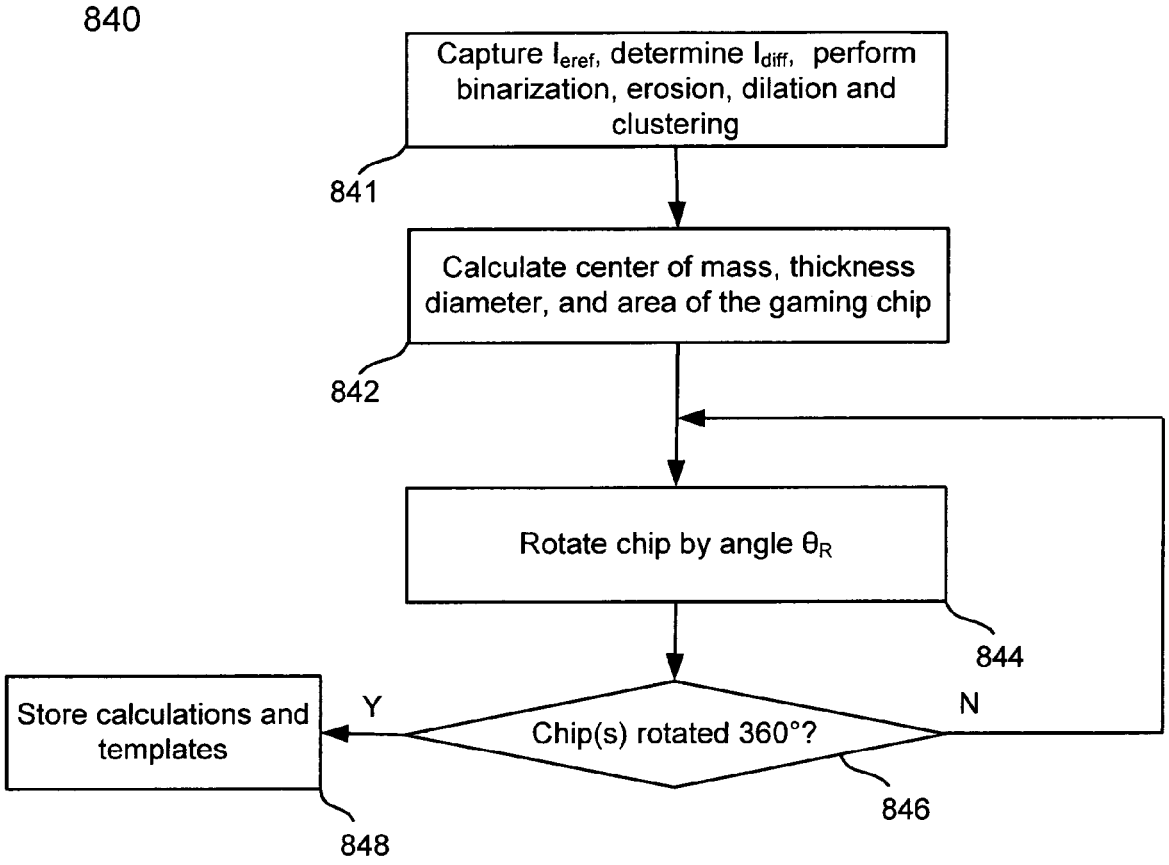
FIG. 8B illustrates another embodiment of a method for performing chip calibration process

The calibration process discussed above operates on the images captured by a first camera. The following calibration process operates on images captured by one or more supplemental camera. FIG. 8B illustrates an embodiment of a method 840 for performing a calibration process. First, processing steps are performed to cluster an image at step 841. In one embodiment, this includes capture $I_{eref}$, determine $I_{diff}$, perform binarization, erosion, dilation and clustering. Thus, step 841 may include the steps performed in steps 810-818 of method 800. The thickness, diameter, center of mass, and area are calculated at distances d for chips at step 842. In one embodiment, a number of chips are placed at different distances within the chip ROI. Images are captured of the chips at these different distances. The thickness, diameter and area are determined for a single chip of each denomination at each distance. The range of the distances captured will cover a range in which the chips will be played during an actual game.

Next, the chips are rotated by an angle $\theta_R$ to generate an image template at step 844. After the rotation, a determination is made as to whether the chips have been rotated 360 degrees or until the view of the chip repeats itself at step 846. If the chips have not been rotated 360 degrees, operation continues to step 844. Otherwise, the chip calibration data and templates are stored at step 848.

Figure 8C:
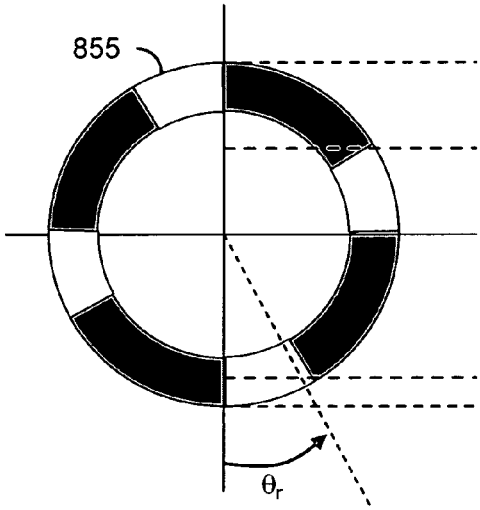
FIG. 8C illustrates an example of a top view of a chip.
Figure 8D:
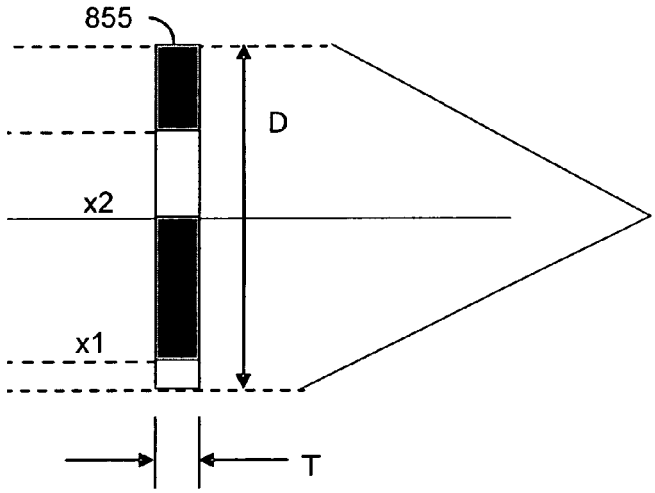
FIG. 8D illustrates an example of a side view of a chip.

FIG. 8C illustrates an example of a top view of a chip calibration image 850. Image 850 illustrates chip 855 configured to be rotated at an angle $\theta_R$. FIG. 8D illustrates a side view image 860 of chip 855 of FIG. 8C. Image 860 illustrates the thickness T and diameter D of chip 855. Images captured at each rotation are stored as templates. From these templates, statistics such as means and variance for each color are calculated and stored as well. In one embodiment, chip templates and chip thickness and diameter and center of mass are derived from a supplemental camera captured image similar to image 860 and the chip area, diameter, and perimeter is derived form a first camera captured image similar to image 850. The area, thickness and diameter as a function of the coordinate of the image capturing camera are calculated and stored. An example of chip calibration parameters taken from a calibration image of first camera and supplemental camera are shown below in Table 2a and Table 2b respectively. Here the center of mass of the gaming chip in Table 2a corresponds to the center of mass of Table 2b. In one embodiment the mentioned calibration process is repeated to generate a set of more comprehensive tables. Therefore, once the center of mass of the chip stack is known from the first camera space, the calculated thickness, diameter, and area of the chip stack as seen by the supplemental camera is known by using Table 3 and Table 2a. For example, the center of mass of the chip stack, in the first camera space is (160,600). The corresponding coordinates in the supplemental camera space is (X1c, Y1c) as shown in Table 3. Using Table 2a, the calculated thickness, diameter, and area of the chip at position (X1c, Y1c) are 8, 95, and 768 respectively.

TABLE 2a

Wagered chip features as seen from the first camera

| Center of Mass | | Chip Features | | |
|---|---|---|---|---|
| X | Y | Perimeter | Diameter | Area |
| 160 | 600 | 80 | 25 | 490 |

TABLE 2b

Wagered chip features as seen from the supplemental camera

| Center of Mass | | Chip Features | | |
|---|---|---|---|---|
| X | Y | Thickness | Diameter | Area |
| X1c | Y1c | 8 | 95 | 768 |

Chip tray calibration as discussed above with respect to step 670 of method 650 may be performed in a manner similar to the card calibration process of method 700. A difference image $I_{diff}$ is taken between an empty reference image $I_{eref}$ and the stacked image $I_{stk}$ of the chip tray. The difference image, Idiff, is bounded by the Region of Interest of the chip well, for example 523 of FIG. 5A. In one embodiment, the stacked image may contain a predetermined number of chips in each row or well within the chip tray, with different wells having different numbers and denominations of chips. Each well may have a single denomination of chips or a different denomination. The difference image is then subjected to binarization and clustering. In one embodiment, the binary image is subject to erosion and dilation operation to remove "salt-n-pepper" noise prior to the clustering operation. As the clustered pixels represent a known number of chips, parameters indicating the area of pixels corresponding to a known number of chips as well as RGB values associated with the each denomination can be stored.

Figure 9A:
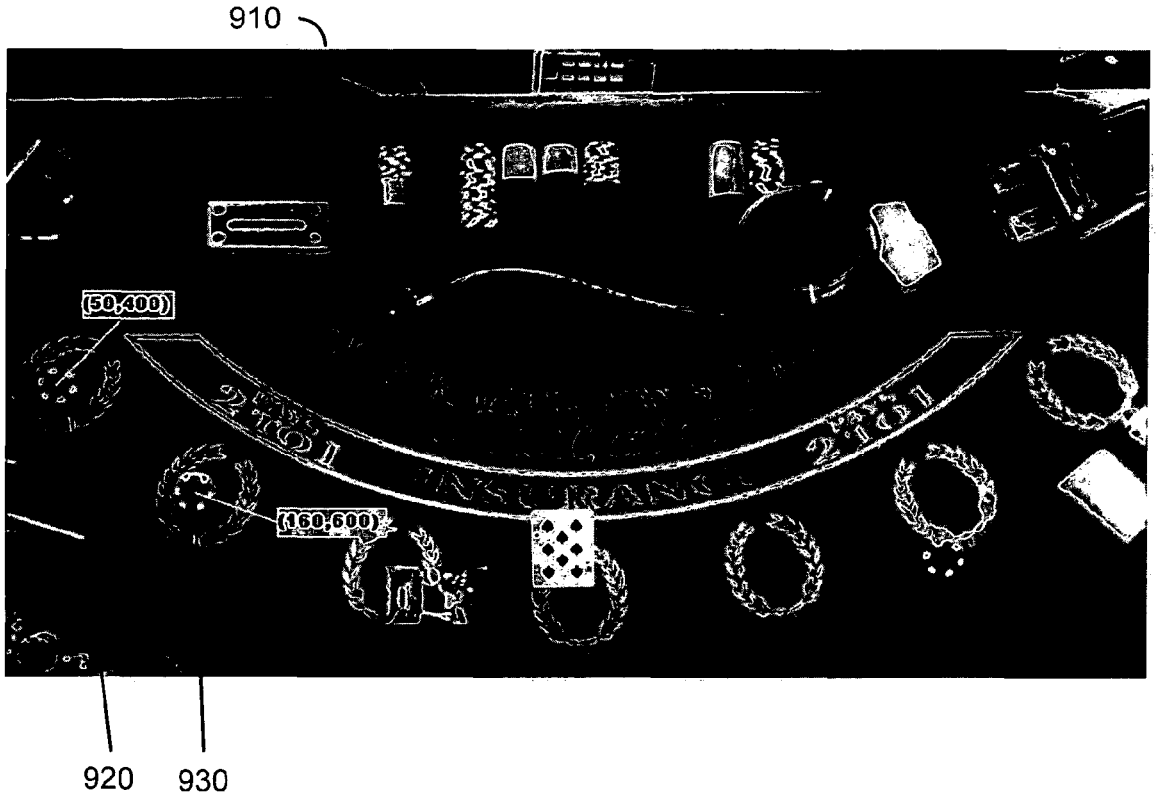
FIG. 9A illustrates an example of an image of chip stacks for use in triangulation.
Figure 9B:
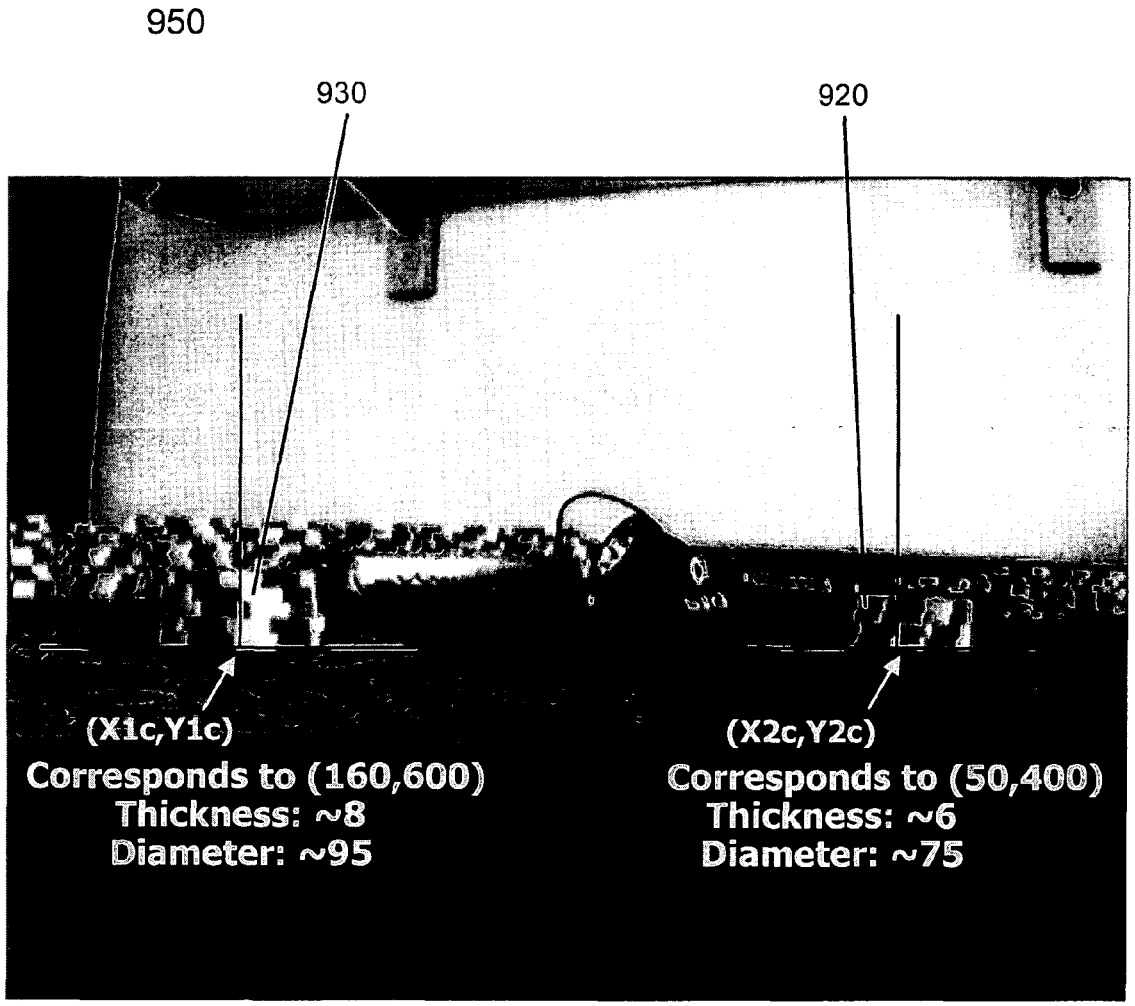
FIG. 9B illustrates another example of an image of chip stacks for use in triangulation.

Triangulation calibration during the calibration process discussed above with respect to step 680 of method 650 involves determining the location of an object, such as a gaming chip. The location may be determined using two or more images captured of the object from different angles. The coordinates of the object within each image are then correlated together. FIGS. 9A and 9B illustrate images of two stacks of chips 920 and 930 captured by two different cameras. A top view camera captures an image 910 of FIG. 9 having the chip stacks 920 and 930. For each chip stack, the positional coordinate is determined for each stack as illustrated. In particular, chip stack 920 has positional coordinates of (50, 400) and chip stack 930 has positional coordinates of (160, 600). Image 950 of FIG. 9B includes a side view of chip stacks 920 and 930. For each stack, the bottom center of the chip stack is determined and stored.

Table 3 shows Look-Up-Table (LUT) of a typical mapping of positional coordinates of first camera to those of supplemental cameras for wagering chip stacks 920 and 930 of FIGS. 9A and 9B. The units of the parameters of Table 3 are in pixels. In one embodiment, the mentioned calibration process is repeated to generate a more comprehensive space mapping LUT.

TABLE 3

Space mapping Look-Up-Table (LUT)

| First camera chip Coordinates (input) | | Supplemental camera chip coordinates (output) | |
|---|---|---|---|
| X | Y | X | Y |
| 50 | 400 | X2c | Y2c |
| 160 | 600 | X1c | Y1c |

In one embodiment, the calibrations for cards, chips, and trip tray are performed for a number of regions in an M×N matrix as discussed above at step 655, 665, and 670 in method 650. Step 686 of method 650 localizes the calibration data of the game environment. FIG. 10 illustrates a game environment divided into a 3×5 matrix. The localization of the card, chip, and chip tray recognition parameters in each region of the matrix improves the robustness of the gaming table monitoring system. This allows for some degree of variations in ambient setting such as lighting, fading of the table surface, imperfection within the optics and the imagers. Reference parameters can be stored for each region in a matrix, such as image quantization thresholds, playing object data (such as card and chip calibration data) and other parameters.

Figure 27:
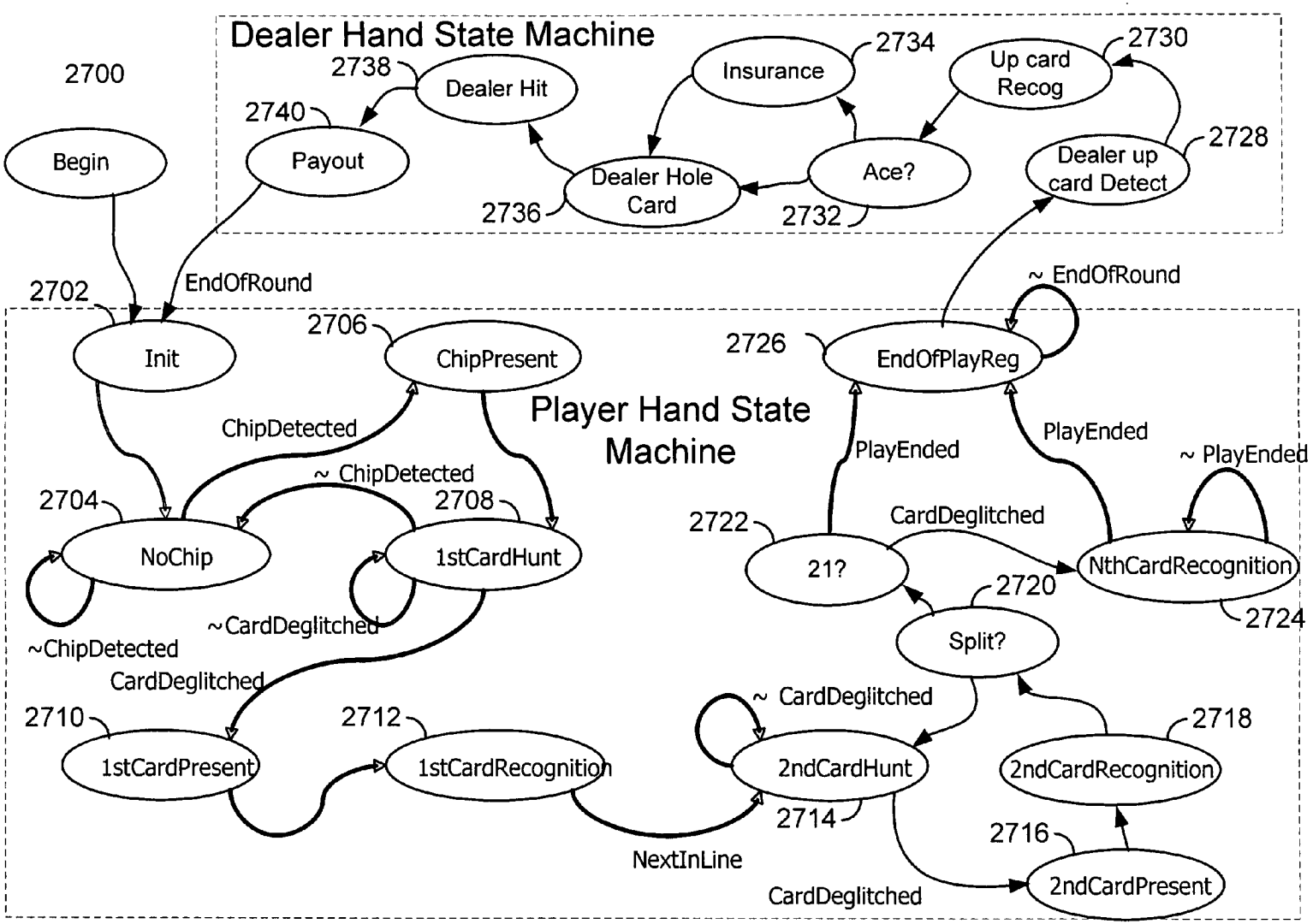
FIG. 27 illustrates one embodiment of game monitoring state machine.

Returning to method 400 of FIG. 4, operation of method 400 remains at step 420 until a new game begins. Once a new game begins, game monitoring begins at step 430. Game monitoring involves the detection of events during a monitored game which are associated with recognized game elements. Game elements may include game play pieces such as cards, chips, and other elements within a game environment. Actions are then performed in response to determining a game event. In one embodiment, the action can include transitioning from one game state within a state machine to another. An embodiment of a state machine for a black jack game is illustrated in FIG. 27 and discussed in more detail below.

Figure 11:
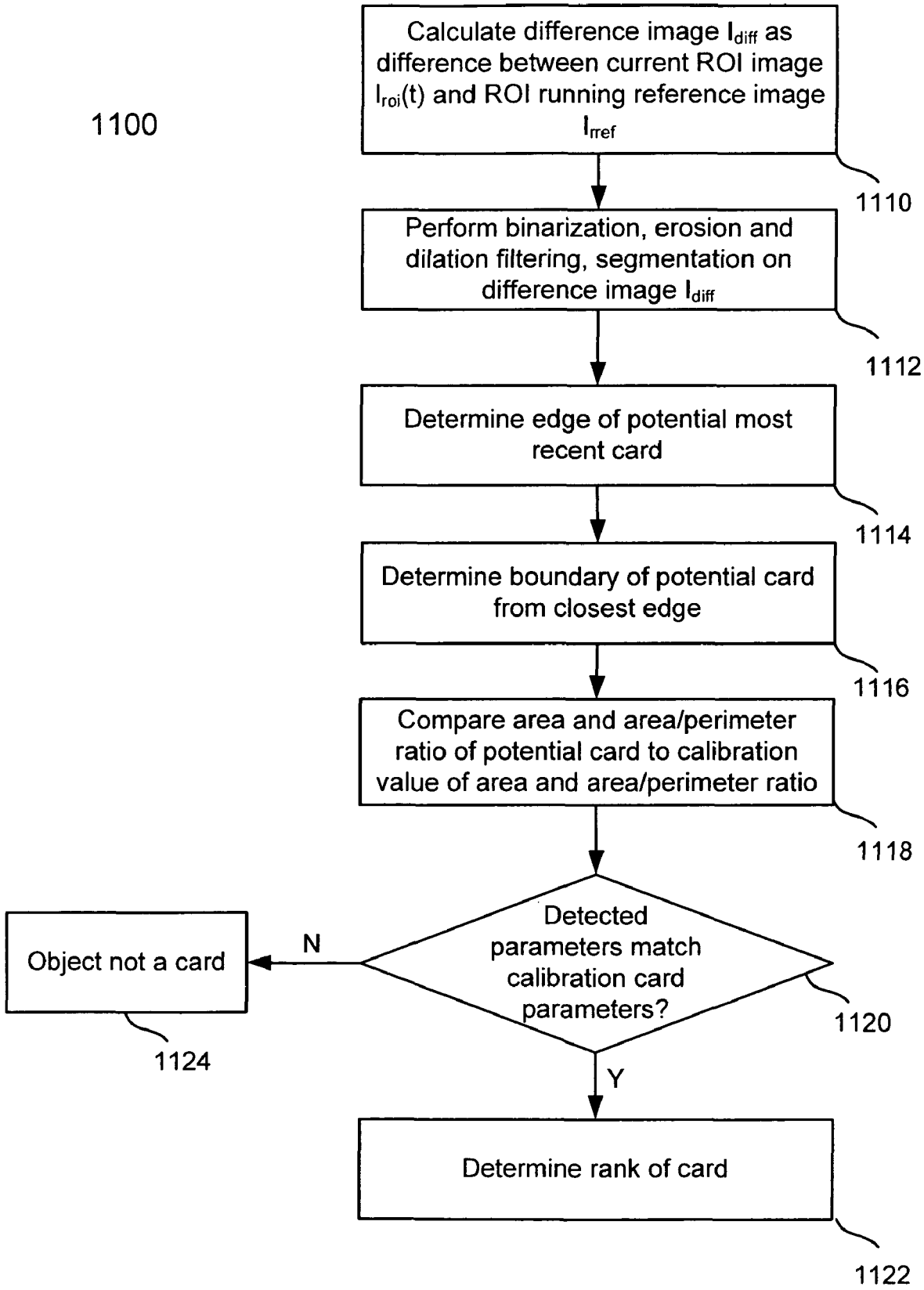
FIG. 11 illustrates one embodiment of a method for performing card recognition during gameplay.

In one embodiment, a detected event may be based on the detection of a card. FIG. 11 illustrates an embodiment of a method 1100 for performing card recognition during game monitoring. The card recognition process can be performed for each player's card ROI. First, a difference image $I_{diff}$ is generated as the difference between a current card ROI image $I_{roi}(t)$ for the current time t and the empty ROI reference image $I_{eref}$ for the player card ROI at step 1110. In another embodiment, the difference image $I_{diff}$ is generated as the difference between the current card ROI image and a running reference image, $I_{rref}$ where $I_{rref}$ is the card ROI of the $I_{eref}$ within which the chip ROI containing the chip is pasted. An example $I_{rref}$ is illustrated in FIG. 5C. $I_{rref}$ is the card ROI 593 of $I_{eref}$ within which the chip ROI 577 is pasted. This is discussed in more detail below. The current card ROI image $I_{roi}(t)$ is the most recent image captured of the ROI by a particular camera. In one embodiment, each player's card ROI is tilted at an angle corresponding to the line from the center of mass of the most recent detected card to the chip tray as illustrated in FIG. 5A-B. This makes the ROI more concise and requires processing of fewer pixels.

Next, binarization, erosion and dilation filtering and segmentation are performed at step 1112. In one embodiment, step 1112 is performed in the player's card ROI. Step 1112 is discussed in more detail above.

The most recent card received by a player is then determined. In one embodiment, the player's card ROI is analyzed for the most recent card. If the player has only received one card, the most recent card is the only card. If several cards have been placed in the player card ROI, than the most recent card must be determined from the plurality of cards. In one embodiment, cards are placed on top of each other and closer to the dealer as they are dealt to a player. In this case, the most recent card is the top card of a stack of cards and closest to the dealer. Thus, the most recent card can be determined by detecting the card edge closest to the dealer.

The edge of the most recently received card is determined at step 1114. In one embodiment, the edge of the most recently received card is determined to be the edge closest to the chip tray. If the player card ROI is determined to be a rectangle and positioned at an angle $\theta_C$ in the x,y plane as shown in FIG. 5B, the edge may be determined by picking a point within the grouped pixels that is closest to each of the corners that are furthest away from the player, or closest to the dealer position. For example, in FIG. 5B, the corners of the most recent card placed in ROI 510 are corners 571 and 572.

Once the most recent card edge is detected, the boundary of the most recent card is determined at step 1116. In one embodiment, the line between the corner pixels of the detected edge is estimated. The estimation can be performed using a least square method or some other method. The area of the card is then estimated from the estimated line between the card corners by multiplying a constant by the length of the line. The constant can be derived from a ratio of card area to card line derived from a calibrated card. The estimated area and area to perimeter ratio is then compared to the card area and area to perimeter ratio determined during calibration during step 1118 from an actual card. A determination is made as to whether detected card parameters match the calibration card parameters at step 1120. If the estimated values and calibration values match within some threshold, the card presence is determined and operation continues to step 1122. If the estimated values and calibration values do not match within the threshold, the object is determined to not be a card at step 1124. In one embodiment, the current frame is decimated at step 1124 and the next frame with the same ROI is analyzed.

The rank of the card is determined at step 1122. In one embodiment, determining card rank includes binarizing, filtering, clustering and comparing pixels. This is discussed in more detail below with respect to FIG. 12.

Figure 12:
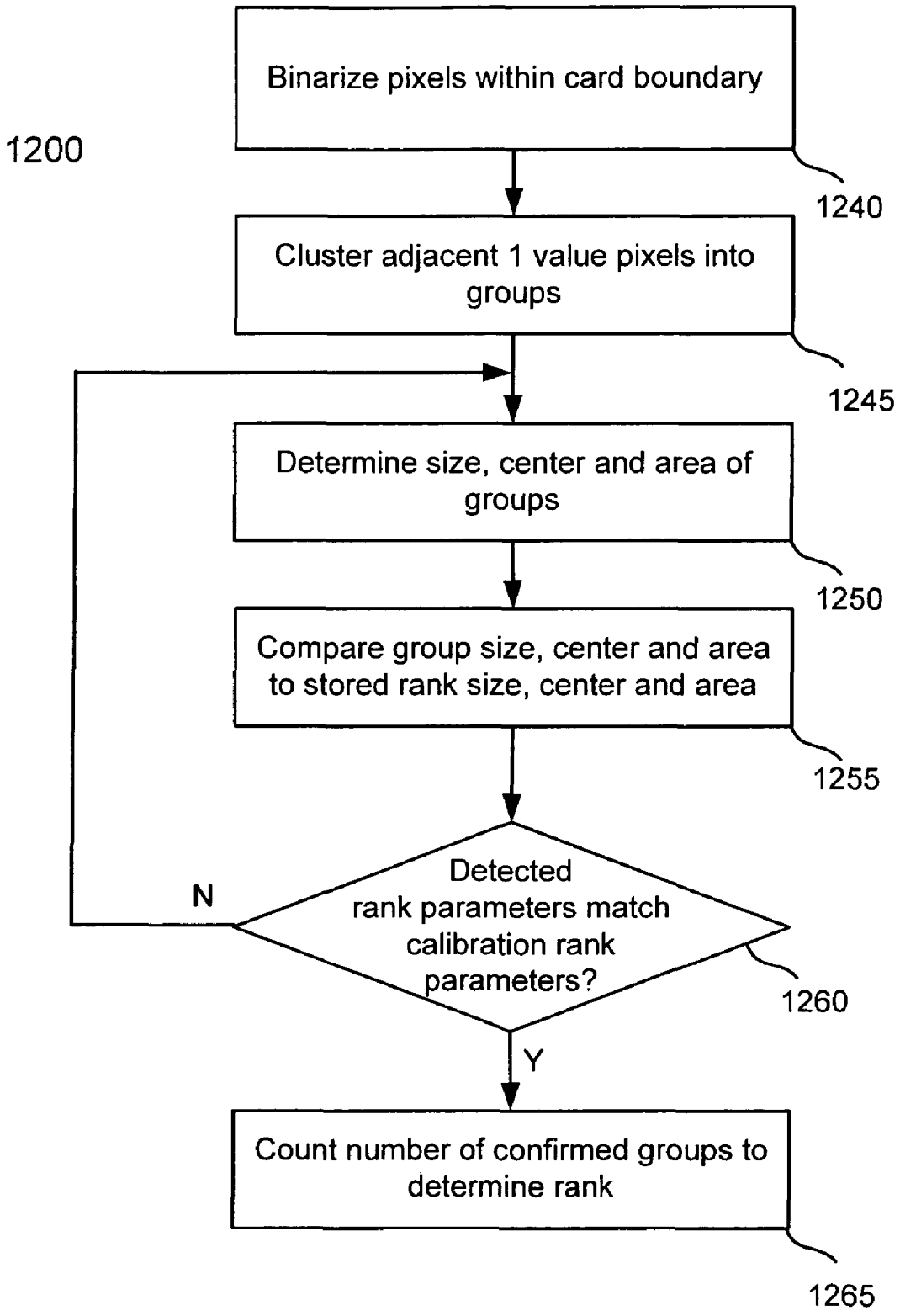
FIG. 12 illustrates one embodiment of a method for determining the rank of a detected card.

FIG. 12 illustrates an embodiment of a method for determining the rank of a detected card as discussed with respect to step 1122 of method 1100 of FIG. 11. Using the card calibration data in step 724, the pixels within the card boundary are binarized at step 1240. After binarization of the card, the binarized difference image is clustered into groups at step 1245. Clustering can be performed as discussed above. The clustered groups are then analyzed to determine the group size, center and area in units of pixels at step 1250. The analyzed groups are then compared to stored group information retrieved during the calibration process. The stored group information includes parameters of group size, center and area of rank marks on cards detected during calibration.

A determination is then made as to whether the comparison of the detected rank parameters and the stored rank parameters indicates that the detected rank is a recognized rank at step 1260. In one embodiment, detected groups with parameters that do not match the calibrated group parameters within some margin are removed from consideration. Further, a size filter may optionally be used to remove groups from being processed. If the detected groups are determined to match the stored groups, operation continues to step 1265. If the detected groups do not match the stored groups, operation may continue to step 1250 where another group of suspected rank groupings can be processed. In another embodiment, if the detected group does not match the stored group, operation ends and not further groups are tested. In this case, the detected groups are removed from consideration as possible card markings. Once the correct sized groups are identified, the groups are counted to determine the rank of the card at step 1265. In one embodiment, any card with over nine groups is considered a rank of ten.

Figure 13:
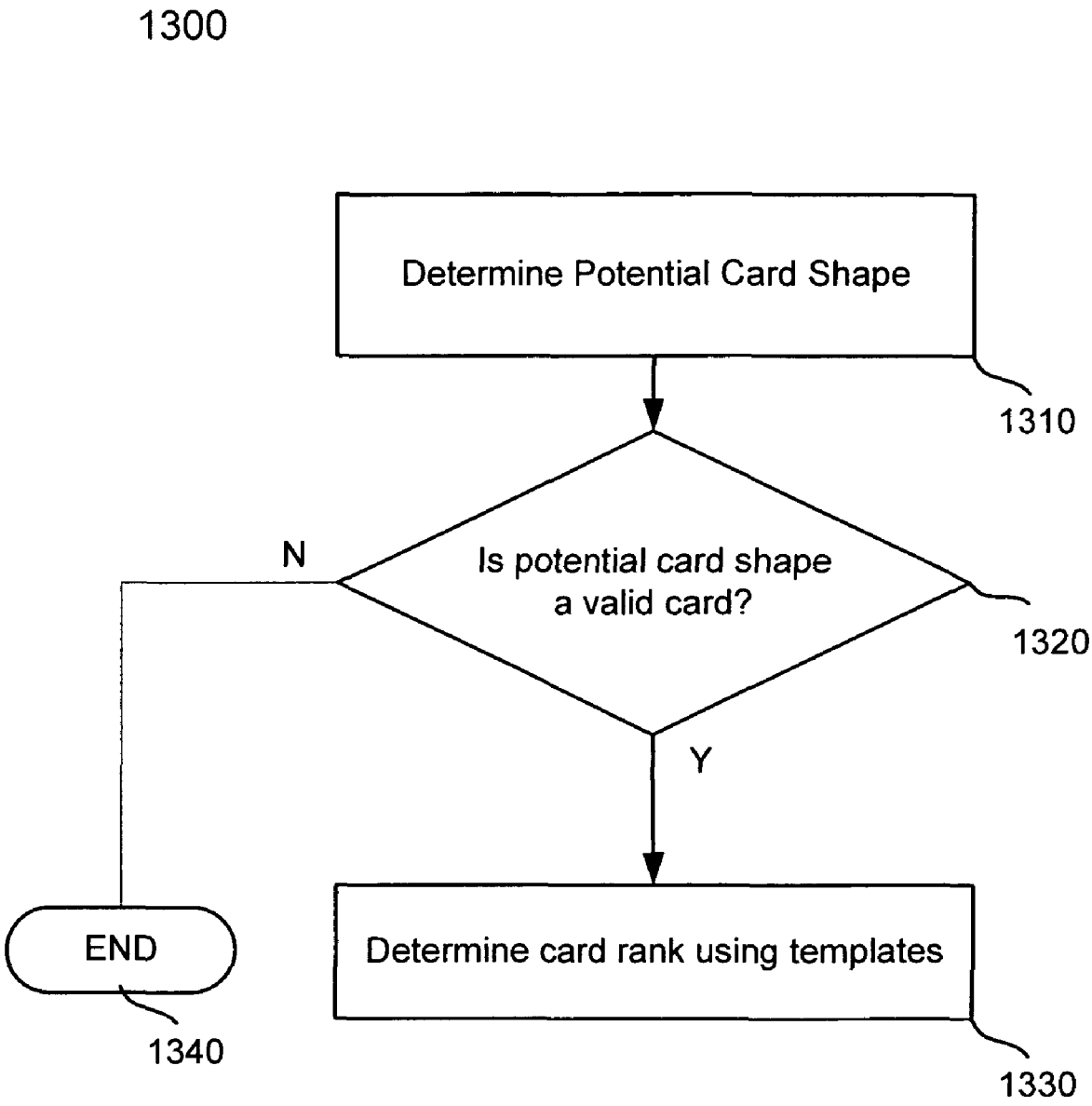
FIG. 13 illustrates one embodiment of a method for detecting a card and determining card rank.

In another embodiment, a card may be detected by determining a card to be valid card and then determining card rank using templates. An embodiment of a method 1300 for detecting a card and determining card rank is illustrated in FIG. 13. Method 13 begins with determining the shape of a potential card at step 1310. Determining card shape involves tracing the boundary of the potential card using an edge detector, and is discussed in more detail below in FIG. 14. Next, a determination is made as to whether the potential card is a valid card at step 1320. The process of making this determination is discussed in more detail below with respect to FIG. 18. If the potential card is valid card, the valid card rank is determined at step 1330. This is discussed in more detail below with respect to FIG. 20. If the potential card is not a valid card as determined at step 1320, operation of method 1300 ends at step 1340 and the potential card is determined not to be a valid card.

Figure 14:
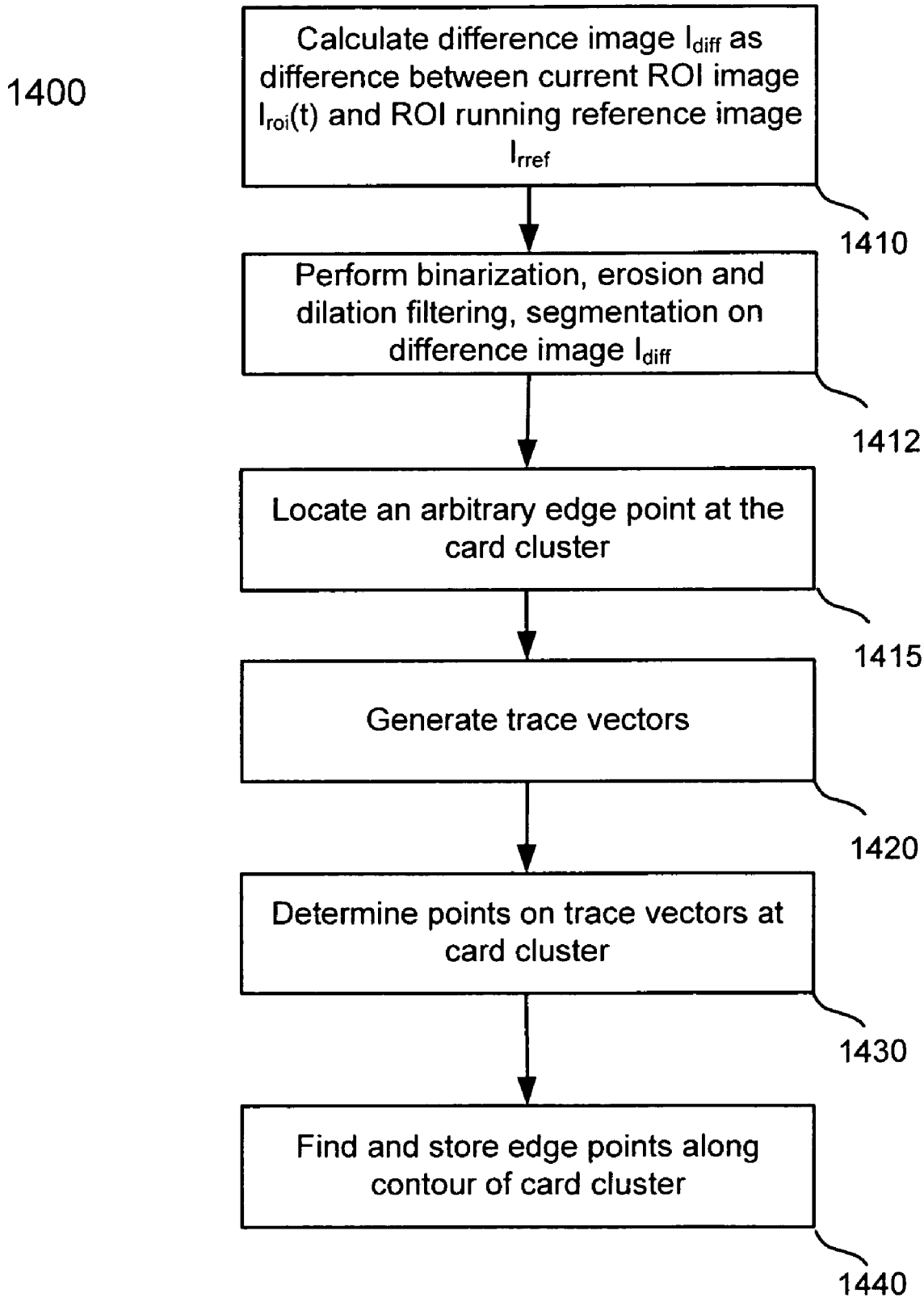
FIG. 14 illustrates one embodiment of a method for determining the contour of the card cluster

FIG. 14 illustrates a method 1400 for determining a potential card shape as discussed at step 1310 of method 1300. Method 1400 begins with generating a cluster of cards within a game environment at steps 1410 and 1412. These steps are similar to steps 1110 and 1112 of method 1100. In one embodiment, for a game environment such as that illustrated in FIG. 5A, subsequent cards dealt to each player are placed on top of each other and closer to a dealer or game administrator near the chip tray. As illustrated in FIG. 5B, most recent card 560 is placed over and closest to the chip tray than cards 561, 562 and 563. Thus, when a player is dealt more than one card, an edge point on the uppermost card (which is also closest to the chip tray) is selected.

Figure 15:
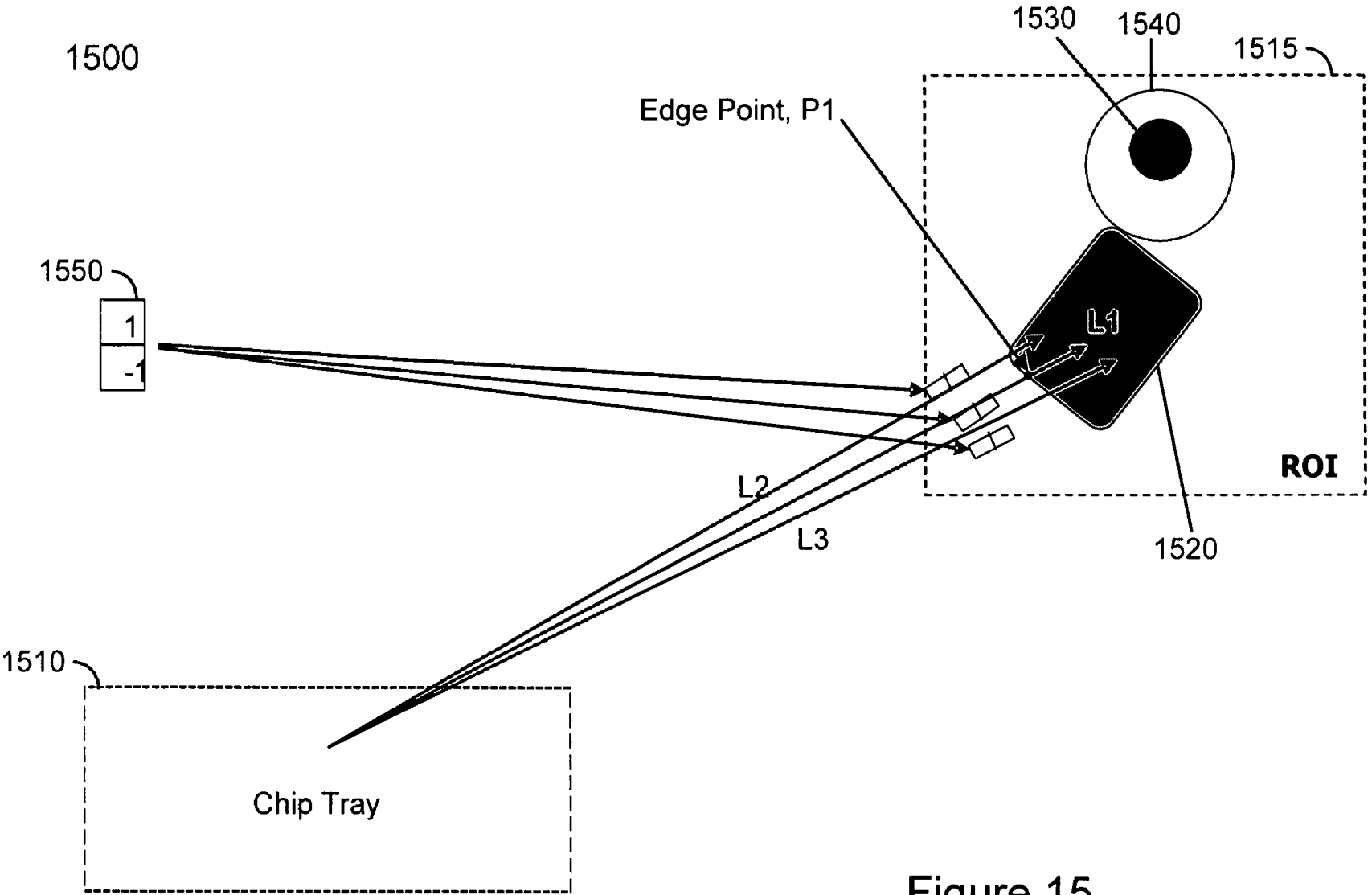
FIG. 15 illustrates one embodiment of a method for detecting a card edge within an image

The edge point of the of the card cluster can be detected at step 1415 and illustrated in FIG. 15. In FIG. 15, line L1 is drawn from the center of a chip tray 1510 to the centroid of the quantized card cluster 1520. An edge detector (ED) can be used to scan along line L1 at one pixel increments to perform edge detection operations, yielding GRAD(x,y)=pixel(x,y)−pixel($x_1$,$y_1$). GRAD(x,y) yields a one when the edge detector ED is right over an edge point (illustrated as P1 in FIG. 15) of the card, and yields zero otherwise. Other edge detectors/operators, such as a Sobel filter, can also be used on the binary or gray scale difference image to detect the card edge as well.

Figure 16:
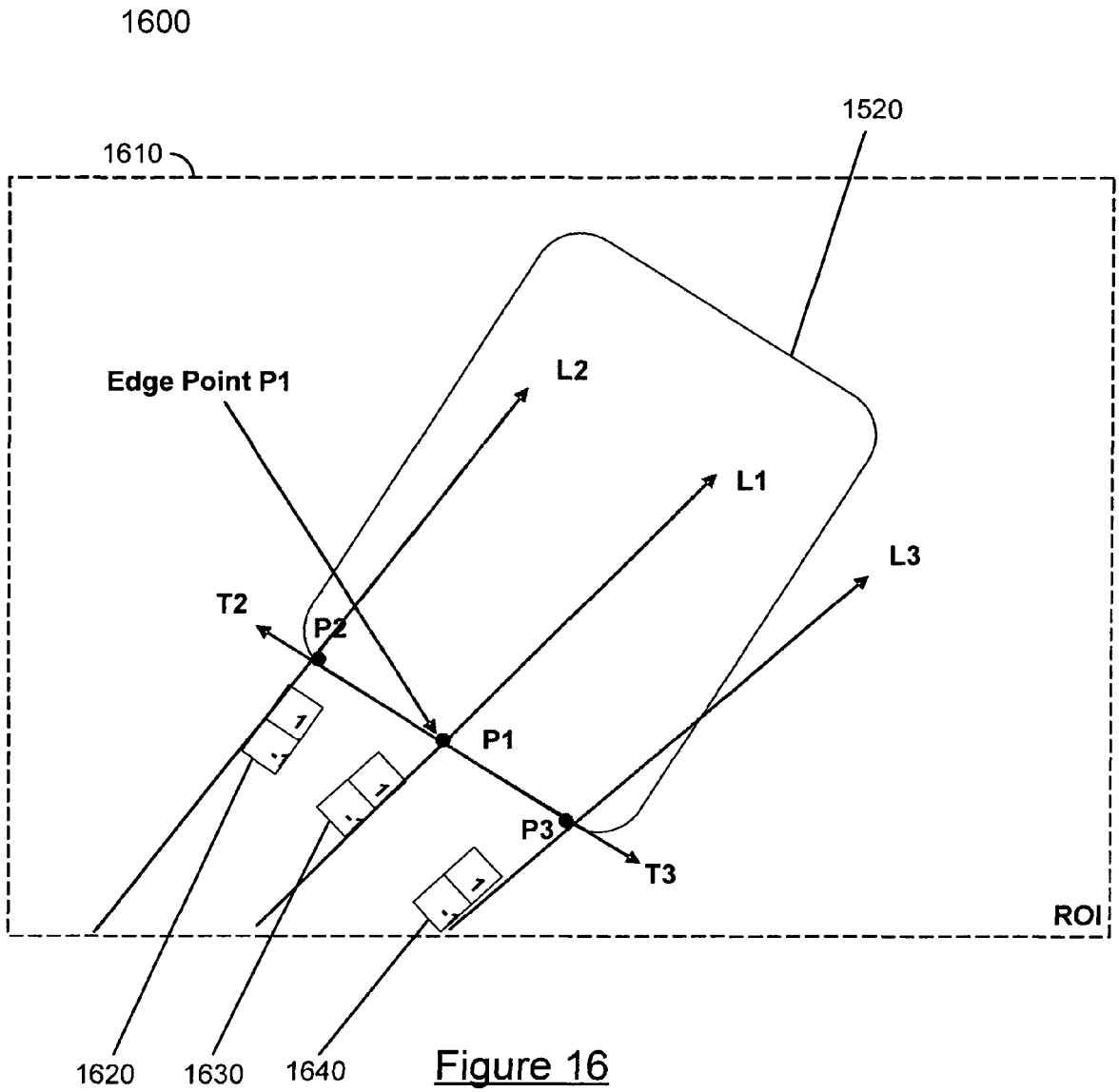
FIG. 16 illustrates an example of generated trace vectors within an image.

After an edge point of a card is detected, trace vectors are generated at step 1420. A visualization of trace vector generation is illustrated in FIGS. 15-16. FIG. 16 illustrates two trace vectors L2 and L3 generated on both sides of a first trace vector L1. Trace vectors L2 and L3 are selected at a distance from first trace vector L1 that will not place them off the space of the most recent card. In one embodiment, each vector is placed between one-eighth and one-fourth of the length of a card edge to either side of the first trace vector. In another embodiment, L2 may be some angle in the counter-clockwise direction relative L1 and L3 may be the same angle in the clockwise direction relative to L1.

Next, a point is detected on each of trace vectors L2 and L3 at the card edge at step 1430. In one embodiment, an ED scans along each of trace vectors L2 and L3. Scanning of the edge detector ED along line L2 and line L3 yields two card edge points P2 and P3, respectively, as illustrated in FIG. 16. Trace vectors T2 and T3 are determined as the directions from the initial card edge point and the two subsequent card edge points associated with trace vectors L2 and L3. Trace vectors T2 and T3 define the initial opposite trace directions.

Figure 17:
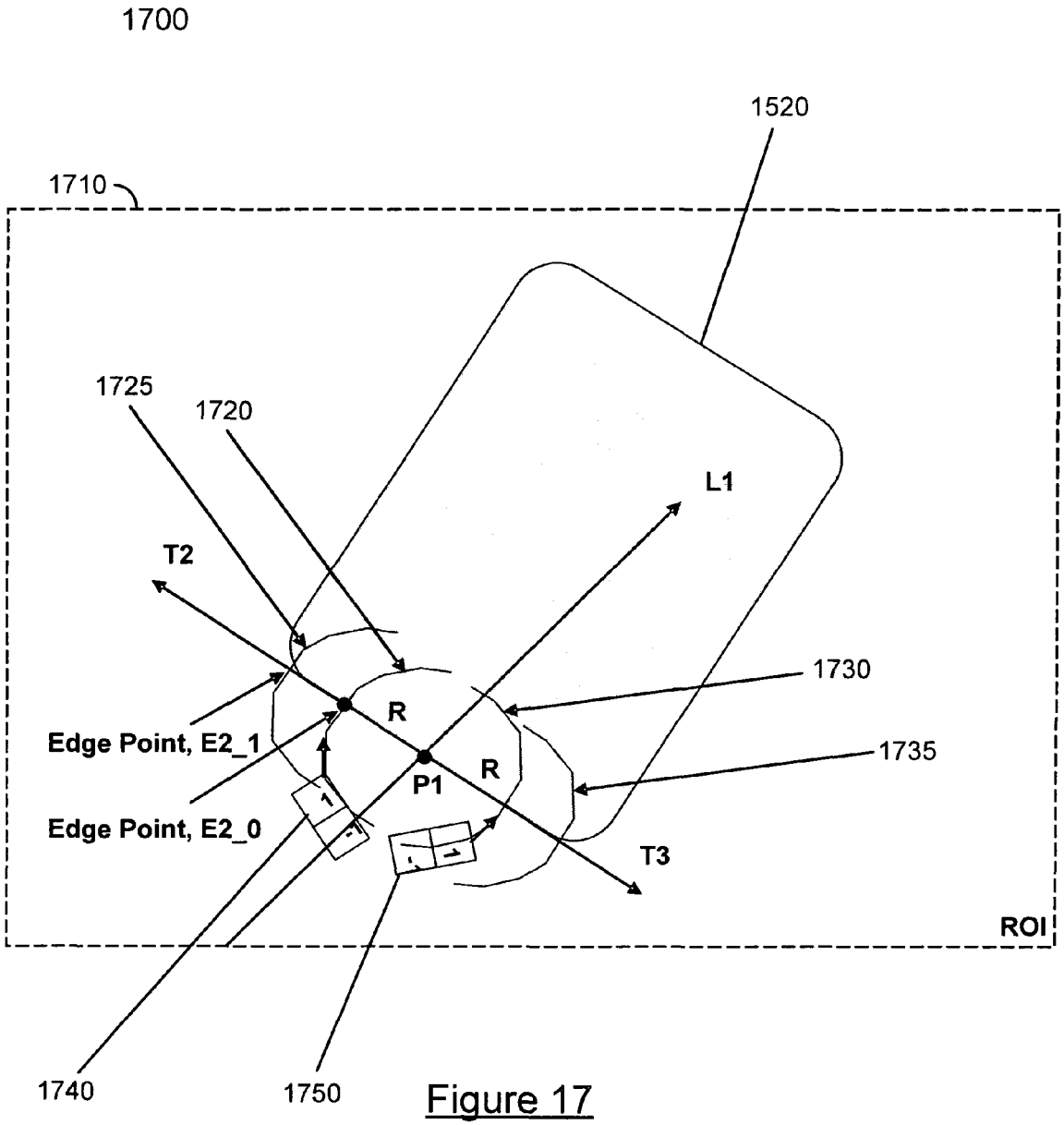
FIG. 17 illustrates one example of detected corner points on a card within an image.

The edge points along the contour of the card cluster are detected and stored in an (x,y) array of K entries at step 1440 and illustrated with FIG. 17. As illustrated in FIG. 17, at each trace location, an edge detector is used to determine card edge points for each trace vector along the card edge. Half circles 1720 and 1730 having a radius R and centered at point P1 are used to form an ED scanning path that intersects the card edge. Half circle 1720 scan path is oriented such that it crosses trace vector T2. Half circle 1730 scan path is oriented such that it crosses trace vector T3. In one embodiment, the edge detector ED starts scanning clockwise along scan path 1720 and stops scanning at edge point E2_0. In another embodiment, the edge detector ED scans two opposite scanning directions starting from the midpoint (near point E2_0) of path 1720 and ending at edge point E2_0. This reduces the number of scans required to locate an edge point. Once an edge point is detected, a new scan path is defined as having a radius extending from the edge point detected on the previous scan path. The ED will again detect the edge point in the current scan path. For example, in FIG. 17, a second scan path 1725 is derived by forming a radius around the detected edge point E2_0 of the previous scan path 1720. The ED will detect edge point E2_1 in scan path 1725. In this manner, the center of a half circle scan path moves along the trace vector T2, R pixels at a time, and is oriented such that it is bisected by the trace vector T2 (P1, E2_0). Similarly, but in opposite direction, an ED process traces the card edge in the T3 direction. When the scan paths reach the edges of the card, the ED will detect an edge on adjacent sides of the card. One or more points may be detected for each of these adjacent edges. Coordinates for these points are stored along with the first-detected edge coordinates.

The detected card cluster edge points are stored in an (x,y) array of K entries in the order they are detected. The traces will stop tracing when the last two edge points detected along the card edge are within some distance (in pixels) of each other or when the number of entries exceeds a pre-defined quantity. Thus, coordinates are determined and stored along the contour of the card cluster. A scan path in the shape of a half circle is used for illustration purposes only. Other operators and path shapes or patterns can be used to implement an ED scan path to detect card edge points.

Figure 18:
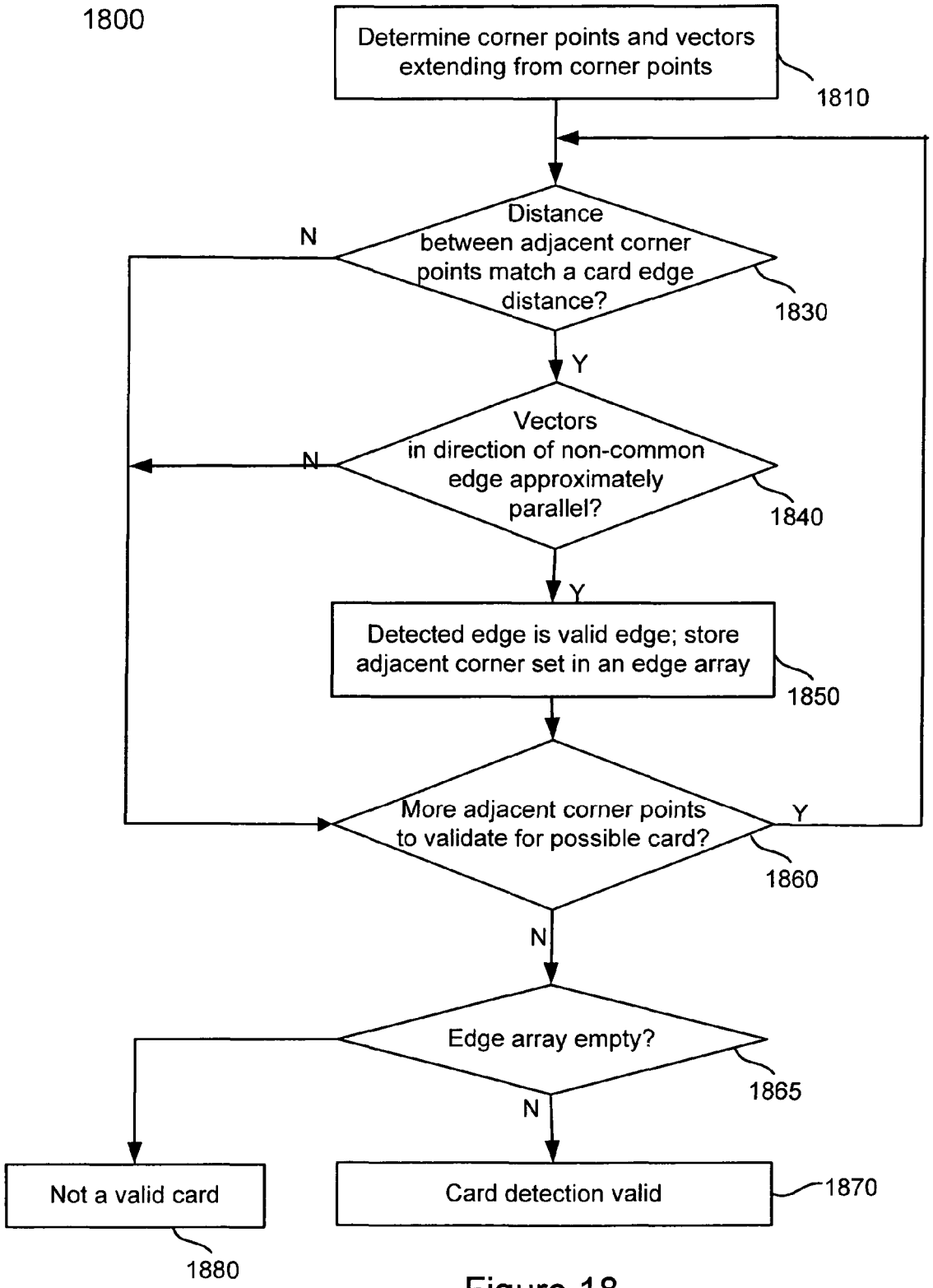
FIG. 18 illustrates one embodiment of a method of determining the validity of a card.
Figure 19:
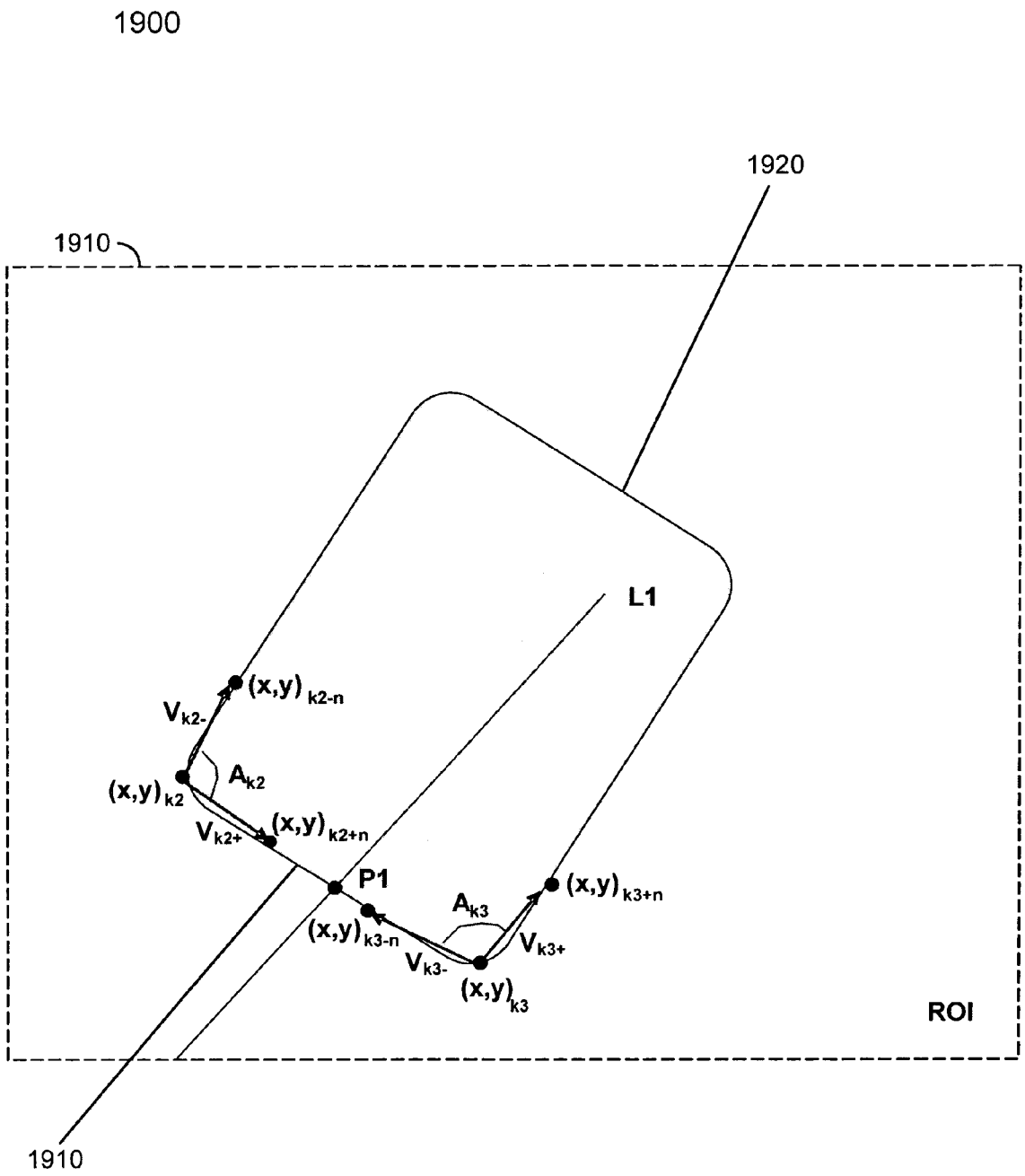
FIG. 19 illustrates one example of corner and vector calculations of a card within an image.

Returning to method 1300, after determining potential card shape, a determination is made at step 1320 as to whether the potential card is valid. An embodiment of a method 1800 for determining whether a potential card is valid, as discussed above at step 1320 of method 1300, is illustrated in FIG. 18. Method 1800 begins with detecting the corner points of the card and vectors extending from the detected corner points at step 1810. In one embodiment, the corners and vectors are derived from coordinate data from the (x,y) array of method 1400. FIG. 19 illustrates an image of a card 1920 with corner and vector calculations depicted. The corners are calculated as $(x,y)_{k2}$ and $(x,y)_{k3}$. The corners may be calculated by determining the two vectors radiating from the vertex are right angles within a pre-defined margin. In one embodiment, the pre-defined margin at step 1810 may be a range of zero to ten degrees. The vectors are derived by forming lines between the first point $(x,y)_{k2}$ and and two $n^{th}$ points away in opposite direction from the first point $(x,y)_{k2+n}$ and $(x,y)_{k2-n}$. As illustrated in FIG. 19, for corners $(x,y)_{k2}$ and $(x,y)_{k3}$, the vectors are generated with points $(x,y)_{k2-n}$ and $(x,y)_{k2+n}$, and $(x,y)_{k3-n}$, and $(x,y)_{k3+n}$, respectively. Thus a corner at $(x,y)_{k2}$ is determined to be valid if the angle $A_{k2}$ between vectors $V_{k2}$ and $V_{k2+}$ is a right angle within some pre-defined margin. A corner at $(x,y)_{k3}$ is determined to be valid if the angle $A_{k3}$ between vectors $V_{k3}$ and $V_{k3+}$ is a right angle within some pre-defined margin. Step 1810 concludes with the determination of all corners and vectors radiating from corners in the (x,y) array generated in method 1400.

As illustrated in FIG. 19, vectors $v_{k2}$+ and $v_{k2}$ form angle $A_{k2}$ and vectors $v_{k3+}$ and $v_{k3}$ form angle $A_{k3}$. If both angles $A_{k2}$ and $A_{k3}$ are detected to be about ninety degrees, or within some threshold of ninety degrees, then operation continues to step 1830. If either of the angles is determined to not be within a threshold of ninety degrees, operation continues to step 1860. At step 1860, the blob or potential card is determined to not be a valid card and analysis ends for the current blob or potential card if there are no more adjacent corner set to evaluate.

Next, the distance between corner points is calculated if it has not already been determined, and a determination is made as to whether the distance between the corner points matches a stored card edge distance at step 1830. A stored card distance is retrieved from information derived during the calibration phase or some other memory. In one embodiment, the distance between the corner points can match the stored distance within a threshold of zero to ten percent of the stored card edge length. If the distance between the corner points matches the stored card edge length, operation continues to step 1840. If the distance between the adjacent corner points does not match the stored card edge length, operation continues to step 1860.

A determination is made as to whether the vectors of the non-common edge at the card corners are approximately parallel at step 1840. As illustrated in FIG. 19, the determination would confirm whether vectors $v_{k2}$ and $v_{k3+}$ are parallel. If the vectors of the non-common edge are approximately parallel, operation continues to step 1850. In one embodiment, the angle between the vectors can be zero (thereby being parallel) within a threshold of zero to ten degrees. If the vectors of the non-common edge are determined to not be parallel, operation continues to step 1860.

At step 1850, the card edge is determined to be a valid edge. In one embodiment, a flag may be set to signify this determination. A determination is then made as to whether more card edges exist to be validated for the possible card at step 1860. In one embodiment, when there are no more adjacent corner points to evaluate for possible card, operation continues to step 1865. In one embodiment, steps 1830-1850 are performed for each edge of a potential card or card cluster under consideration. If more card edges exist to be validated, operation continues to step 1830. In one embodiment, steps 1830-1850 are repeated as needed for the next card edge to be analyzed. If no further card edges are to be validated, operation continues to step 1865 wherein the determination is made if the array of edge candidates stored in 1850 is empty or not. If the array of edge candidates is empty, the determination is made at step 1880 that the card cluster does not contain a valid card. Otherwise, a card is determined to be a valid card by selecting an edge that is closest to the chip tray from an array of edge candidates stored in 1850.

Figure 20:
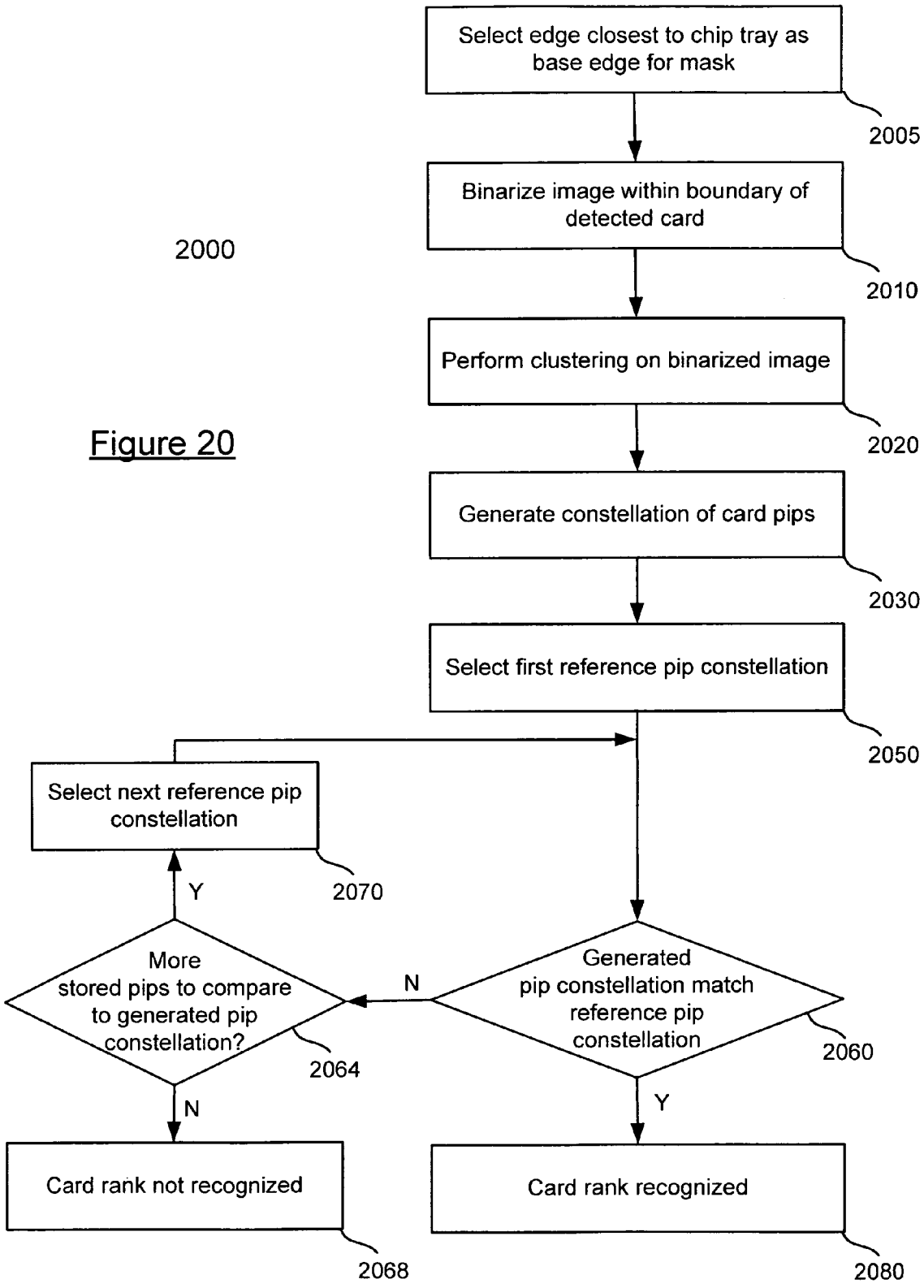
FIG. 20 illustrates one embodiment of a method for determining the rank of a card.
Figure 21:
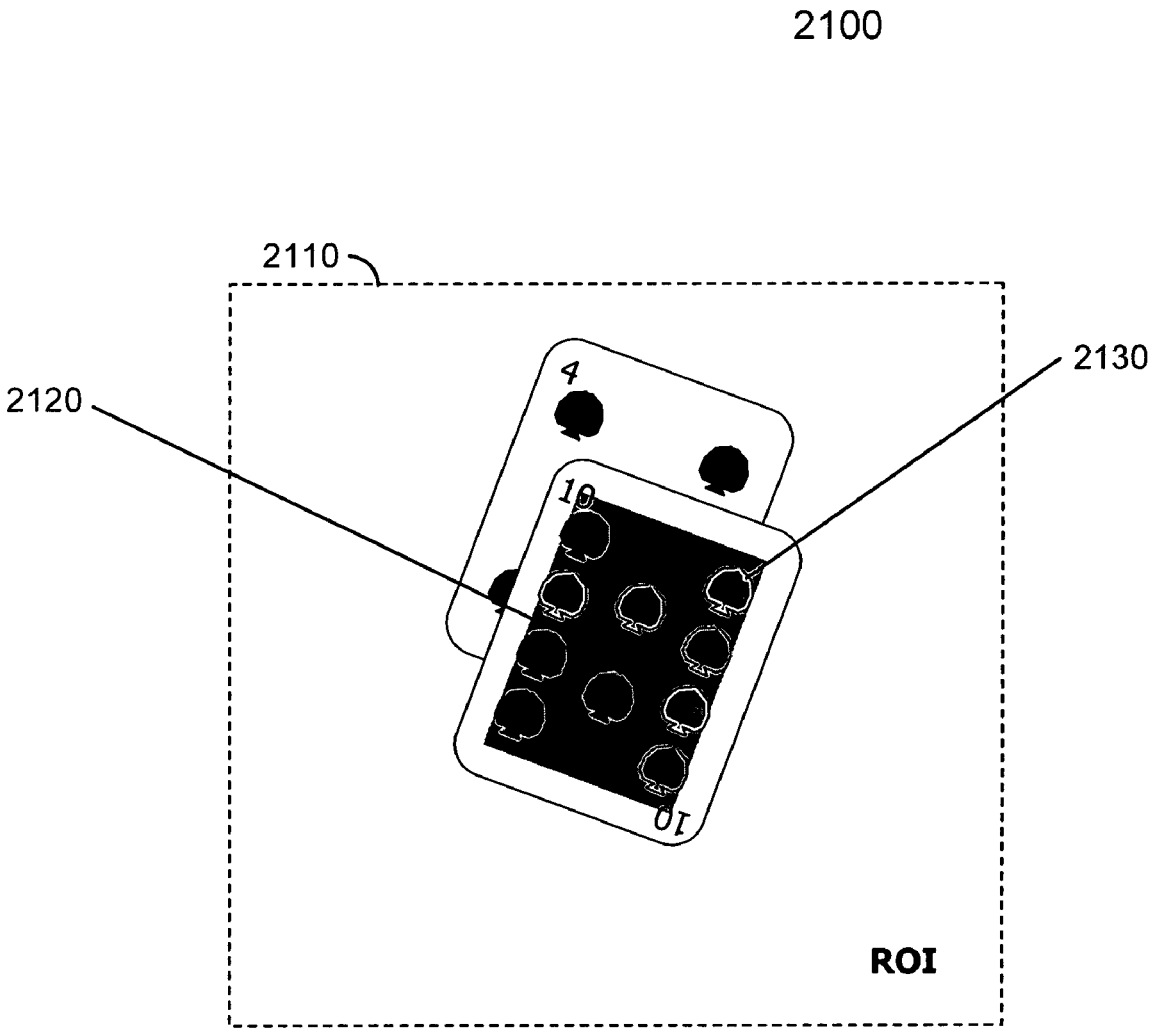
FIG. 21 illustrates one example of a constellation of card pips on a card within an image.

After the card is determined to be valid in method 1300, the rank of the valid card is determined at step 1330. In one embodiment, card rank can be performed similar to the process discussed above in method 1200 during card calibration. In another embodiment, masks and pip constellations can be used to determine card rank. A method 2000 for determining card rank using masks and pip constellations is illustrated in FIG. 20. First, the edge of the card closest to the chip tray is selected as the base edge for the mask at step 2005. FIG. 21 illustrates an example of a mask 2120, although other shape and size of mask can be used. The mask is binarized at step 2010. Next, the binarized image is clustered at step 2020. In one embodiment, the erosion and dilation filtering are operated on the binarized image prior to clustering at step 2020. A constellation of card pips is generated at step 2030. A constellation of card pips is a collection of clustered pixels representing the rank of the card. An example of a constellation of card pips is illustrated in FIG. 21. The top most card of image 2110 of FIG. 21 is a ten of spades. The constellation of pips 2130 within the mask 2120 includes the ten spades on the face of the card. Each spade is assigned an arbitrary shade by the clustering algorithm.

Next, a first reference pip constellation is then selected at step 2050. In one embodiment, the first reference pip constellation is chosen from a library, a list of constellations generated during calibration and/or initialization, or some other source. A determination is then made as to whether the generated pip constellation matches the reference pip constellation at step 2060. If the generated constellation matches the reference constellation, operation ends at step 2080 where the card rank is recognized. If the constellations do not match, operation continues to step 2064.

A determination is made as to whether there are more reference pip constellations to compare at step 2064. If more reference pip constellations exist that can be compared to the generated pip constellation, then operation continues to step 2070 wherein the next reference pip constellation is selected. Operation then continues to step 2060. If no further reference pip constellations exist to be compared against the generated constellation, operation ends at step 2068 and the card is not recognized. Card rank recognition as provided by implementation of method 2000 provides a discriminate feature for robust card rank recognition. In another embodiment, rank and/or suit of the card can be determined from a combination of the partial constellation or full constellation and/or a character at the corners of the card.

Figure 22:
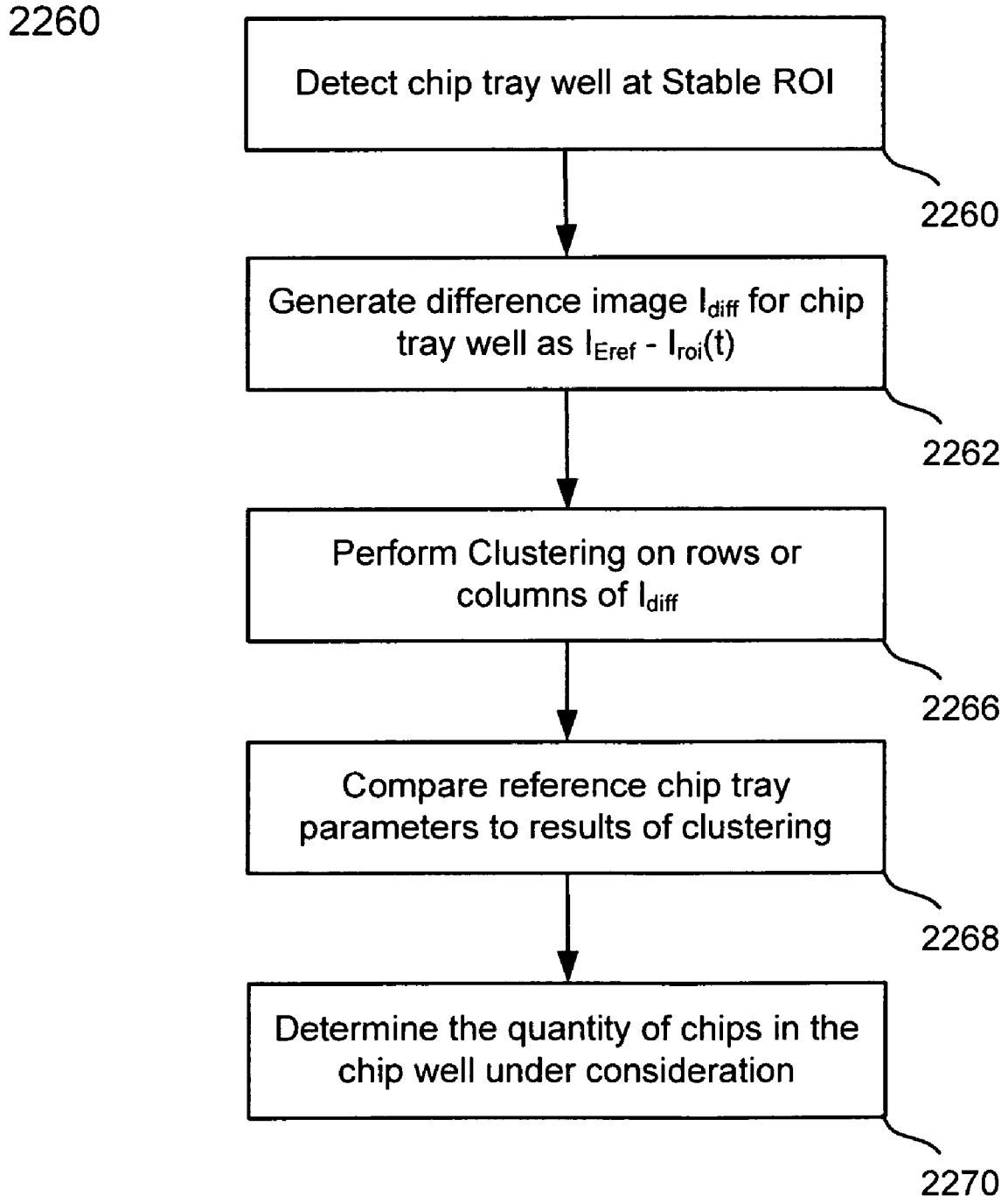
FIG. 22 illustrates one embodiment of illustrates one embodiment of a method for recognizing the contents of a chip tray by well.

In another embodiment, the chip tray balance is recognized well by well. FIG. 22B illustrates a method 2260 for recognizing contents of a chip tray by well. First, one or more wells is recognized to have a stable ROI asserted for those wells at step 2260. In one embodiment, the stable ROI is asserted for a chip well when the two neighboring well delimiters ROI are stable. A stable event for a specified ROI is defined as the sum of difference of the absolute difference image is less than some threshold. The difference image, in this case, is defined as the difference between the current image and previous image or previous $n^{th}$ image for the ROI under consideration. For example, FIG. 5C illustrates a chip well ROI 599 and the two neighboring well delimiters ROI 578 and 579. When sum of the difference between the current image and the previous image or previous $n^{th}$ image in ROI 578 and 579 yields a number that is less than some threshold, then a stable event is asserted for the well delimiters ROI 578 and 579. In one embodiment, the threshold is in the range of 0 to one-fourth the area of the region of interest. In another embodiment, threshold is based on the noise statistics of the camera. Using the metrics just mentioned, the stable event for ROI 599 is asserted at step 2260. Next, a difference image is determined for the chip tray well ROI at step 2262. In one embodiment, the difference image $I_{diff}$ is calculated as the absolute difference of the current chip tray well region of interest image $I_{roi}(t)$ and the empty reference image $I_{Eref}$. The clustering operation is performed on the difference image at step 2266. In one embodiment, erosion and dilation operations are performed prior to the clustering operation.

After clustering at step 2266, reference chip tray parameters are compared to the clustered difference image at step 2268. The comparison may include comparing the rows and columns of chips to corresponding chip pixel area and height of known chip quantities within a chip well. The quantity chips present in the chip tray wells are then determined at step 2270.

Figure 23:
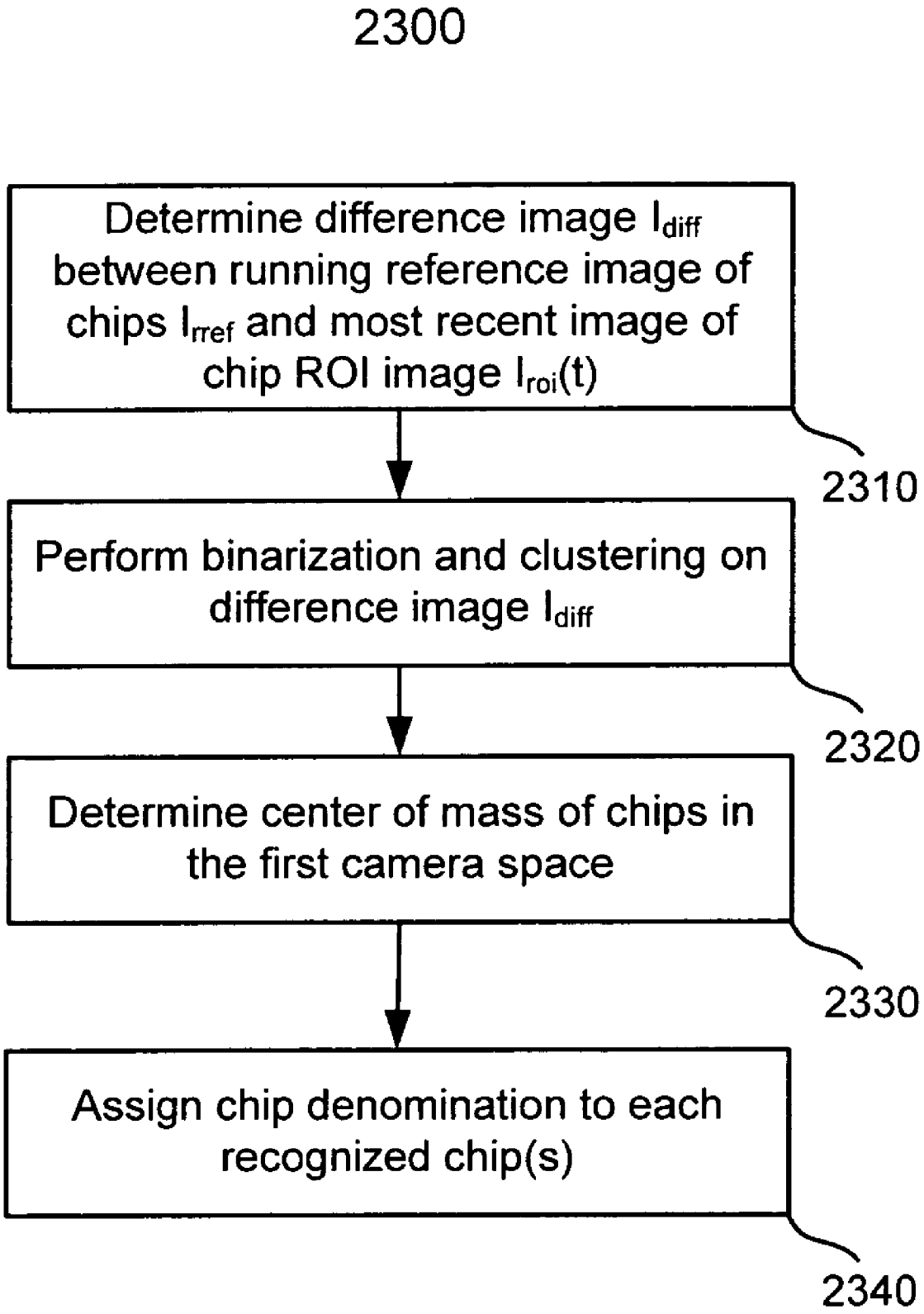
FIG. 23 illustrates one embodiment of a method for detecting chips during game monitoring.
Figure 24A:
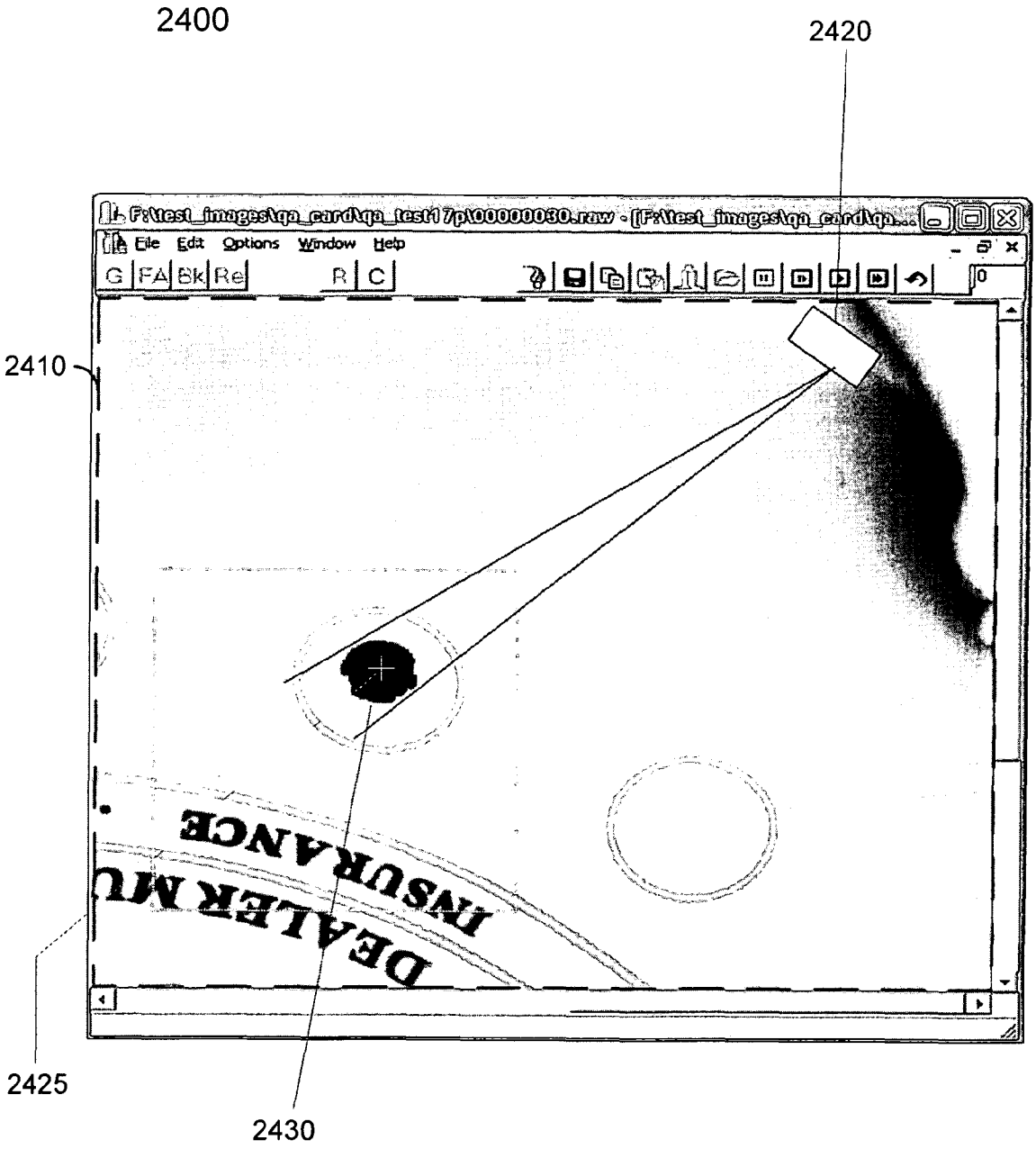
FIG. 24A illustrates one embodiment of clustered pixel group representing a wagering chip within an image.

In one embodiment, chips can be recognized through template matching using images provided by one or more supplemental cameras in conjunction with an overhead or top view camera. In another embodiment, chips can be recognized by matching each color or combination of colors using images provided by one or more supplemental cameras in conjunction with the first camera or top view camera. FIG. 23 illustrates a method 2300 for detecting chips during game monitoring. Method 2300 begins with determining a difference image between a empty reference image, $I_{Eref}$ of a chip ROI and the most recent image $I_{roi(t)}$ of a chip ROI image at step 2310. Next, the difference image is binarized and clustered at step 2320. In one embodiment, the erosion and dilation operations are performed on the binarized image prior to clustering. The presence and center of mass of the chips is then determined from the clustered image at step 2330. In one embodiment, the metrics used to determine the presence of the chip are the area and area to diameter. Other metrics can be used as well. As illustrated in FIG. 24A, clustered pixel group 2430 is positioned within a game environment within image 2410. In one embodiment, the (x,y) coordinates of the center clustered pixel group 2425 can be determined within the game environment positioning as indicated by a top view camera. In some embodiment, the distance between the supplemental camera and clustered group is determined. Once the image of the chips is segmented and the clustered group center of mass, in the top view camera space, is calculated at step 2330. Once the center of mass of the chip stack is known, the chip stack is recognized using the images captured by one or more supplemental cameras at step 2340. The conclusion of step 2340 assigns chip denomination to each recognized chips of the chip stack.

Figure 24B:
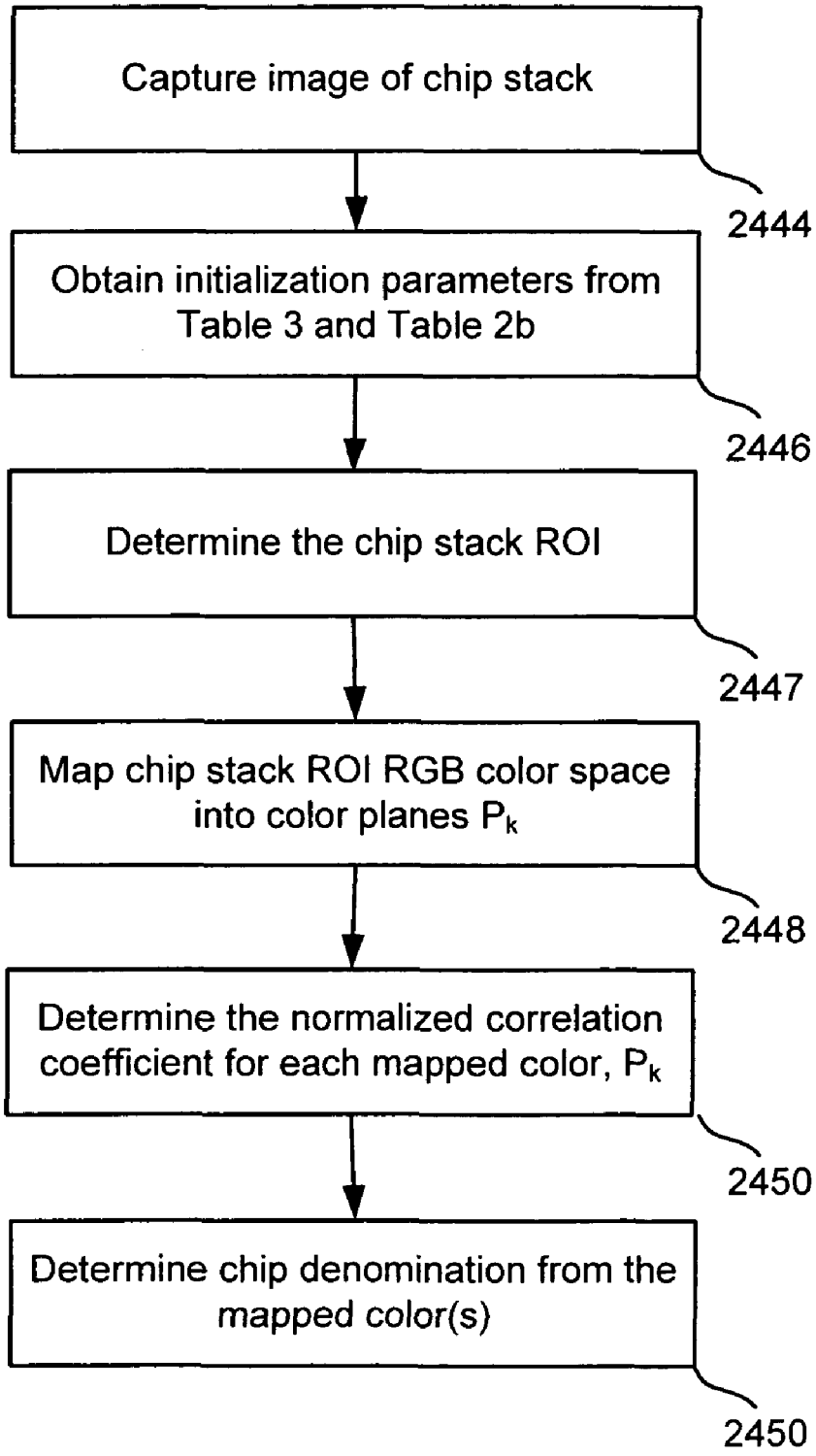
FIG. 24B illustrates one embodiment of a method for assigning chip denomination and values.
Figure 25:
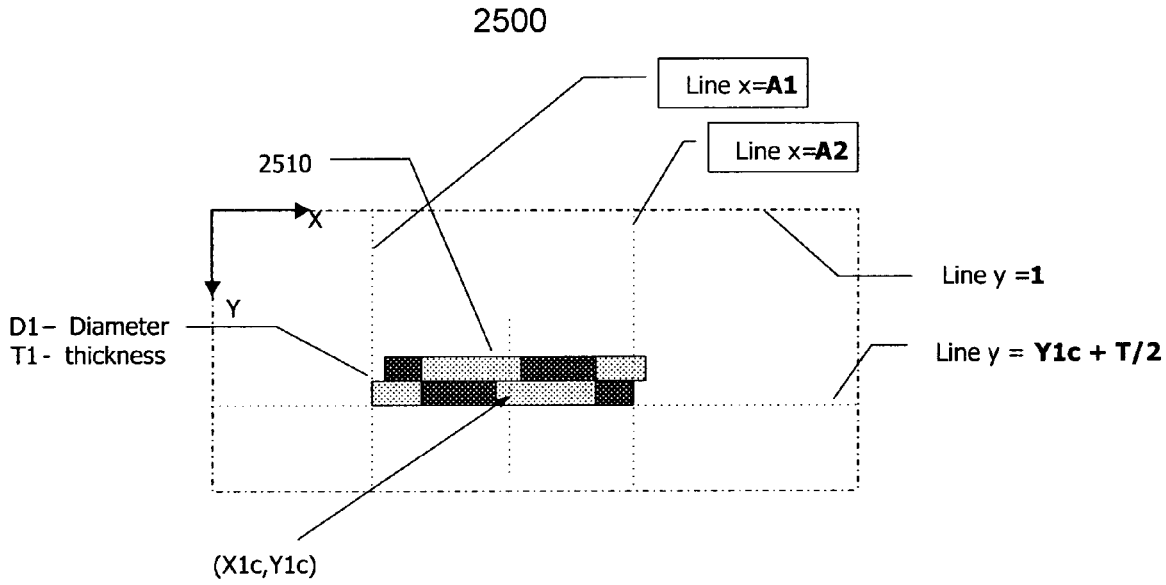
FIG. 25 illustrates another embodiment for performing chip recognition.

FIG. 24B illustrates a method 2440 for assigning chip denomination and value to each recognized chip as discussed above in step 2340 of method 2300. First, an image of the chip stack to analyze is captured with the supplemental camera 2420 at step 2444. Next, initialization parameters are obtained at step 2446. The initialization parameters may include chip thickness, chip diameter, and the bottom center coordinates of the chip stack from Table 3 and Table 2b. Using the space mapping LUT, Table 3, the coordinates of the bottom center of the chip stack as viewed by the supplemental camera are obtained by locating the center of mass of the chip stack as viewed from the top level camera. Using Table 2b, the chip thickness and chip diameter are obtained by locating the coordinates of the bottom center of the chip stack. With these initialization parameters, the chip stack ROI of the image captured by the supplemental camera is determined at step 2447. FIG. 25 illustrates an example image of a chip corresponding to an ROI captured at step 2447. The bottom center of the chip stack 2510 is (X1c,Y1c+T/2). X1c and Y1c were obtained from Table 3 in step 2446. The ROI in which the chip stack resides is defined by four lines. The vertical line A1 is defined by x=X1c−D/2 where D is the diameter of the chip obtained from Table 2b. The vertical line A2 is determined by x=X1c+D/2. The top horizontal line is y=1. The bottom horizontal line is y=Y1c−T/2 where T is the thickness of the chip obtained from Table 2b.

Next, the RGB color space of the chip stack ROI is then mapped into color planes at step 2448. Mapping of the chip stack RGB color space into color planes $P_k$ at step 2448 can be implemented as described below.

$$P_k = \begin{cases} 1 & I(x, y) = C_k \\ 0 & \text{else} \end{cases}$$

$$C_k \equiv r_k \pm n\sigma_{rk} \cap g_k \pm n\sigma_{gk} \cap b_k \pm n\sigma_{bk}$$

where $r_k$, $g_k$, and $b_k$ are mean red, green, and blue component of color k, $\sigma_{rk}$ is the standard deviation of red component of color k, $\sigma_{gk}$ is the standard deviation of green component of color k, $\sigma_{bk}$ is the standard deviation of the blue component of color k, n is an integer, 4) obtain normalized correlation coefficient for each color.

Figure 26A:
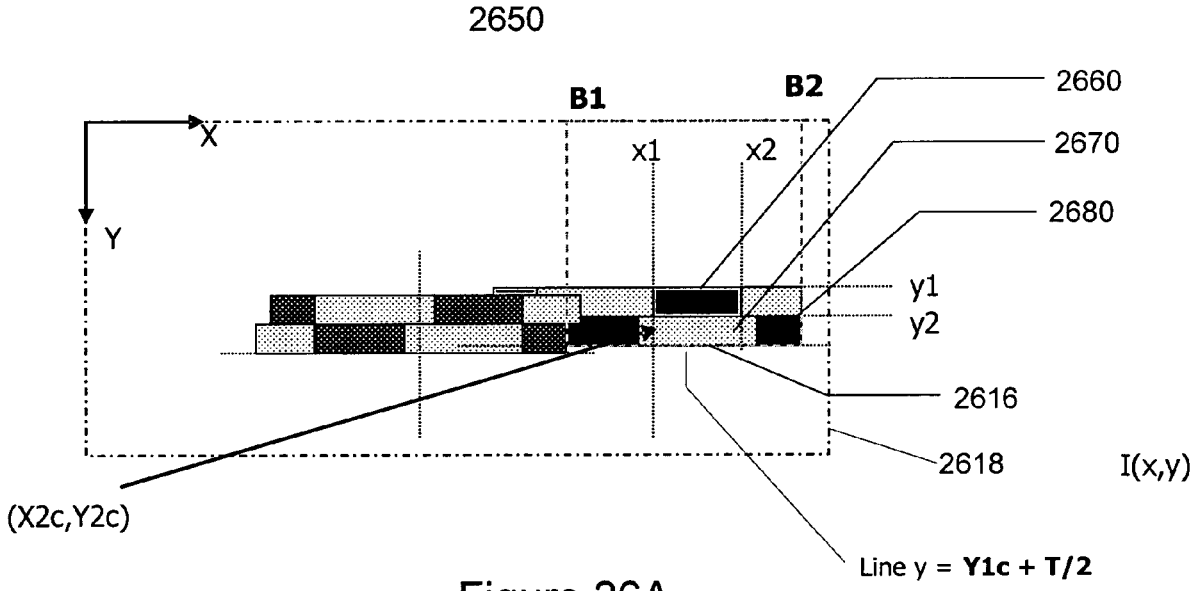
FIG. 26A illustrates one embodiment of a mapped chip stack within an image.
Figure 26B:
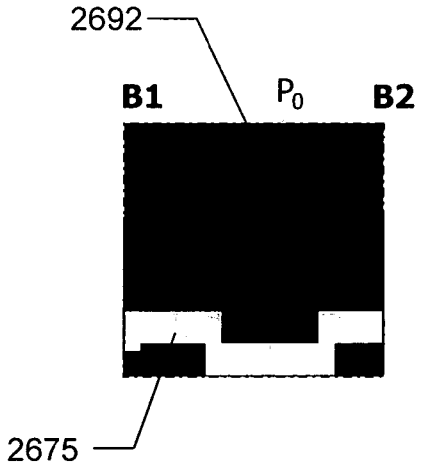
FIG. 26B illustrates an example of a mapping of a chip stack in RGB space within an image.
Figure 26C:
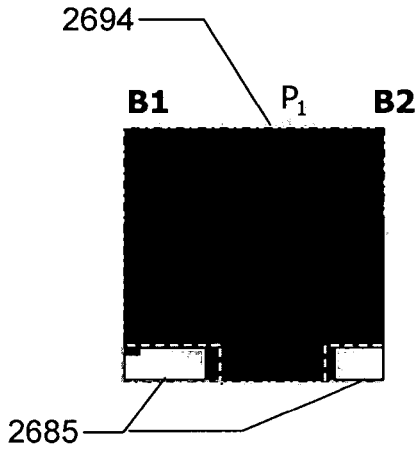
FIG. 26C illustrates another example of a mapping of a chip stack in RGB space within an image.
Figure 26D:
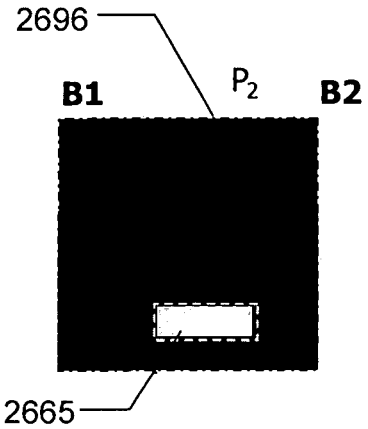
FIG. 26D illustrates yet another example of a mapping of a chip stack in RGB space within an image.

FIG. 26A illustrates an example of a chip stack image 2650 in RGB color space that is mapped into $P_k$ color planes. The ROI is generated for the chip stack. The ROI is bounded by four lines—x=B1, x=B2, y=1, y=Y2c+T/2. FIG. 26 B-D illustrates the mapping of a chip stack 2650 into three color planes $P_0$ 2692, $P_1$ 2694, and $P_2$ 2696. The pixels with value of "1" 2675 in the color plane $P_0$ represent the pixels of color $C_0$ 2670 in the chip stack 2650. The pixels with value of "1" 2685 in the color plane $P_1$ represent the pixels of color C, 2680 in the chip stack 2650. The pixels with value of "1" 2664 in the color plane $P_2$ represent the pixels of color $C_2$ 2650 in the chip stack 2650.

A normalized correlation coefficient is then determined for each mapped color $P_k$ at step 2450. The pseudo code of an algorithm to obtain the normalized correlation coefficient for each color, $cc_k$, is illustrated below. The four initialized parameters—diameter D, thickness T, bottom center coordinate (x2c,y2c)—are obtained from Table 3 and Table 2b. FIG. 8D illustrates an image of a chip having the vertical lines x1 and x2 using a rotation angle, $\theta_r$. The y1 and y2 parameters are the vertical chip boundary generated by the algorithm. The estimated color discriminant window is formed with x1, x2, y1, and y2. A Distortion function may map a barrel distortion view or pin cushion distortion view into the correct view as known in the art. A new discriminant window 2610 compensates for the optical distortion. In one embodiment, where optical distortion is minimal the DistortionMap function may be bypassed. The sum of all pixels over the color discriminant window divided by the area of this window yields an element in the $ccArray_k(r,y)$. The $ccArray_k(r,y)$ is the correlation coefficient array for color k with size $Y_{dither}$ by MaxRotationIndex. In one embodiment, $Y_{dither}$ is some fraction of chip thickness, T. The $cc_k(r_m,y_m)$ is the maximum corrrelation coefficient for color k, and is located at $(r_m,y_m)$ in the array. Of all the mapped colors $C_k$, the ccValue represents the highest correlation coefficient for a particular color. This color or combination thereof corresponds to a chip denomination.

```
Initialize D, T, x2c, y2=Y2c, EnterLoop
While EnterLoop
    for y = −Y_dither/2:Y_dither/2
        for r = 1:MaxRotationIndex
            for k = 1:NumOfColors
                [x1 x2] = Projection(theta(r));
                y1 = y2−T+y;
                Region = DistortionMap(x1,x2,y1,y2);
                ccArray_k(r,y) =
                sum(P_k(Region))/(Area of Region);
    end k, end r, end y
    cc_k(r_m,y_m) = max(ccArray_k(r,y);
    [Color ccValue] = max(cc_k);
    if ccValule > Threshold
        y_2 = y_2 − T + y_m
        EnterLoop = 1;
    else
        EnterLoop = 0;
    end (if)
End (while)
```

In another embodiment, the chip recognition may be implemented by a normalized correlation algorithm. A normalized correlation with self delineation algorithm that may be used to perform chip recognition is shown below:

$$ncc_c(u, v) = \frac{\sum_{u,v} [f_c(x, y) - \overline{f_c}][t_c(x-u, y-v) - \overline{t}]}{\sqrt{\sum_{u,v} [f_c(x, y) - \overline{f_c}]^2 \sum_{u,v} [t_c(x-u, y-v) - \overline{t}]^2}}$$

wherein $ncc_c(u,v)$ is the normalized correlation coefficient, $f_c(x,y)$ is the image size x and y, $fbar_{u,v}$ is the mean value at u,v, $t_c(x,y)$ is the template size of x and, tbar is the mean of the template, and c is color (1 for red, 2 for green, 3 for blue.) The chip recognition self delineation algorithm may be implemented in code as shown below:

```
while EnterLoop = 1
    do v – vNominal –1
        x = x + 1;
        do u = 2
            y = y + 1
            ccRed(x,y) = ncc (f,tRed);
            ccGreen(x,y) = ncc (f,tGreen);
            ccPurple(x,y) = ncc (f,tPurple);
        until u = xMax – xMin –D1
    until v = vNominal +1;
    [cc Chip U V] = max (ccRed, ccGreen, ccPurple);
    vNominal = vNominal – T1 – V;
    x,y = 0
    if cc < Threshold
        EnterLoop = 0
    end
end
```

In the code above, tRed, tGreen, tPurple are templates in the library, f is the image, ncc is the normalized correlation function, max is the maximum function, T is the thickness of the template, D is the diameter of the template, U,V is the location of the maximum correlation coefficient, and cc is the maximum correlation coefficient.

To implement this algorithm, the system recognizes chips through template matching using images provided by the supplemental cameras. To recognize the chips in a particular players betting circle, an image is captured by a supplemental camera that has a view of the player's betting circle. The image can be compared to chip templates stored during calibration. A correlation efficient is generated for each template comparison. The template associated with the highest correlation coefficient (ideally a value of one) is considered the match. The denomination and value of the chips is then taken to be that associated with the template.

FIG. 27 illustrates an embodiment of a game state machine for implementing game monitoring. States are asserted in the game state machine 2700. During game monitoring, transition between game states occurs based on the occurrence of detected events. In one embodiment, transition between states 2704 and 2724 occurs for each player in a game. Thus, several instances of states 2704-2924 may occur after each other for the number of players in a game.

Figure 28:
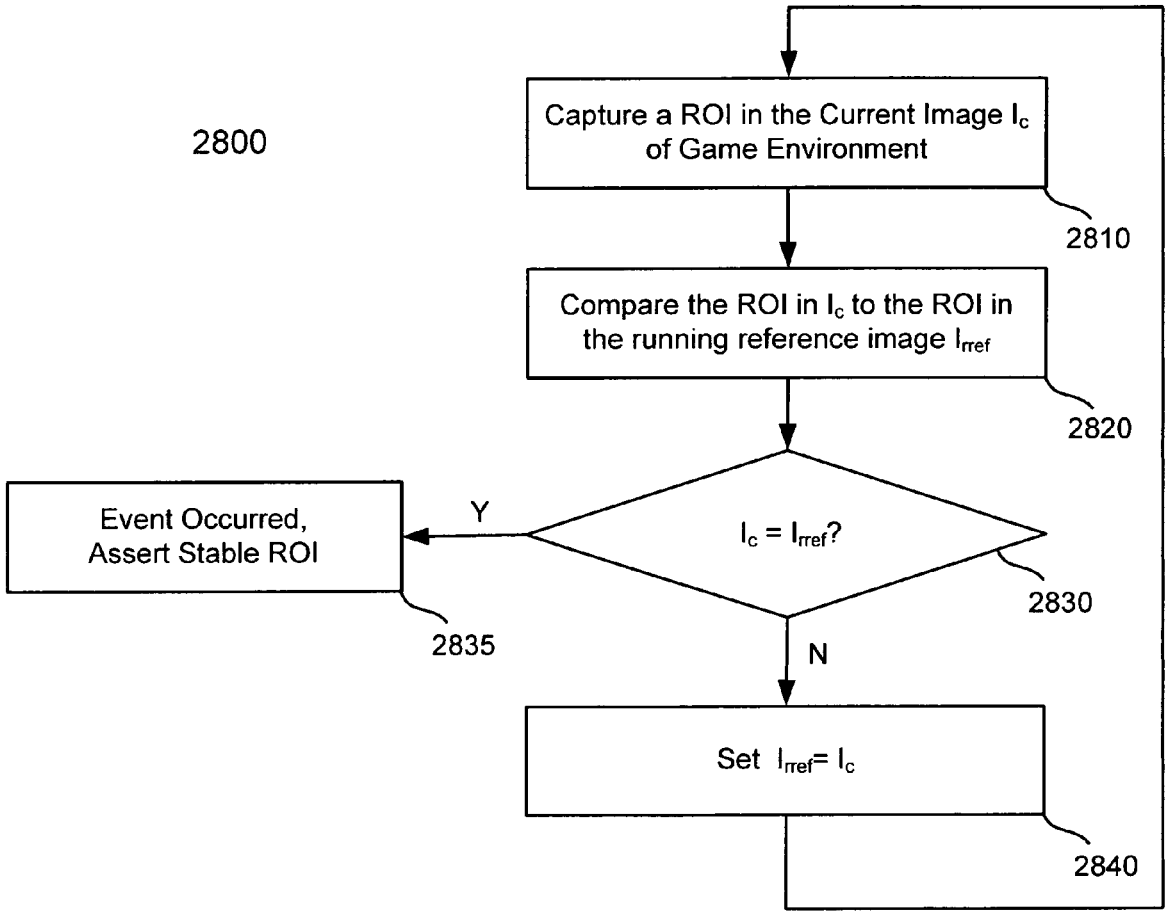
FIG. 28 illustrates one embodiment of a method for detecting a stable ROI.

FIG. 28 illustrates one embodiment for detecting a stable region of interest. In one embodiment, state transitions for the state diagram 2700 of FIG. 27 are triggered by the detection of a stable region of interest. First, a current image $I_c$ of a game environment is captured at step 2810. Next, the current image is compared to the running reference image at step 2820. A determination is then made whether the running reference image is the same image as the current image. If the current is equal to the running reference image, then an event has occurred and a stable ROI state is asserted at step 2835. If the current image is not equal to the running reference image, then the running reference image is set equal to the current image, and operation returns to step 2810. In another embodiment, the running reference image $I_{rref}$ can be set to the nth previous image $I_{roi}$(t-n) where n is an integer as step 2840. In another embodiment step 2820 can be replaced by the absolute difference image, $I_{diff}=|I_c-I_{rref}|$. The summation of $I_{diff}$ is calculated over the ROI. Step 2830 is now replaced with another metric. If the summation of $I_{diff}$ image is less than some threshold, then the stable ROI state is asserted at step 2835. In one embodiment, the threshold may be some proportionately related to the area of the ROI under consideration. In another embodiment, the $I_{diff}$ is binarized and spatially filtered with erosion and dilation operations. This binarized image is then clustered. A contour trace, as described above, is operated on the binarized image. In this embodiment, step 2830 is replaced with a shape criteria test. If the contour of the binarized image pass the shape criteria test, then the stable event is asserted at step 2835.

State machine 2700 begins at initialization state 2702. Initialization may include equipment calibration, game administrator tasks, and other initialization tasks. After initialization functions are performed, a no chip state 2704 is asserted. Operation remains at the no chip state 2704 until a chip is detected for the currently monitored player. After chips have been detected, first card hunt state 2708 is asserted.

Figure 29:
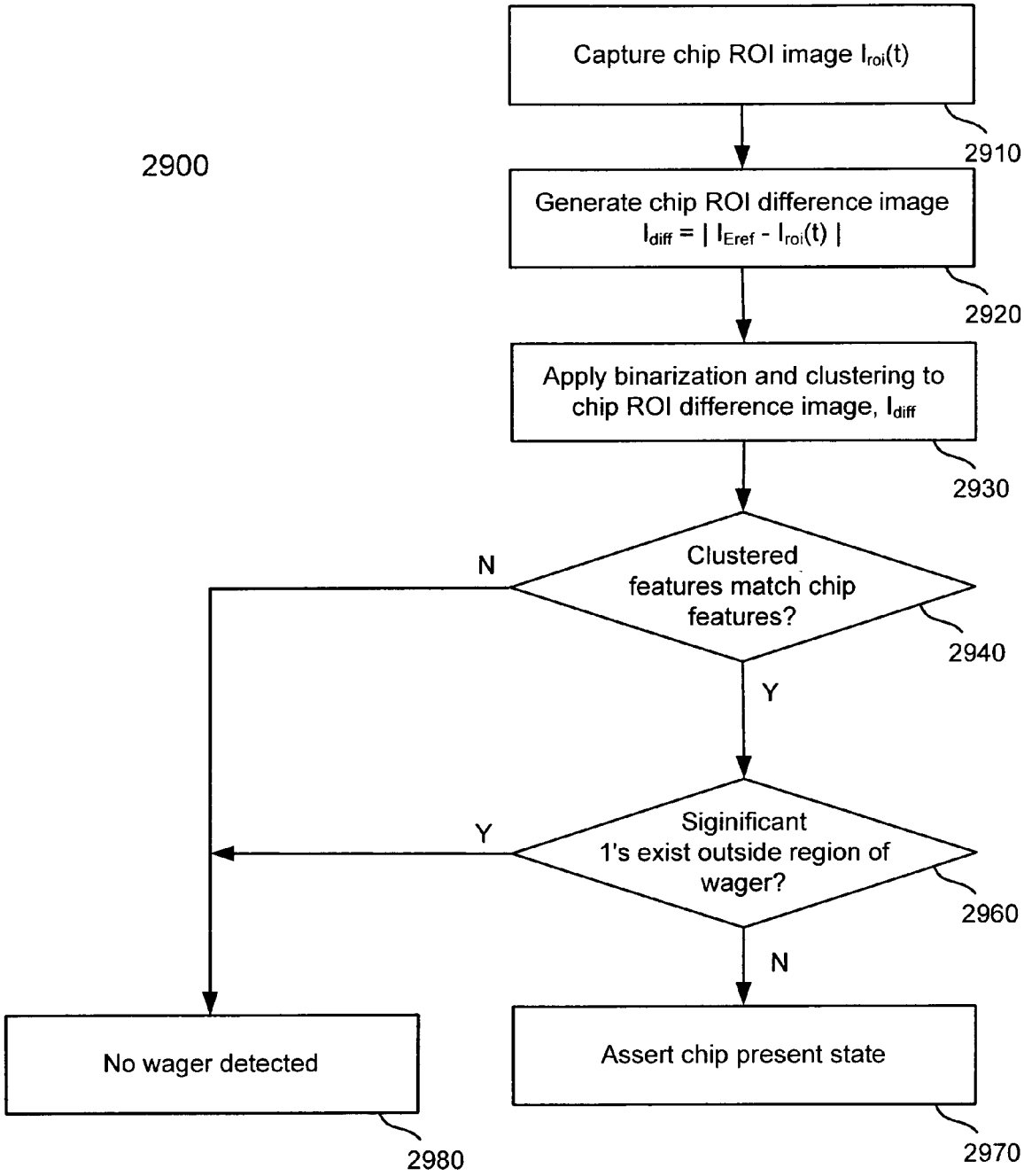
FIG. 29 illustrates one embodiment of a method for determining whether chips are present in a chip ROI.

FIG. 29 illustrates an embodiment of a method 2900 for determining whether chips are present. In one embodiment, method 2900 implements the transition from state 2704 to state 2706 of FIG. 27. First, a chip region of interest image is captured at step 2910. Next, the chip region of interest difference image is generated by taking the absolute difference of the chip region of interest of the current image $I_{roi}$(t) and the empty running reference image $I_{Eref}$ at step 2920. Binarization and clustering are performed to the chip ROI difference image at step 2930. In another embodiment, erosion and dilation operations are performed prior to clustering. A determination is then made whether clustered features match a chip features at step 2940. If clustered features do not map the chip features, then operation continues to step 2980 where no wager is detected. At step 2980, where no wager is detected, no transition will occur as a result of the current images analyzed at states 2704 of FIG. 27. If the cluster features match the chip features at step 2940, then operation continues to step 2960.

A determination is made as to whether insignificant one value pixels exist outside the region of wager at step 2960. In one embodiment, insignificant one value pixels include any group of pixels caused by noise, camera equipment, and other factors inherent to a monitoring system. If significant one value pixels exist outside the region of wager, then operation continues to step 2980. If significant one value pixels do not exist outside the region of wager at step 2960, then the chip present state is asserted at step 2970. In one embodiment step 2960 is bypassed such that if the cluster features match those of the chip features at step 2940, the chip present state is asserted at step 2970.

Returning to state machine 2700, at first card hunt state 2708, the system is awaiting detection of a card for the current player. Card detection can be performed as discussed above. Upon detection of a card, a first card present state 2710 is asserted. This is discussed in more detail with respect to FIG. 32. After the first card present state 2710 is asserted, the system recognizes the card at first card recognition state 2712. Card recognition can be performed as discussed above.

Figure 30A:
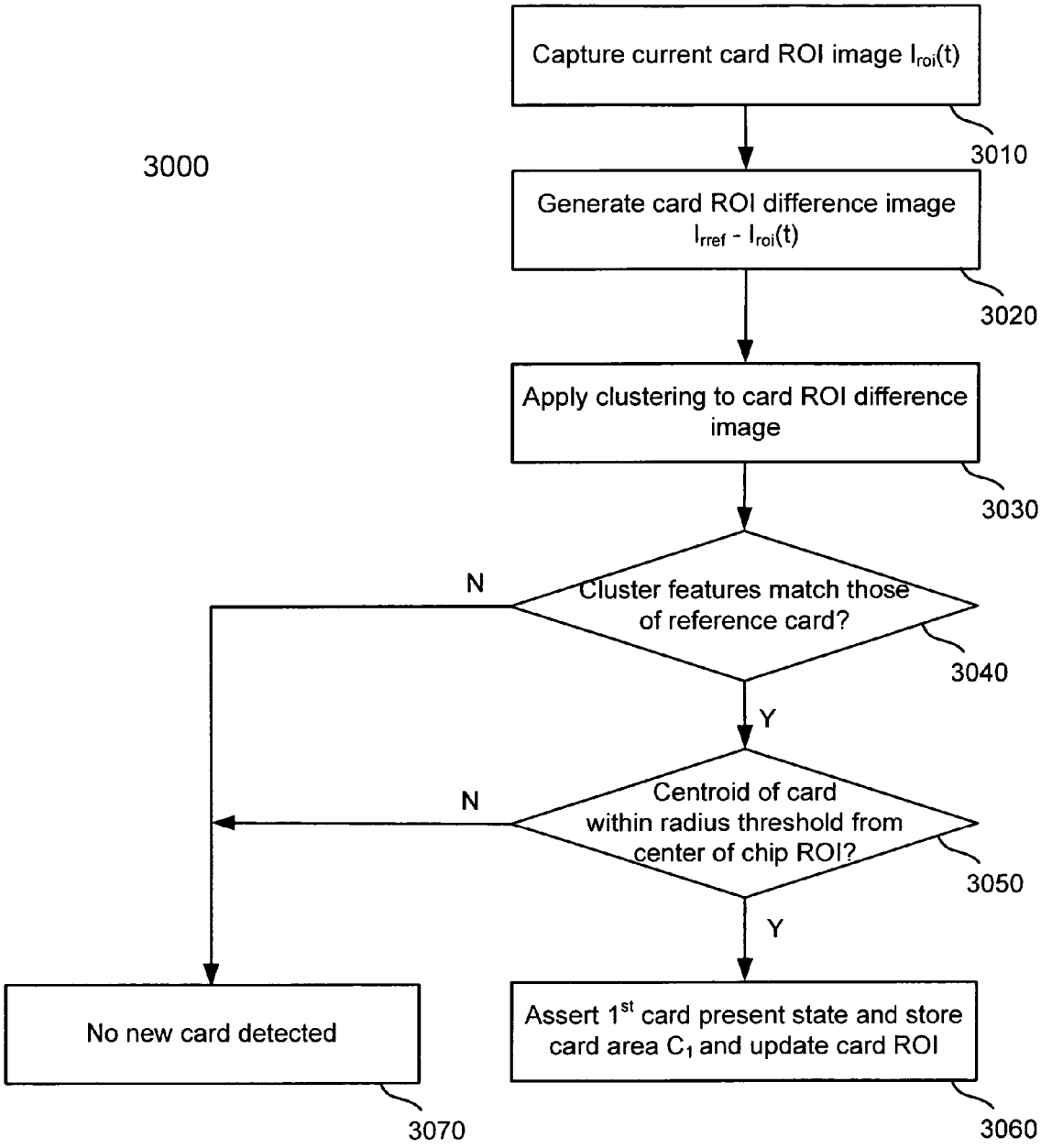
FIG. 30A illustrates one embodiment of a method for determining whether a first card is present in a card ROI.
Figure 30B:
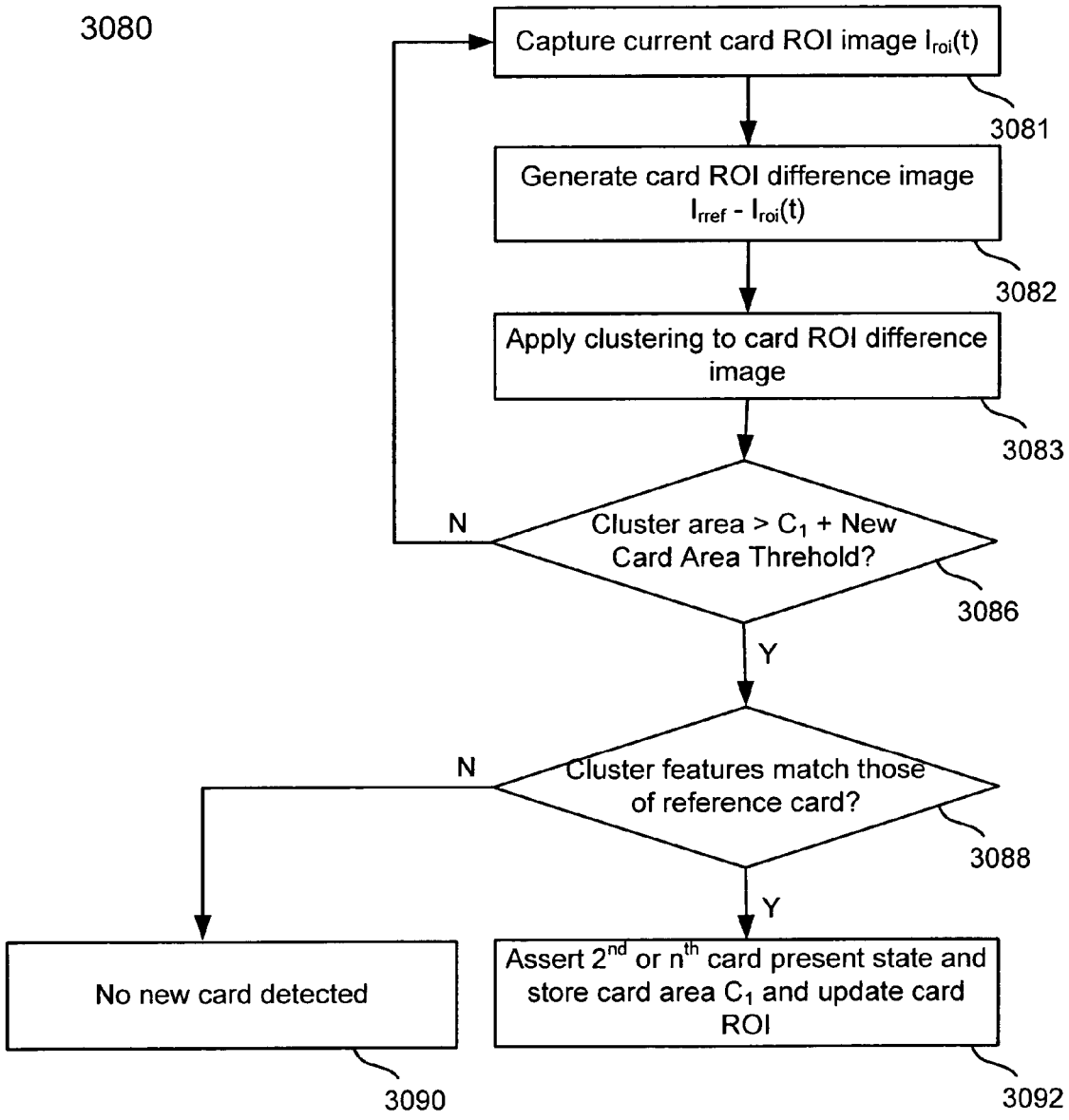
FIG. 30B illustrates one embodiment of a method for determining whether an additional card is present in a card ROI.

FIG. 30 illustrates an embodiment of a method 3000 for determining whether to assert a first card present state. The current card region of interest (ROI) image is captured at step 3010. Next, a card ROI difference image is generated at step 3020. In one embodiment, the card ROI difference image is generated as the difference between a running reference image and the current ROI image. In a prefer embodiment, the running reference image is the card ROI of the empty reference image with the chip ROI cut out and replaced with the chip ROI containing the chip as determined at step 2970. Binarization and clustering are performed to the card ROI difference image at step 3030. In one embodiment, erosion and dilation are performed prior to clustering. Binarization and clustering can be performed as discussed in more detail above. Next, a determination is made as to whether cluster features of the difference image match the features of a card at step 3040. This step is illustrated in method 1300. In one embodiment, the reference card features are retrieved from information stored during the calibration phase. If cluster features do not match the features of the reference card, operation continues to step 3070 where no new card is detected. In one embodiment, a determination that no new card is detected indicates no transition will occur from state 2708 to state 2710 of FIG. 27. If cluster features do match a reference card at step 3040, operation continues to step 3050.

A determination is made as to whether the centroid of the cluster is within the some radius threshold from the center of the chip ROI at step 3050. If the centroid is within the radius threshold, then operation continues to step 3060. If the centroid is not within the radius threshold from the center of the chip ROI, then operation continues to step 3070 where a determination is made that no new card is detected. At step 3060, a first card present event is asserted, the card cluster area is stored, and the card ROI is updated. In one embodiment, the assertion of the first card present event triggers a transition from state 2708 to state 2710 in the state machine diagram of FIG. 27. In one embodiment, the card ROI is updated by extending the ROI by a pre-defined number of pixels from the center of the newly detected card towards the dealer. In one embodiment this pre-defined number is the longer edge of the card. In another embodiment the pre-defined number may be 1.5 times the longer edge of the card.

Returning to state machine 2700, once the first card has been recognized, second card hunt state 2714 will be asserted. While in this state, a determination is made as to whether or not a second card has been detected with method 3050 FIG. 30A. Steps 3081, 3082, and 3083 are similar to steps 3010, 3020, 3030 of method 3000. Step 3086 compares the current cluster area to the previous cluster area C1. If the current cluster area is greater than the previous cluster area by some new card area threshold, then a possible new card has been delivered to the player. Operation continues to step 3088 which is also illustrated in method 1300. Step 3088 determines if the features of the cluster match those of the reference card. If so, operation continues to step 3092. The $2^{nd}$ card or nth card is detect to be valid at step 3092. The cluster area is stored. The card ROI is updated. Once a second card is detected, a second card present state 2716 is asserted. Once the second card is determined to be present at state 2716, the second card is recognized at second card recognition state 2718. Split state 2720 is then asserted wherein the system then determines whether or not a player has split the two recognized cards with method 3100. If a player does split the cards recognized for that player, operation continues to second card hunt state 2714. If the player does not decide to split his cards, operation continues to Step 2722. A method for implementing split state 2718 is discussed in more detail below.

Figure 31:
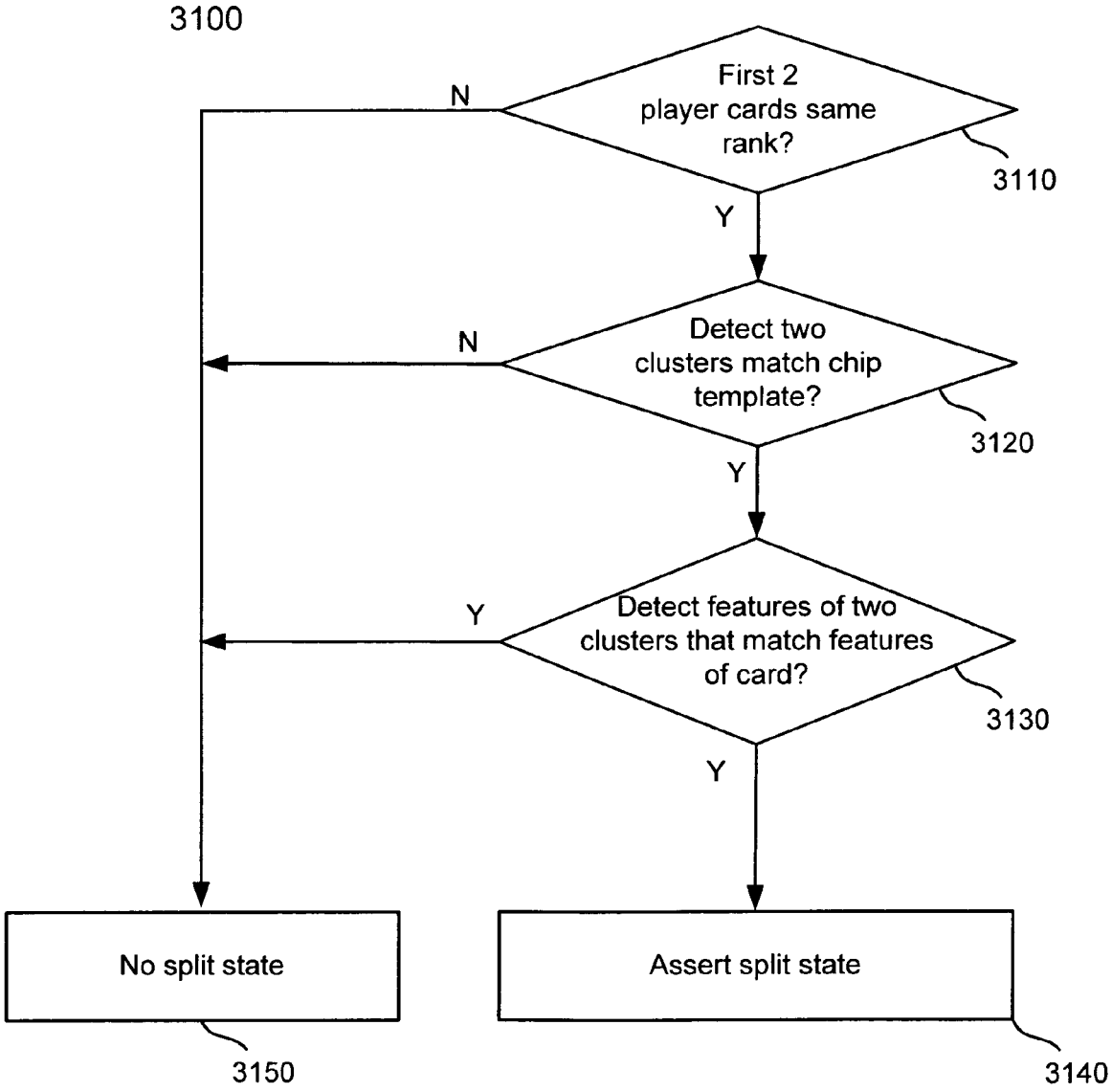
FIG. 31 illustrates one embodiment of a method for detecting a split.

FIG. 31 illustrates an embodiment of method 3100 for asserting a split state. In one embodiment, method 3100 is performed during split state 2720 of state diagram machine 2700. A determination is made as to whether the first two player cards have the same rank at step 3110. If the first two player cards do not have the same rank, then operation continues to step 3150 where no split state is detected. In one embodiment, a determination that no split state exists causes a transition from split state 2720 to state 2722 within FIG. 27. If the first two player cards have the same rank, a determination is made as to whether two clusters matching a chip template are detected at step 3120. In one embodiment, this determination detects whether an additional wager has been made by a user such that two piles of chips have been detected. This corresponds to a stack of chips for each split card or a double down bet. If two clusters are not determined to match a chip template at step 3120, operation continues to step 3150. If two clusters are detected to match chip templates at step 3120, then operation continues to step 3130. If the features of two more clusters are found to match the features of the reference card, then the split state is asserted at step 3140. Here the center of mass for cards and chips are calculated. The original ROI is now split in two. Each ROI now accommodates one set of chip and card. In one embodiment, asserting a split state triggers a transition from split state 2720 to second card hunt state 2724 within state machine diagram 2700 of FIG. 27. And the state machine diagram 2700 is duplicated. Each one representing one split hand. For each split card, the system will detect additional cards dealt to the player one card at a time.

The state machine determines whether the current player has a score of twenty-one at state 2722. The total score for a player is maintained as each detected card is recognized. If the current player does have twenty-one, an end of play state 2726 is asserted. In another embodiment, the end of play state is not asserted when a player does have 21. If a player does not have twenty-one, an Nth card recognition state 2724 is asserted. Operations performed while in Nth card recognition state are similar to those performed while at second card hunt state 2714, $2^{nd}$ card present state 2716 and $2^{nd}$ card recognition state 2718 in that a determination is made as to whether an additional card is received and then recognized.

Once play has ended for the current player at Nth card recognition state 2724, then operation continues to end of play state 2726. States 2704 through 2726 can be implemented for each player in a game. After the end of play state 2726 has been reached for every player in a game, state machine 2700 transitions to dealer up card detection state 2728.

Figure 32:
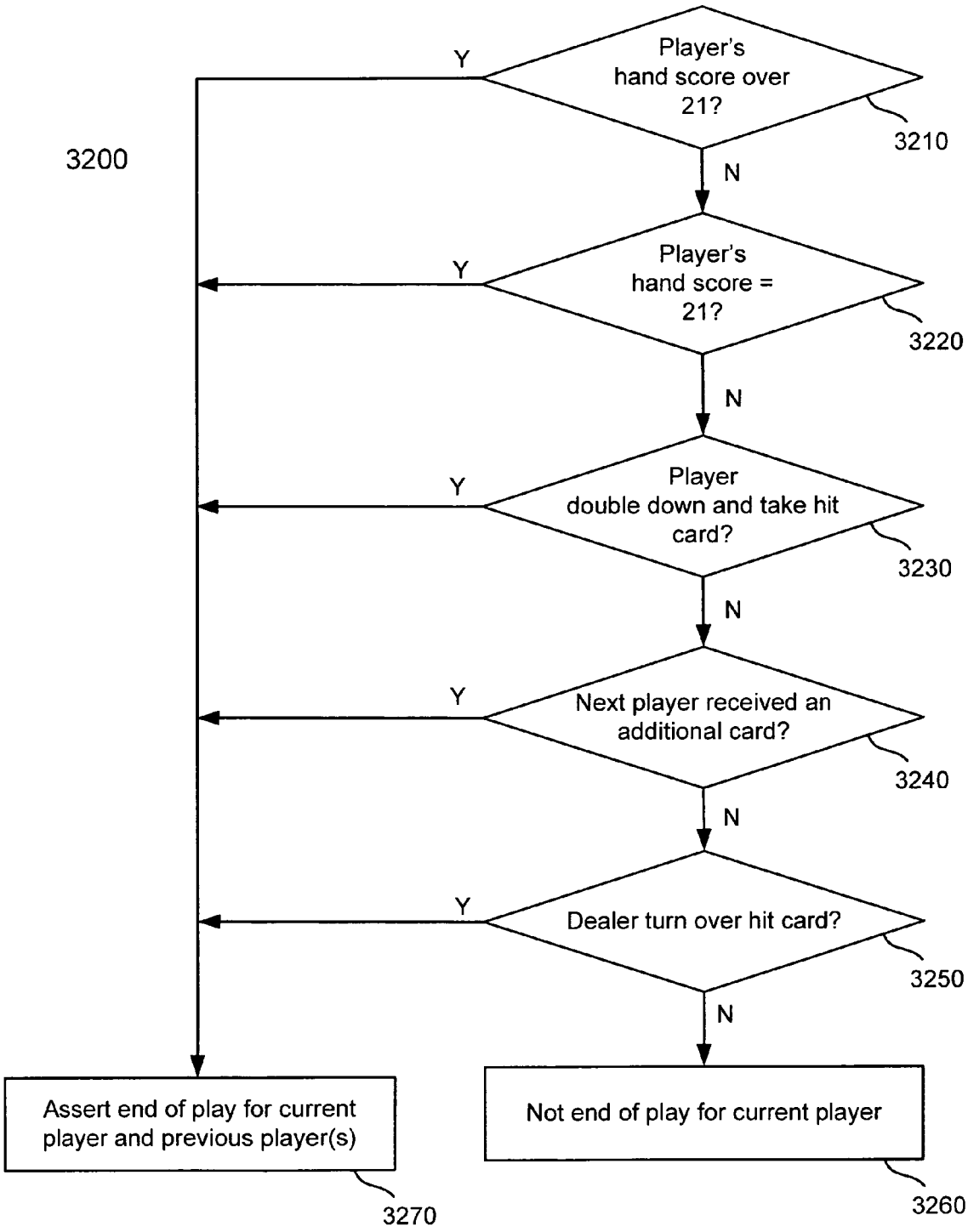
FIG. 32 illustrates one embodiment of a method for detecting end of play for a current player.

FIG. 32 illustrates an embodiment of a method 3200 for determining an end of play state for a return player. In one embodiment, the process of method 3200 can be performed during implementation of states 2722 through states 2726 of FIG. 27. First, a determination is made as to whether a player's score is over 21 at step 3210. In one embodiment, this determination is made during an Nth card recognition state 2724 of FIG. 27. If a player's score is over 21, the operation continues to step 3270 where an end of play state is asserted for the current player. If the player's score is not over 21, the system determines whether the player's score is equal to 21 at step 3220. This determination can be made at state 2722 of FIG. 27. If the player's score is equal to 21, then operation continues to step 3270. If the player's hand value is not equal to 21, then the system determines whether a player has doubled down and taken a hit card at step 3120. In one embodiment, the system determines whether a player has only been dealt two cards and an additional stack of chips is detected for that player. In on embodiment step 3220 is bypassed to allow a player with an ace and a rank 10 card to double down.

If a player has doubled down and taken a hit card at step 3230, operation continues to step 3270. If the player has not doubled down and received a hit card, a determination is made as to whether next player has received a card at step 3240. If the next player has received a card, then operation continues to step 3270. If the next player has not received a card, a determination is made at step 3250 as to whether the dealer has turned over a hole card. If the dealer has turned over a hole card at step 3250, the operation continues to step 3270. If the dealer has not turned over a hole card at step 3250, then a determination is made that the end of play for the current player has not yet been reached at step 3260.

In one embodiment, end of play state is asserted when either a card has been detected for next player, a split for the next player, or a dealer hole card is detected. In this state, the system recognizes that a card for the dealer has been turned up. Next, up card recognition state 2730 is asserted. At this state, the dealer's up card is recognized.

Returning to state machine 2700, a determination is made as to whether the dealer up card is recognized to be an ace at state 2732. If the up card is recognized to be an ace at state 2732, then insurance state 2734 is asserted. The insurance state is discussed in more detail below. If the up card is not an ace, dealer hole card recognition state 2736 is asserted.

After insurance state 2734, the dealer hole card state is asserted. After dealer hole card state 2736 has occurred, dealer hit card state 2738 is asserted. After a dealer plays out house rules, a payout state 2740 is asserted. Payout is discussed in more detail below. After payout 2740 is asserted, operation of the same machine continues to initialization state 2702.

Figure 33:
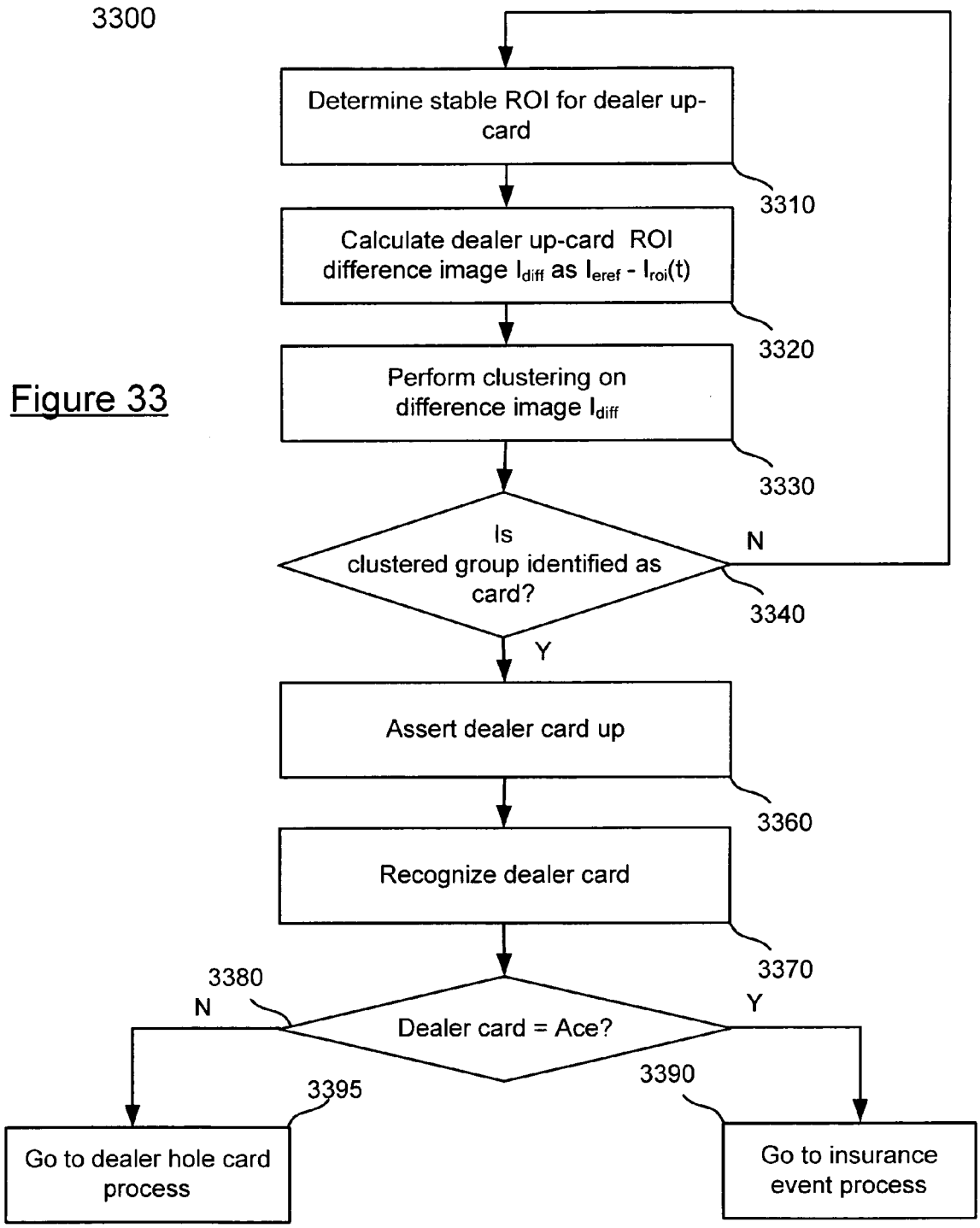
FIG. 33 illustrates one embodiment of a method for monitoring dealer events within a game.

FIG. 33 illustrates an embodiment of a method 3300 from monitoring dealer events within a game. In one embodiment, steps 3380 through 3395 of method 3300 correspond to states 2732, 2734, and 2736 of FIG. 27. A determination is made that a stable ROI for a dealer up card is detected at step 3310. Next, the dealer up-card ROI difference image is calculated at step 3320. In one embodiment, the dealer up-card ROI difference image is calculated as the difference between the empty reference image of the dealer up-card ROI and a current image of the dealer up-card ROI. Next, binarization and clustering are performed on the difference image at step 3330. In one embodiment, erosion and dilation are performed prior to clustering. A determination is then made as to whether the clustered group derived from the clustering process is identified as a card at step 3340. Card recognition is discussed in detail above. If the clustered group is not identified as a card at step 3340, operation returns to step 3310. If the clustered group is identified as a card, then operation continues to step 3360.

In one embodiment, asserting a dealer up card state at step 3360 triggers a transition from state 2726 to state 2728 of FIG. 27. Next, a dealer card is then recognized at step 3370. Recognizing the dealer card at step 3370 triggers the transition from state 2728 to state 2730 of FIG. 27. A determination is then made as to whether the dealer card is an ace at step 3380. If the dealer card is detected to be an ace at step 3380, operation continues to step 3390 where an insurance event process is initiated. If the dealer card is determined not to be an ace, dealer hole card recognition is initiated at step 3395.

Figure 34:
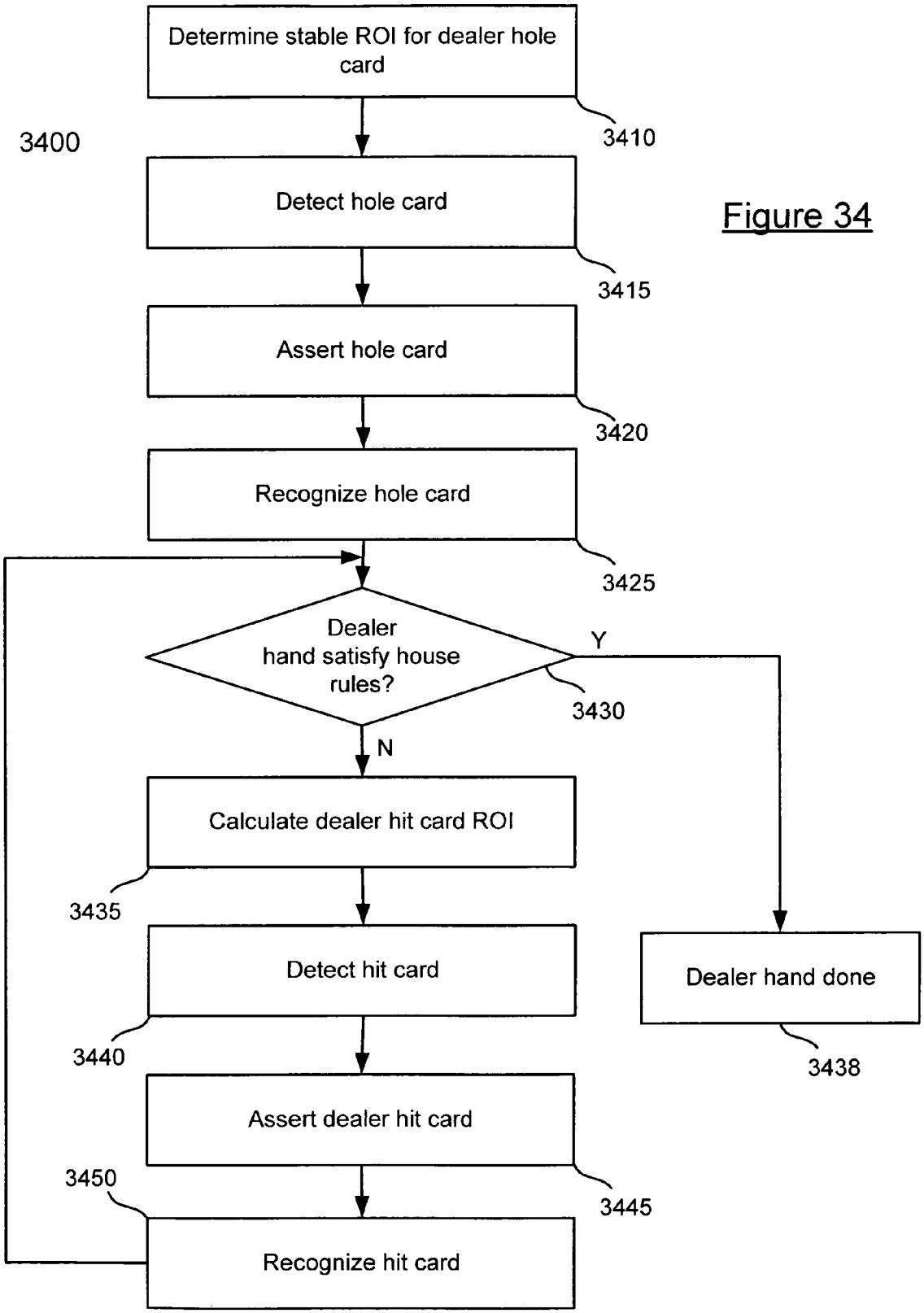
FIG. 34 illustrates one embodiment of a method for detecting dealer cards.

FIG. 34 illustrates an embodiment of a method 3400 for processing dealer cards. A determination is made that a stable ROI exists for a dealer hole card ROI at step 3410. Next the hole card is detected at step 3415. In one embodiment, identifying the hole card includes performing steps 3320-3350 of method 3300. A hole card state is asserted at step 3420. In one embodiment, asserting hole card state at step 3420 initiates a transition to state 2736 of FIG. 27. A hole card is then recognized at step 3425. A determination is then made as to whether the dealer hand satisfies house rules at step 3430. In one embodiment, a dealer hand satisfies house rules if the dealer cards add up to at least 17 or a hard 17. If the dealer hand does not satisfy house rules at step 3430, operation continues to step 3435. If the dealer hand does satisfy house rules, operation continues to step 3438 where the dealer hand play is complete.

A dealer hit card ROI is calculated at step 3435. Next, the dealer hit card ROI is detected at step 3440. A dealer hit card state is then asserted at step 3435. A dealer hit card state assertion at step 3445 initiates a transition to state 2738 of FIG. 27. Next, the hit card is recognized at step 3450. Operation of method 3400 then continues to step 3430.

Figure 35:
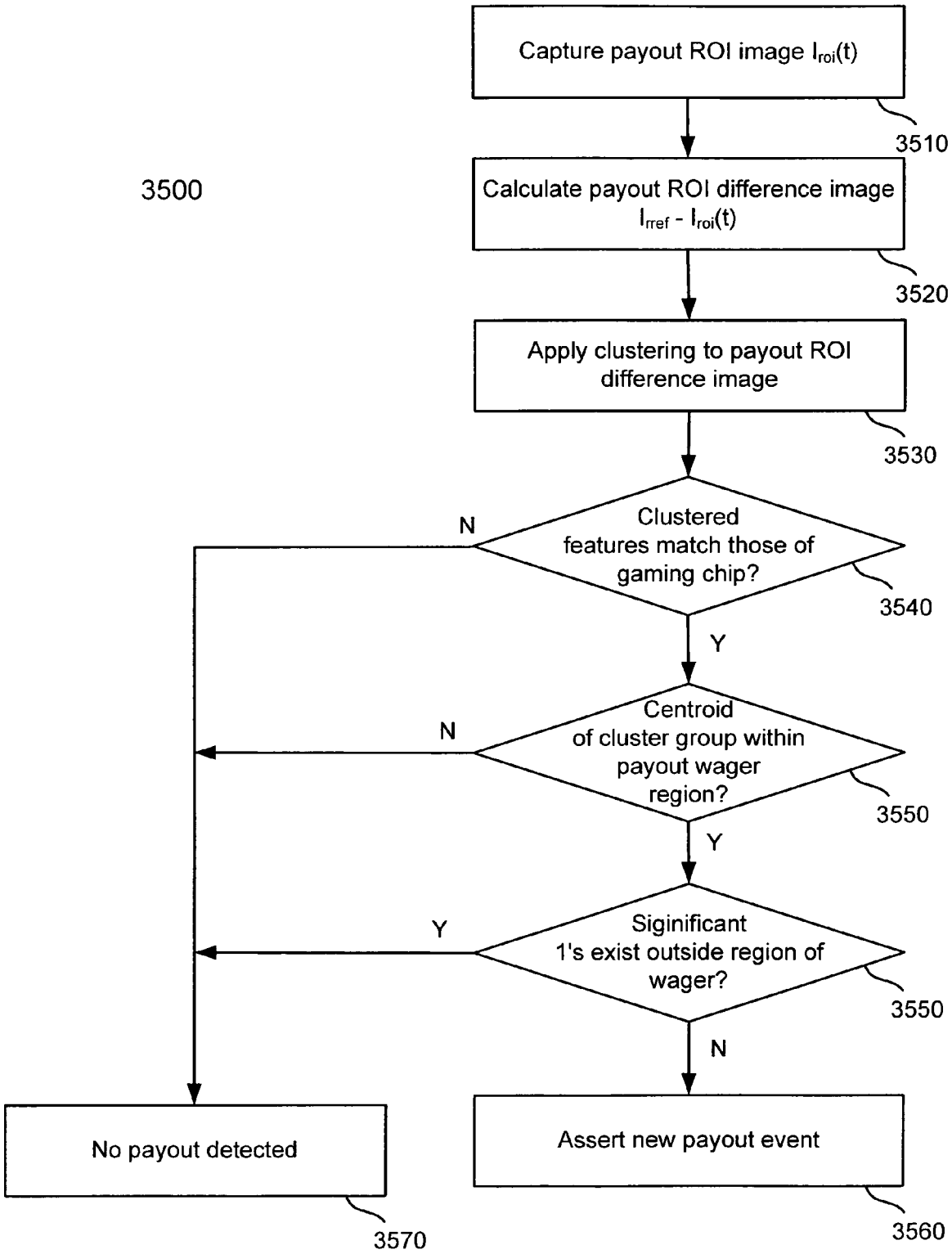
FIG. 35 illustrates one embodiment of a method for detecting payout.

FIG. 35 illustrates an embodiment of a method 3500 for determining the assertion of a payout state. In one embodiment, method 3500 is performed while state 2738 is asserted. First, a payout ROI image is captured at step 3510. Next, the payout ROI difference image is calculated at step 3520. In one embodiment, the payout ROI difference image is generated as the difference between a running reference image and the current payout ROI image. In this case the running reference image is the image captured after the dealer hole card is detected and recognized at step 3425. Binarization and clustering are then performed to the payout ROI difference image at step 3530. Again, erosion and dilation may be optionally be implemented to remove "salt-n-pepper" noise. A determination is then made as to whether the clustered features of the difference image match those of a gaming chip at step 3540. If the clustered features do not match at a chip template, operation continues to step 3570 where no payout is detected for that user. If the clustered features do match those of gaming chip, then a determination is made at step 3550 as to whether the centroid of the clustered group is within the payout wager region. If the centroid of the clustered group is not within a payout wager region, operation continues to step 3570. If the centroid is within the wager region, a determination is made as to whether significant one value pixels exist outside the region of wager at step 3550. If significant one value pixels exist outside the region of wager, operation continues to step 3570. If significant one value pixels do not exist outside the region of wager, then operation continues to step 3560 where a new payout event is asserted.

The transition from payout state 2738 to init state 2702 occurs when cards in the active player's card ROI are detected to have been removed. This detection is performed by comparing the empty reference image to the current image of the active player's card ROI.

The state machine in FIG. 27 illustrates the many states of the game monitoring system. A variation of the illustrated state may be implemented. In one embodiment, the state machine 2700 in FIG. 27 can be separated into the dealer hand state machine and the player hand state machine. In another embodiment some states may be deleted from one or both state machines while additional states may be added to one or both state machines. This state machine can then be adapted to other types of game monitoring, including baccarat, craps, or roulette. The scope of the state machine is to keep track of game progression by detecting gaming events. Gaming events such as doubling down, split, payout, hitting, staying, taking insurance, surrendering, can be monitored and track game progression. These gaming events, as mentioned above, may be embedded into the first camera video stream and sent to DVR for recording. In another embodiment, these gaming events can trigger other processes of another table games management.

Data Analysis

Once the system of the present invention has collected data from a game, the data may be processed in a variety of ways. For example, data can be processed and presented to aid in game security, player and game operator progress and history, determine trends, maximize the integrity and draw of casino games, and a wide variety of other areas.

In one embodiment, data processing includes collecting data and analyzing data. The collected data includes, but is not limited to, game date, time, table number, shoe number, round number, seat number, cards dealt on a per hand basis, dealer's hole card, wager on a per hand basis, pay out on per hand basis, dealer ID or name, and chip tray balance on a per round basis. One embodiment of this data is shown in Table 6. Data processing may result in determining whether to "comp" certain players, attempt to determine whether a player is strategically reducing the game operator's take, whether a player and game operator are in collusion, or other determinations.

tion information, and the tray balance. In one embodiment, the time column of subsequent hand(s) may be used to identify splits and/or double down.

The event and object recognition algorithm utilizes streaming videos from first camera and supplemental cameras to extract playing data as shown in Table 6. The data shown is for blackjack but the present invention can collect game data for baccarat, crabs, roulette, paigow, and other table games. Also, the chip tray balance will be extracted on a "per round" basis.

Casinos often determine that certain players should receive compensation, or "comps", in the form of casino lodging so they will stay and gamble at their casino. One example of determing a "comp" is per the equation below:

Player Comp=average bet*hands/hour*hours played*house advantage*re-investment %.

In one embodiment, a determination can be made regarding player comp using the data in Table 6. The actual theoretical house advantage can be determined rather than estimated. Theoretical house advantage is inversely related to theoretical skill level of a player. The theoretical skill level of a player will be determined from the player's decision based on undealt cards and the dealer's up card and the player's current hand. The total wager can be determined exactly instead of estimated as illustrated in Table 7. Thus, based on the information in Table 6, an appropriate compensation may be determined instantaneously for a particular player.

Casinos are also interested in knowing if a particular player is implementing a strategy to increase his or her odds of

TABLE 6

Data collected from image processing

| Date | Time | table # | Shoe# | rd# | seat # | Cards (hole) | Wager | Insurance | Payout | Dealer ID | Tray Balance |
|---|---|---|---|---|---|---|---|---|---|---|---|
| Oct. 10, 1913 | 1:55:26 pm | 1 | 1 | 1 | Dlr | 10-(6)-9 | | | | Xyz | $2100 |
| Oct. 10, 2003 | 1:55:26 pm | 1 | 1 | 1 | 2 | 10-2-4 | $50 | | $50 | Xyz | |
| Oct. 10, 2003 | 1:55:26 pm | 1 | 1 | 1 | 5 | 10-10 | $50 | | $50 | Xyz | |
| Oct. 10, 2003 | 1:55:26 pm | 1 | 1 | 1 | 7 | 9-9 | $50 | | $50 | Xyz | |
| Oct. 10, 2003 | 1:755:27 pm | 1 | 1 | 2 | Dlr | 10-(9) | | | | Xyz | $1950 |
| Oct. 10, 2003 | 1:755:27 pm | 1 | 1 | 2 | 2 | 10-10 | $50 | | $50 | Xyz | |
| Oct. 10, 2003 | 1:755:27 pm | 1 | 1 | 2 | 5 | 10-6-7 | $50 | | ($50) | Xyz | |
| Oct. 10, 2003 | 1:755:27 pm | 1 | 1 | 2 | 7 | A-10 | $50 | | $75 | Xyz | |
| Oct. 10, 2003 | 1:855:28 pm | 1 | 1 | 3 | Dlr | A-(10) | | | | Xyz | $1875 |
| Oct. 10, 2003 | 1:855:28 pm | 1 | 1 | 3 | 2 | 10-9 | $50 | $25 | 0 | Xyz | |
| Oct. 10, 2003 | 1:855:28 pm | 1 | 1 | 3 | 5 | 9-9 | $50 | | ($50) | Xyz | |
| Oct. 10, 2003 | 1:855:28 pm | 1 | 1 | 3 | 7 | A-8 | $50 | | ($50) | Xyz | |
| Oct. 10, 2003 | 1:955:29 pm | 1 | 1 | 4 | D | 6-(5)-9 | | | | Xyz | 1975 |
| Oct. 10, 2003 | 1:955:30 pm | 1 | 1 | 4 | 2 | A-5-2 | $50 | | ($50) | Xyz | |
| Oct. 10, 2003 | 1:955:30 pm | 1 | 1 | 4 | 2 | 10-5-10 | $50 | | ($50) | Xyz | |
| Oct. 10, 2003 | 2:01:29 pm | 1 | 1 | 5 | D | 5-(5)-9 | | | | Xyz | 1925 |
| Oct. 10, 2003 | 2:01:30 pm | 1 | 1 | 5 | 2 | A-5-5 | $50 | | 50 | Xyz | |
| Oct. 10, 2003 | 2:01:30 pm | 1 | 1 | 5 | 3 | 10-5-10 | $50 | | ($50) | Xyz | |
| Oct. 10, 2003 | 2:02:29 pm | 1 | 1 | 6 | D | 9-(10) | | | | Xyz | |
| Oct. 10, 2003 | 2:02:30 pm | 1 | 1 | 6 | 2 | 8-4-8 | $50 | | 50 | Xyz | |
| | split | | | 6 | 2 | 8-10 | $50 | | (50) | Xyz | |
| Oct. 10, 2003 | 2:02:30 pm | 1 | 1 | 6 | 3 | 10-5-10 | $50 | | ($50) | Xyz | |
| Oct. 10, 2003 | 2:03:29 pm | 1 | 1 | 7 | D | 7-(3)-9 | | | | Xyz | 1825 |
| Oct. 10, 2003 | 2:03:30 pm | 1 | 1 | 7 | 2 | 8-2-10 | $150 | | 150 | Xyz | |
| | Split, double | | | 7 | 2 | | $150 | | 150 | Xyz | |
| | Split | | | | 2 | 8-7-10 | $150 | | (150) | | |
| Oct. 10, 2003 | 2:03:30 pm | 1 | 1 | 7 | 3 | 10-5-10 | $50 | | ($50) | Xyz | |

Table 6 includes information such as date and time of game, table from which the data was collected, the shoe from which cards were dealt, rounds of play, player seat number, cards by the dealer and players, wagers by the players, insurance placed by players, payouts to players, dealer identification information, and the tray balance. In one embodiment, the time column of subsequent hand(s) may be used to identify splits and/or double down.

winning, such as counting cards in card game. Based on the data retrieved from Table 6, player ratings can be derived and presented for casino operators to make quick and informed decisions regarding a player. An example of player rating information is shown in Table 7.

TABLE 7

| Player Ratings | | | | | | | | |
|---|---|---|---|---|---|---|---|---|
| Date | Player | Duration | Total Wagered | Theoretical House Advantage | Theoretical Win | Actual Win | Comp | Counting |
| Jan. 1, 2003 | 1101 | 2 h 30 m | $1000 | −2 | −200 | −1000 | 0 | Probable |
| Jan. 1, 2003 | 1102 | 2 h 30 m | $1000 | 1 | 100 | 500 | 50 | No |

Other information that can be retrieved from the data of Table 6 includes whether or not a table needs to be filled or credited with chips or whether a winnings pick-up should be made, the performance of a particular dealer, and whether a particular player wins significantly more at a table with a particular dealer (suggesting player-dealer collusion). Table 8 illustrates data derived from Table 6 that can be used to determine the performance of a dealer.

TABLE 8

| Dealer Performance | | |
|---|---|---|
| | Dealer 1101 | Dealer 1102 |
| Elapsed Time | 60 min | 60 min |
| Hands/Hr | 100 | 250 |
| Net | −500 | 500 |
| Short | 100 | 0 |
| Errors | 5 | 0 |

A player wager as a function of the running count can be shown for both recreational and advanced players in a game. An advanced user will be more likely than a recreational user to place higher wagers when the running count gets higher. Other scenarios that can be automatically detected include whether dealer dumping occurred (looking at dealer/player cards and wagered and reconciled chips over time), hole card play (looking a player's decision v. the dealer's hole card), and top betting (a difference between a players bet at the time of the first card and at the end of the round).

The present invention provides a system and method for monitoring players in a game, extracting player and game operator data, and processing the data. In one embodiment, the present invention captures the relevant actions and/or the results of relevant actions of one or more players and one or more game operators in game, such as a casino game. The system and methods are flexible in that they do not require special gaming pieces to collect data. Rather, the present invention is calibrated to the particular gaming pieces and environment already in used in the game. The data extracted can be processed and presented to aid in game security, player and game operator progress and history, determine trends, maximize the integrity and draw of casino games, and a wide variety of other areas. The data is generally retrieved through a series of cameras that capture images of game play from different angles.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A method for recognizing a game element in a game environment, comprising:

(a) capturing an initial calibration image of a game environment background surface associated with an expected location of a gaming piece;

(b) capturing a reference image of a background surface within a game environment;

(c) storing the reference image of the background surface within the game environment;

(d) detecting by the computing device a start of a game within the game environment;

(e) capturing a current image of the background surface within the game environment after the game has started;

(f) detecting by the computing device the presence of a gaming card by comparing the reference image and the current image to identify differences between the reference image and the current image, the differences associated with the presence of the gaming card;

(g) comparing by the computing device a portion of the initial calibration image of the game environment background surface to a corresponding portion of the current image of the game environment background surface, the portion associated with the game environment background surface;

(h) detecting change in pixel intensity values for the for the portion associated with the background surface of the game environment, the current image of the game environment captured of the game environment during a game;

(i) capturing a second calibration image of the background surface with an updated camera setting in response to the illumination detected change in pixel intensity values determined by comparing the reference image of the game environment to the current image of the game environment captured during a game, the detected change in illumination triggering a calibration event which triggered the capturing of the second calibration image, the camera setting updated based on the illumination change;

(j) storing the second calibration image; and (k) repeating the steps (e) through (j) based on the second calibration image and a second current image.

2. The method of claim 1, further comprising:

capturing a second reference image of a game environment by a second camera, the first reference image captured by a first camera positioned over the game environment;

mapping the position of one or more game objects in the first reference image to the position of the one or more game objects in the second reference image; and storing position mapping data for the one or more game objects based on said step of mapping the position of the one or more game objects, said step of comparing including, calculating the difference image from the reference image and the current captured image of the game environment during a game, applying a threshold to the difference image to identify pixels that satisfy a threshold, identifying sets of neighboring pixels that satisfy the threshold into one or more groups, determining geometric features of the one or more groups, and comparing the said geometric features of the one or more groups to stored calibration data.

3. The method of claim 1, further comprising:

capturing a first chip reference image by a second camera, the second camera positioned to capture a side view of a stack of one or more chips placed in the game environment;

capturing a second chip reference image by the second camera;

storing the first chip reference image and second chip reference image as a template; and deriving chip statistics for the chips in the stack of one or more chips from the stored template.

4. The method of claim 1, further comprising:

performing a calibration task in response to triggering a calibration event during game play, the calibration task including storing an image associated with a subset of the background surface of the gaming environment, the calibration event associated with the determined illumination change.

5. The method of claim 1, further comprising:

dividing the image into an array of regions, each region encompassing a portion of the background surface of the game environment; and generating image calibration information from image data for each array region, the image data derived from the image of the game environment.

6. The method of claim 5, wherein the image calibration information for each array region includes localized parameters for each array region for one or more cards, chips or a gaming surface for the particular array region.

7. The method of claim 5, wherein the image calibration information for each array region includes localized color space information for one or more cards, chips or a gaming surface.

* * * * *